US007458567B2

(12) United States Patent
Yamada et al.

(10) Patent No.: US 7,458,567 B2
(45) Date of Patent: Dec. 2, 2008

(54) SHEET FINISHER AND IMAGE FORMING SYSTEM USING THE SAME

(75) Inventors: Kenji Yamada, Tokyo (JP); Masahiro Tamura, Kanagawa (JP); Nobuyoshi Suzuki, Tokyo (JP); Hiromoto Saitoh, Kanagawa (JP); Shuuya Nagasako, Tokyo (JP); Junichi Iida, Kanagawa (JP); Hiroki Okada, Kanagawa (JP); Akihito Andoh, Kanagawa (JP); Naohiro Kikkawa, Tokyo (JP); Junichi Tokita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/584,502

(22) Filed: Oct. 23, 2006

(65) Prior Publication Data

US 2007/0035080 A1 Feb. 15, 2007

Related U.S. Application Data

(62) Division of application No. 10/361,762, filed on Feb. 11, 2003, now Pat. No. 7,137,625.

(30) Foreign Application Priority Data

| | | |
|---|---|---|
| Feb. 12, 2002 | (JP) | 2002-034626 |
| Mar. 20, 2002 | (JP) | 2002-079471 |
| Jun. 3, 2002 | (JP) | 2002-162134 |
| Dec. 6, 2002 | (JP) | 2002-355714 |
| Dec. 6, 2002 | (JP) | 2002-355731 |
| Dec. 26, 2002 | (JP) | 2002-378464 |
| Dec. 26, 2002 | (JP) | 2002-378478 |

(51) Int. Cl.
*B65H 37/04* (2006.01)

(52) U.S. Cl. ..... 270/58.07; 270/52.17; 493/370; 493/371; 83/280; 83/483; 83/485; 83/488; 83/491; 83/495; 83/934

(58) Field of Classification Search ..... 270/58.07, 270/52.17; 493/370, 371; 399/407; 412/16; 83/280, 483, 485, 488, 491, 495, 934
See application file for complete search history.

(56) References Cited

U.S. PATENT DOCUMENTS

| | | | | |
|---|---|---|---|---|
| 3,146,650 | A * | 9/1964 | Sarring et al. | 83/91 |
| 4,011,779 | A | 3/1977 | Berg | |

(Continued)

FOREIGN PATENT DOCUMENTS

| | | |
|---|---|---|
| JP | 2-139198 | 5/1990 |

(Continued)

*Primary Examiner*—Gene O. Crawford
*Assistant Examiner*—Leslie Nicholson, III
(74) *Attorney, Agent, or Firm*—Oblon, Spivak, McClelland, Maier & Neustadt, P.C.

(57) ABSTRACT

A sheet finisher for performing preselected processing with a sheet or a sheet stack conveyed thereto of the present invention includes a cutter unit configured to cut the sheet or the sheet stack in a direction perpendicular to a direction of sheet conveyance. A guide member is positioned upstream of the cutter unit in the direction of sheet conveyance for guiding the sheet or the sheet stack being conveyed. A moving device moves the guide member in a direction parallel to the direction of sheet conveyance.

18 Claims, 46 Drawing Sheets

U.S. PATENT DOCUMENTS

| | | | | |
|---|---|---|---|---|
| 4,281,757 | A * | 8/1981 | Morton | 198/358 |
| 4,436,469 | A * | 3/1984 | Kelly | 412/16 |
| 4,891,681 | A | 1/1990 | Fiske et al. | |
| 5,377,965 | A * | 1/1995 | Mandel et al. | 270/37 |
| 5,692,411 | A | 12/1997 | Tamura | |
| 5,762,328 | A | 6/1998 | Yamada et al. | |
| 6,099,225 | A | 8/2000 | Allen et al. | |
| 6,103,288 | A * | 8/2000 | Kobayashi et al. | 426/503 |
| 6,145,825 | A | 11/2000 | Kunihiro et al. | |
| 6,199,853 | B1 | 3/2001 | Andoh et al. | |
| 6,231,045 | B1 | 5/2001 | Yamada et al. | |
| 6,264,191 | B1 | 7/2001 | Suzuki et al. | |
| 6,296,247 | B1 | 10/2001 | Tamura et al. | |
| 6,322,070 | B2 | 11/2001 | Yamada et al. | |
| 6,343,785 | B1 | 2/2002 | Yamada et al. | |
| 6,394,448 | B2 | 5/2002 | Suzuki et al. | |
| 6,416,052 | B2 | 7/2002 | Yamada et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,532,856 | B2 | 3/2003 | Kato et al. | |
| 6,549,734 | B2 | 4/2003 | Yamada et al. | |
| 6,562,171 | B1 | 5/2003 | Archie et al. | |
| 2001/0054342 | A1 * | 12/2001 | Kato et al. | 83/78 |
| 2002/0050676 | A1 * | 5/2002 | Sato et al. | 270/58.08 |
| 2002/0146302 | A1 | 10/2002 | Trovinger | |
| 2004/0113348 | A1 * | 6/2004 | Awano | 270/58.07 |

FOREIGN PATENT DOCUMENTS

| | | |
|---|---|---|
| JP | 03-50453 | 5/1991 |
| JP | 03-251390 | 11/1991 |
| JP | 4-331093 | 11/1992 |
| JP | 6-87297 | 3/1994 |
| JP | 6-214435 | 8/1994 |
| JP | 08-090855 | 4/1996 |
| JP | 8-216465 | 8/1996 |
| JP | 9-11185 | 1/1997 |
| JP | 2000-198613 | 7/2000 |
| JP | 2001-240298 | 9/2001 |

* cited by examiner

CENTER STAPLE & FOLD MODE

CENTER STAPLE & FOLD MODE

FIG. 31

| | | SHEET SIZE | A3 | B4 | A4 | B5 |
|---|---|---|---|---|---|---|
| | | FULL LENGTH | 420 | 367 | 297 | 257 |
| | | LC | 210 | 183.5 | 148.5 | 128.5 |
| L1 | NUMBER OF SHEETS TO BE STAPLED | 2 | 210.4 | 183.9 | 148.9 | 128.9 |
| | | 3 | 210.8 | 184.3 | 149.3 | 129.3 |
| | | 4 | 211.2 | 184.7 | 149.7 | 129.7 |
| | | 5 | 211.6 | 185.1 | 150.1 | 130.1 |
| | | 6 | 212 | 185.5 | 150.5 | 130.5 |
| | | 7 | 212.4 | 185.9 | 150.9 | 130.9 |
| | | 8 | 212.8 | 186.3 | 151.3 | 131.3 |
| | | 9 | 213.2 | 186.7 | 151.7 | 131.7 |
| | | 10 | 213.6 | 187.1 | 152.1 | 132.1 |
| | | 11 | 214 | 187.5 | 152.5 | 132.5 |
| | | 12 | 214.4 | 187.9 | 152.9 | 132.9 |
| | | 13 | 214.8 | 188.3 | 153.3 | 133.3 |
| | | 14 | 215.2 | 188.7 | 153.7 | 133.7 |
| | | 15 | 215.6 | 189.1 | 154.1 | 134.1 |
| | | | | | | |

SHEET FINISHER AND IMAGE FORMING SYSTEM USING THE SAME

CROSS-REFERENCE TO RELATED APPLICATIONS

The present application is a divisional of application Ser. No. 10/361,762, filed on Feb. 11, 2003, which claims priority to JP 2002-034626, filed Feb. 12, 2002; JP 2002-079471, filed Mar. 20, 2002; JP 2002-162134, filed Jun. 3, 2002; JP 2002-355714, filed Dec. 6, 2002; JP 2002-355731, filed Dec. 6, 2002; JP 2002-378464, filed Dec. 26, 2002; and JP 2002-378478, filed Dec. 26, 2002, the entire contents of each of which are incorporated by reference herein.

BACKGROUND OF THE INVENTION

1. Field of the Invention

The present invention relates to a sheet finisher mounted on or operatively connected to a copier, printer or similar image forming apparatus for stapling, punching, jogging or otherwise processing sheets or recording media carrying images thereon and then cutting sheets, and an image forming system using the same.

2. Description of the Background Art

There is extensively used a sheet finisher positioned at the downstream side of an image forming apparatus for, e.g., stapling a stack of sheets sequentially driven out of the image forming apparatus. Today, even a sheet finisher with multiple advanced functions including an edge and a center stapling function is available. However, a sheet finisher with such multiple functions is, in many cases, bulky or is limited as to the individual function because of the combination of various functions. For example, Japanese Patent Laid-Open Publication Nos. 07-48062 and 2000-153947 each propose a sheet finisher in which a path is switched at the inlet of the finisher to implement an edge and a center stapling function independent of each other. Although this kind of sheet finisher is feasible for a unit configuration and less-option application, combining similar functions is undesirable from the cost standpoint.

Further, in a center staple mode, the above sheet finisher is configured to jog and staple a sheet stack and then fold the sheet stack at the same position. This brings about a problem that the sheet finisher cannot deal with sheets belonging to the next job until it fully folds the sheets of the preceding job, resulting in low productivity.

In light of the above, Japanese Patent Laid-Open Publication Nos. 2000-118861 and 7-187479, for example, each disclose a sheet finisher of the type jogging and stapling, in an edge or a center staple mode, a sheet stack on a staple tray, which is inclined upward to the downstream side, switching back the stapled sheet stack to another tray positioned below the staple tray, and then folding the sheet stack. In this type of sheet finisher, a folding mechanism is independent of the other mechanisms and enhances productivity while minimizing an increase in cost ascribable to overlapping mechanisms. However, to enhance productivity, the staple tray is located at a high level in order to make the folding mechanism sufficiently long. As a result, two trays are connected together in a "<" configuration and make the entire sheet finisher bulky.

On the other hand, Japanese Patent Laid-Open Publication No. 2000-63031 teaches a sheet finisher configured to fold a sheet stack extending from a staple tray, thereby reducing the size of the sheet finisher. This, however, prevents productivity from being enhanced. Further, Japanese Patent Laid-Open Publication Nos. 11-286368 and 2000-86067 each propose a sheet finisher in which a fold roller pair is positioned slightly above the center portion of a staple tray so as to directly fold a stapled sheet stack, thereby implementing the shared use of a tray or reducing the length of a path. However, this configuration not only fails to enhance productivity, but also increases the size of the sheet finisher because the fold roller pair is positioned above the staple tray, which is inclined upward to the downstream side. In addition, a folded sheet stack is driven out of the sheet finisher at a relatively high level, so that the amount of usual edge-stapled sheet stacks that can be stacked is reduced.

Japanese Patent Laid-Open Publication Nos. 2000-198613 and 2000-103567 each disclose a value-added sheet finisher additionally provided with an edge cutting function. Such a sheet finisher includes either one of a guillotine type of cutter movable up and down and a shuttle type of cutter customary with, e.g., a facsimile apparatus or a plotter. Conventional sheet finishers each using the guillotine type of cutter or the shuttle type of cutter have the following problems (1) through (5) left unsolved.

(1) The cutter taught in the above Laid-Open Publication No. 2000-103567, for example, is a guillotine type of cutter. Generally, although a guillotine type of cutter is bulky and needs a large-output drive source, it has a sufficient height in a portion for delivering a sheet stack to a cutting portion and therefore does not need special means for insuring conveyance. However, in the case where a sheet stack is directly conveyed to a cutter portion by a roller pair just preceding the cutter portion, conveyance quality is questionable and will be a grave issue in consideration of further size reduction expected in the future.

The sheet finisher of Laid-Open Publication No. 2000-198613 also mentioned earlier includes an angularly movable guide plate just preceding a cutting portion and retractable in accordance with the movement of an elevatable cutting edge. However, this guide plate scheme is not easily applicable to the shuttle type of cutter, because the direction in which a shuttle moves and the direction in which the guide plate retracts would be perpendicular to each other. Further, while the guillotine type cutter allows sheet scraps to be easily dropped because of its movement, the shuttle type of cutter cannot do so and needs a sufficiently large opening for scraps to drop. Moreover, in the shuttle type of cutter, the opening is largest in the vicinity of the bottom dead center of a rotary edge, but slightly reduced at opposite sides of the bottom dead center. It is therefore likely that scraps staying around the rotary edge due to some cause close the opening when the rotary edge retracts.

(2) The shuttle type of cutter is feasible for a small size, power-saving configuration, as known in the art, and will probably be predominant over the guillotine type of cutter in the future. However, the probability of defective cutting increases with the shuttle type of cutter when it comes to small-size configuration. Further, if a sufficient cut margin is not available for structure reasons, then scraps are likely to curl and wrap around the rotary edge, causing an error to occur. When this kind of error occurs during cutting, the rotary edge stops while nipping a sheet stack and makes it impossible to remove the sheet stack. Generally, while the guillotine type of cutter allows such an error to be simply detected if one rotation of a cam is detected, the shuttle type of cutter cannot do so because it moves horizontally.

Other sheet finishers using the shuttle type of cutter are disclosed in, e.g., Japanese Patent Laid-Open Publication Nos. 2000-62262, 2001-88384 and 5-88271. Among them, the sheet finisher of Laid-Open Publication No. 2000-62262 is configured to reduce the cutting time when a medium has a small width, but does not addresses to an error to occur when a sheet stack is being cut. The sheet finisher of Laid-Open Publication No. 2001-88384 is configured to estimate the time for replacing a cutter and cause a replacement time sensing portion to output an alarm message or an alarm tone meant for the user. Further, the sheet finisher of Laid-Open Publication No. 5-88271 contemplates to promote easy replacement of a sheet stack jamming a path. For this purpose, this sheet finisher determines, based on whether or not a cutter has returned to its initial position within a preselected time, whether or not a jam has occurred. Even when a jam has occurred, the sheet finisher continuously drives the cutter to fully cut a sheet stack, prepares a magazine adjacent the cutter for removal, and then displays the jam.

(3) With the guillotine type of cutter, it is possible to make a cut margin noticeably small by adjusting alignment of both cutting edges. On the other hand, if the cut margin is extremely small, then the shuttle type of cutter causes scraps to deform like curled strips and causes them be caught by the rotary edge.

(4) Another problem with the shuttle type of cutter is that the rotary edge has a relatively small diameter, so that a load noticeably varies when the rotary edge starts cutting a relatively thick sheet stack. Consequently, a force tending to shift the sheet stack acts on the sheet stack and causes it to be shifted or scratched. Further, when use is made of a stepping motor, it is likely that the motor fails to follow the sharp change in load and is brought out of synchronism.

(5) The guillotine type of cutter cuts the entire sheet stack in a relatively short time, so that the resulting scraps drop to a position substantially beneath the sheet stack. Therefore, scraps cut away from consecutive sheet stacks are sequentially piled up around the center of the sheet stack because sheets are generally conveyed with the center as a reference without regard to the sheet size. Because a hopper for storing the scraps has a sufficiently larger width than the sheet width, the pile of scraps naturally collapses and can be stored in the hopper in a large amount.

On the other hand, the shuttle type of cutter cuts a sheet stack in one direction over a substantial period of time, so that the resulting scraps hang down from the sheet stack until the sheet stack has been fully cut. Consequently, the scraps fully cut away from the sheet stack drop to a position adjacent a position where the cutting stroke ends and shifted from the center of a hopper. One side of such scraps lean on the wall of the hopper. As a result, the pile of scraps does not naturally collapse and cannot be stored in the hopper in a large amount, as will be described more specifically later. Although the hopper may be provided with a larger capacity or a width sufficiently larger than that of a sheet stack, this kind of scheme increases the size of the entire sheet finisher and makes the use of the shuttle type of cutter practically meaningless.

SUMMARY OF THE INVENTION

It is a first object of the present invention to provide a sheet finisher capable of surely guiding and cutting sheets, and an image forming system using the same.

It is a second object of the present invention to provide a sheet finisher that is small size and operable with a small-size drive source despite the use of the shuttle type of cutter, and an image forming system using the same.

It is a third object of the present invention to provide a sheet finisher including a cutting portion smaller in height than that of the guillotine type of cutter, and an image forming system using the same.

It is a fourth object of the present invention to provide a sheet finisher free from defective cutting and jam ascribable to sheet scraps, and an image forming system using the same.

It is a fifth object of the present invention to provide a sheet finisher capable efficiently cutting sheets, and an image forming system using the same.

It is a sixth object of the present invention to provide a sheet finisher capable of efficiently detecting an error, allowing the user to deal with the error as far as possible, and reducing the down time, and an image forming system using the same.

It is a seventh object of the present invention to provide a sheet finisher capable of guaranteeing a sufficient cut margin and obviating a trouble ascribable to sheet scraps caught, and an image forming system using the same.

It is an eighth object of the present invention to provide a sheet finisher capable of guaranteeing a cut margin ever. when a sheet stack is inaccurately folded or when it should be cut at a preselected length, and an image forming system using the same.

It is a ninth object of the present invention to provide a sheet finisher capable of cutting a relatively thick sheet stack without shifting it, and an image forming system using the same.

It is a tenth object of the present invention to provide a sheet finisher capable of preventing, when use is made of a stepping motor, the motor from being brought out of synchronism due to a sharp change in load, and an image forming system using the same.

It is an eleventh object of the present invention to provide a sheet finisher capable of storing a large amount of sheet scraps cut away by the shuttle type of cutter without increasing the capacity of a hopper, and an image forming system using the same.

A sheet finisher for performing preselected processing with a sheet or a sheet stack conveyed thereto of the present invention includes a cutter unit configured to cut the sheet or the sheet stack in a direction perpendicular to a direction of sheet conveyance. A guide member is positioned upstream of the cutter unit in the direction of sheet conveyance for guiding the sheet or the sheet stack being conveyed. A moving device moves the guide member in a direction parallel to the direction of sheet conveyance.

An image forming system using the above sheet finisher is also disclosed.

BRIEF DESCRIPTION OF THE DRAWINGS

The above and other objects, features and advantages of the present invention will become more apparent from the following detailed description taken with the accompanying drawings in which:

FIG. 31 is a table listing a relation between sheet sizes, lengths L, and the number of sheets stapled together;

DESCRIPTION OF THE PREFERRED EMBODIMENTS

Preferred embodiments of the present invention will be described hereinafter.

First Embodiment

This embodiment is a solution to the problem (1) stated earlier and mainly directed toward the first to fifth objects.

Figure 1:
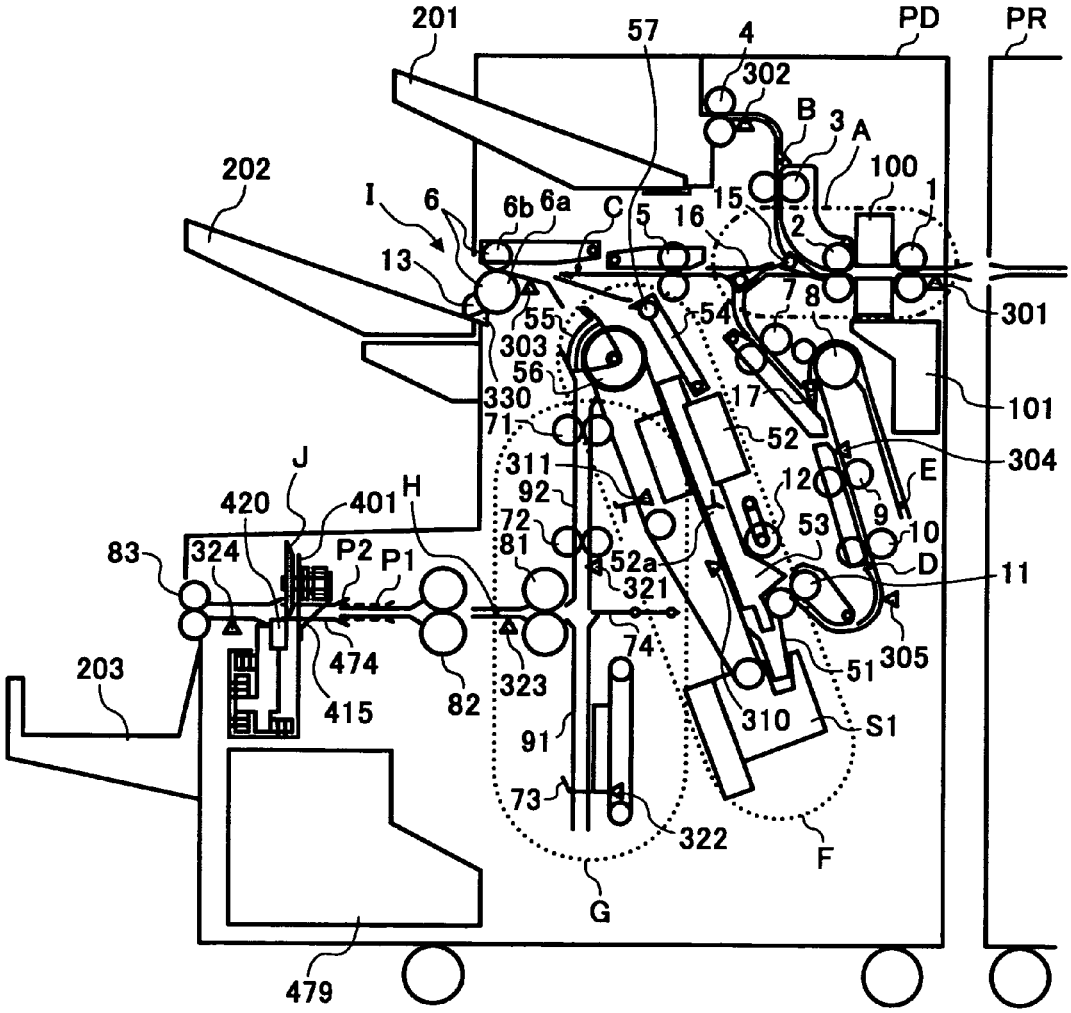
FIG. 1 shows an image forming system made up of a sheet finisher and an image forming apparatus and with which preferred embodiments of the present invention are practicable.

Referring to FIG. 1 of the drawings, an image forming system is shown and generally made up of a sheet finisher PD embodying the present and an image forming apparatus PR. As shown, the sheet finisher PD is operatively connected to one side of the image forming apparatus PR. A sheet or recording medium driven out of the image forming apparatus is introduced into the sheet finisher PD. The sheet is then conveyed through a path A where finishing means for finishing a single sheet is located. In the illustrative embodiment, the finishing means on the path A is implemented as a punch unit or punching means 100. Subsequently, the sheet is steered by a path selector 15 to either one of a path B terminating at an upper tray 201 and a path C terminating at a shift tray 202 or steered by a path selector 16 to a path D terminating at a processing tray F. The processing tray F is used to position, staple or otherwise process a sheet or sheets and, in this sense, will be referred to as a staple tray hereinafter.

Sheets sequentially brought to the staple tray F via the paths A and D are positioned one by one, stapled or otherwise processed, and then steered by a guide plate 54 and a movable guide 55 to either one of the path C and another processing tray G. The processing tray G folds or otherwise processes the sheets and, in this sense, will be referred to as a fold tray hereinafter. The sheets folded by the fold tray G are guided to a lower tray 203 via a cutter unit J. The path D includes a path selector 17 constantly biased to a position shown in FIG. 1 by a light-load spring not shown. An arrangement is made such that after the trailing edge of a sheet has moved away from the path selector 17, among rollers 9 and 10 and a staple outlet roller 11, at least the roller 9 is rotated in the reverse direction to convey the trailing edge of the sheet to a prestacking portion E and cause the sheet to stay there. In this case, the sheet can be conveyed together with the next sheet superposed thereon. Such an operation may be repeated to convey two or more sheets together.

On the path A merging into the paths B, C and D, there are sequentially arranged an inlet sensor 301 responsive to a sheet coming into the finisher PD, an inlet roller pair 1, the punch unit 100, a hopper 101 for storing scraps, a roller pair 2, and path selectors 15 and 16. Springs, not shown, constantly bias the path selectors 15 and 16 to the positions shown in FIG. 1. When solenoids, not shown, are energized, the path selectors 15 and 16 rotate upward and downward, respectively, to thereby steer the sheet to desired one of the paths B, C and D.

More specifically, to guide a sheet to the path B, the path selector 15 is held in the position shown in FIG. 1 while the solenoid assigned thereto is turned off. To guide a sheet to the path C, the solenoids are turned on to rotate the path selectors 15 and 16 upward and downward, respectively. Further, to guide a sheet to the path D, the path selector 16 is held in the position shown in FIG. 1 while the solenoid assigned thereto is turned off; at the same time, the solenoid assigned to the path selector 15 is turned on to move it angularly upward.

In the illustrative embodiment, the finisher PD is capable of selectively effecting punching (punch unit 100), jogging and edge stapling (jogger fence 53 and edge stapler S1, jogging and center stapling (jogger fence 53 and center staplers S2), sorting (shift tray 202), center folding (fold plate 74 and fold rollers 81 and 82), and cutting (cutter unit J).

The image forming apparatus PR uses a conventional electrophotographic process that forms a latent image on the charged surface of a photoconductive drum or similar image carrier with a light beam in accordance with image data, develops the latent image with toner, transfers the resulting toner image to a sheet or recording medium, and fixes the toner image on the sheet. Such a process is well known in the art and will not be described in detail. Of course, the illustrative embodiment is similarly applicable to any other image forming apparatus, e.g., an ink jet printer.

A shift tray outlet section I is located at the most downstream position of the sheet finisher PD and includes a shift outlet roller pair 6, a return roller 13, a sheet surface sensor 330, and the shift tray 202. The shift tray outlet section I additionally includes a shifting mechanism and a shift tray elevating mechanism although not shown specifically.

The return roller 13 contacts a sheet driven out by the shift outlet roller pair 6 and causes the trailing edge of the sheet to abut against an end fence for thereby positioning it. The end fence is mounted on one side of the sheet finisher PD contacting the lowermost end of the shift tray 202. The return roller 13 is formed of sponge and caused to rotate by the shift outlet roller 6. As shown in FIG. 1, the sheet surface sensor 330 senses the surface of a sheet or that of a sheet stack driven out to the shift tray 202.

The shift tray 202 is moved upward or downward in accordance with the output of the sheet surface sensor 330. In a sort mode, the shift tray 202 is shifted copy (set of prints) by copy in the direction perpendicular to the direction of sheet conveyance for thereby sorting consecutive prints. Such movement of the shift tray 202 is conventional and will not be described specifically.

Figure 2:
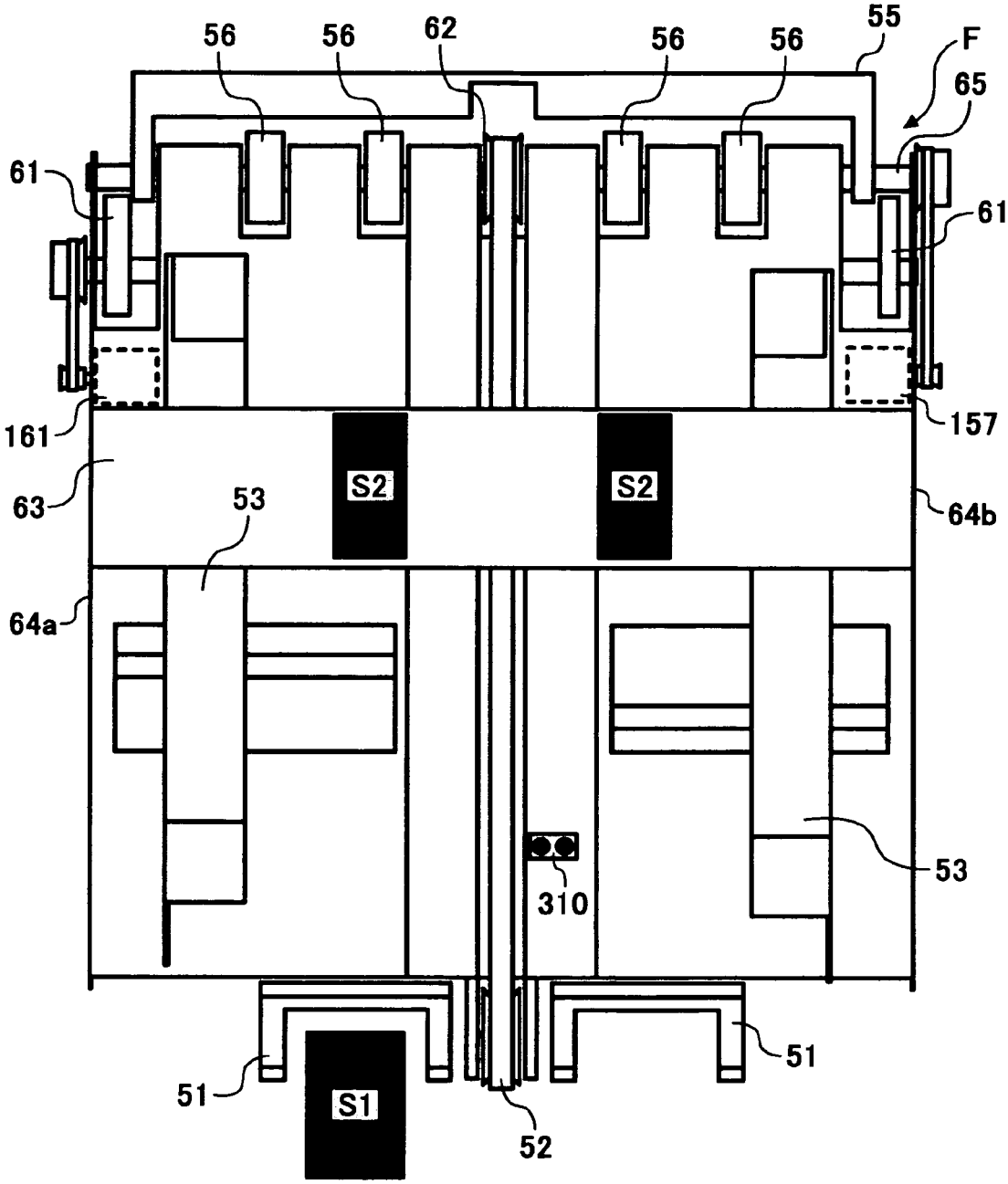
FIG. 2 is a plan view showing a staple tray included in the finisher, as seen in a direction perpendicular to a sheet conveyance plane.
Figure 3:
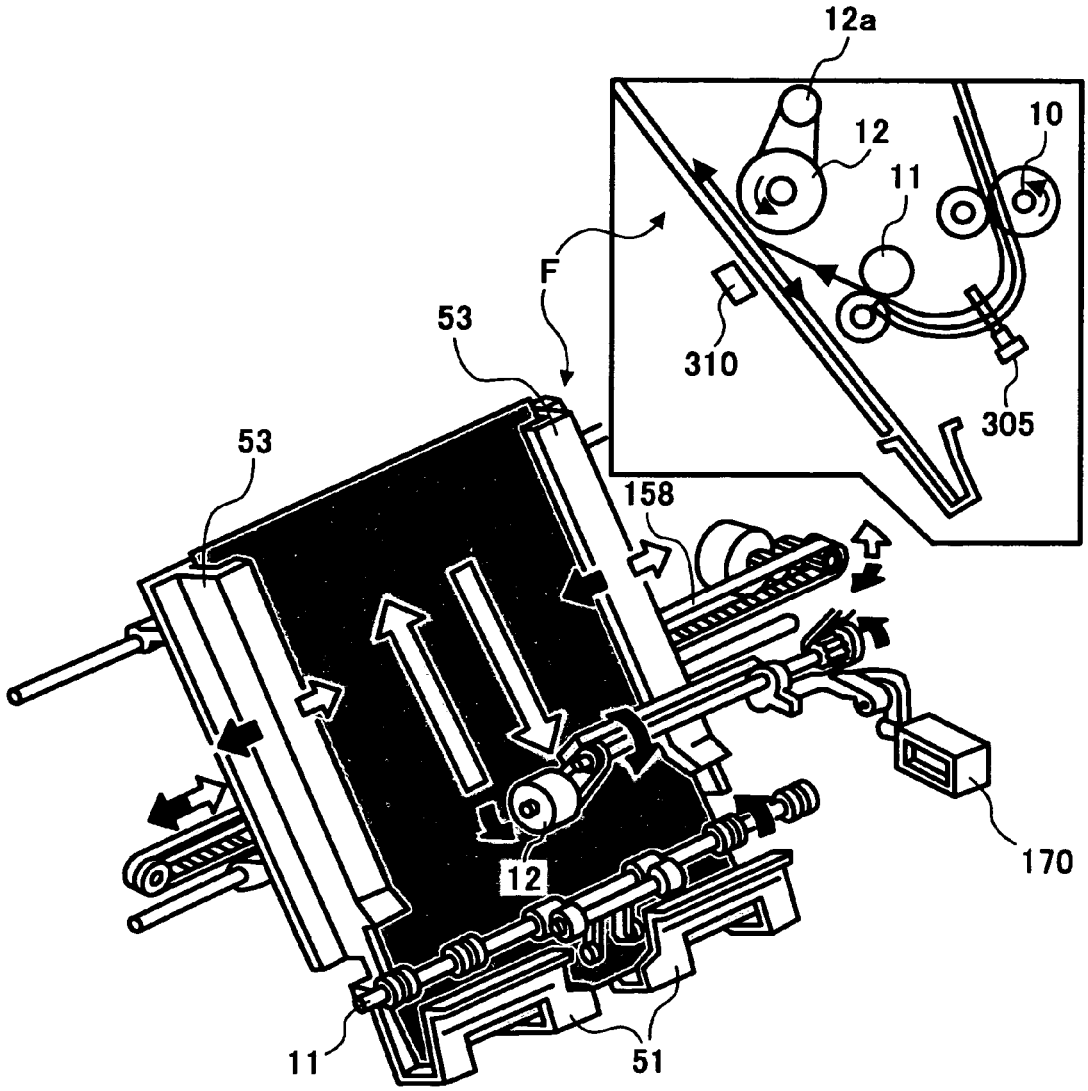
FIG. 3 is an isometric view showing the staple tray and a mechanism for driving it.
Figure 4:
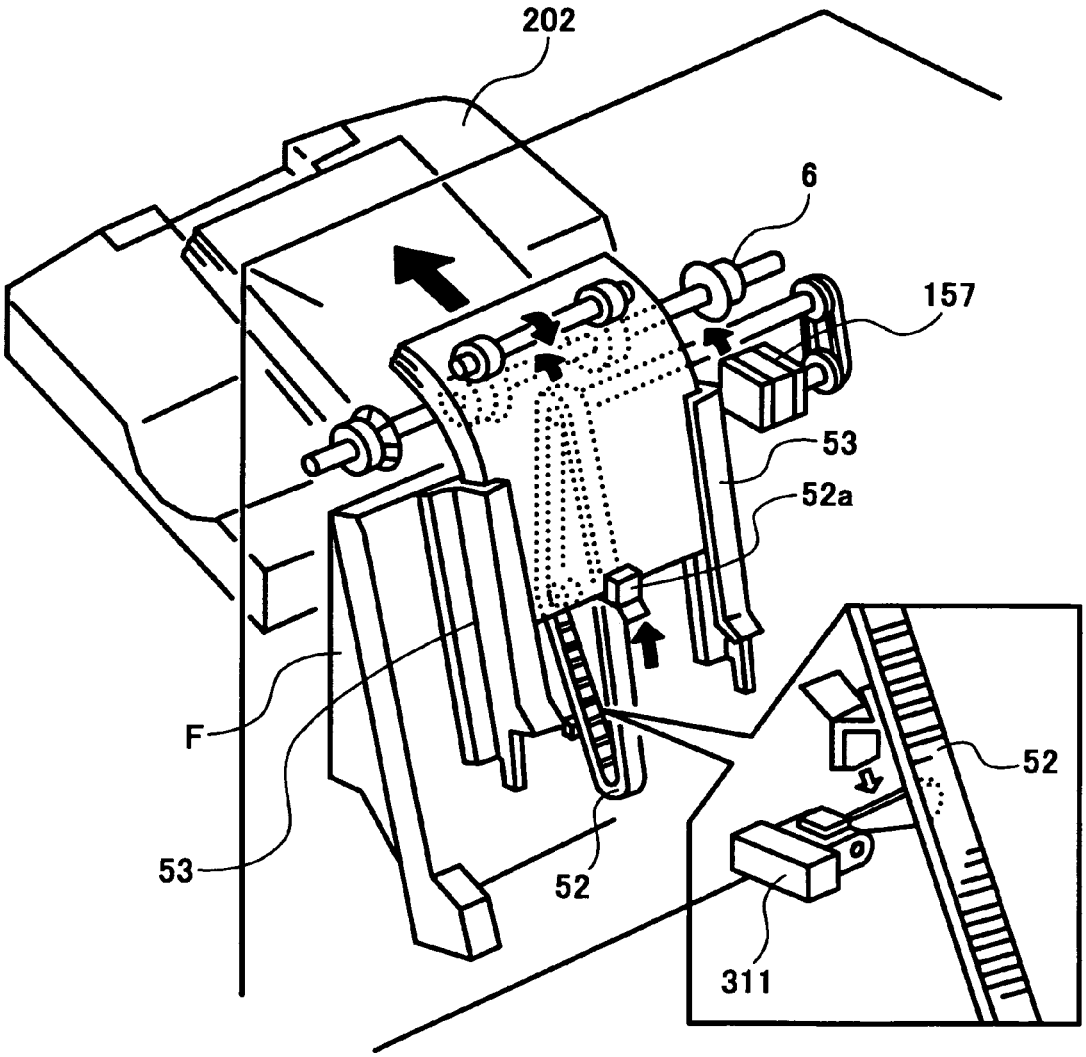
FIG. 4 is a perspective view showing a mechanism included in the sheet finisher for discharging a sheet stack.

FIG. 2 shows the staple tray F as seen in a direction perpendicular to the sheet conveyance plane. FIG. 3 a drive mechanism assigned to the staple tray F while FIG. 4 shows a sheet stack discharging mechanism. As shown, sheets sequentially conveyed by the staple outlet roller pair 11 to the staple tray F are sequentially stacked on the staple tray F. At this instant, a knock roller 12 knocks every sheet for positioning it in the vertical direction (direction of sheet conveyance) while jogger fences 53 position the sheet in the horizontal direction perpendicular to the direction of sheet conveyance (sometimes referred to as a direction of sheet width). Between consecutive jobs, i.e., during an interval between the last sheet of a sheet stack and the first sheet of the next sheet stack, a controller 350 (see FIG. 14) outputs a staple signal for causing the edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

As shown in FIG. 4, a belt HP (Home Position) sensor 311 senses the hook 52*a* of the discharge belt 52 brought to its home position. More specifically, two hooks 52*a* are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*a* position the leading edge of the sheet stack stored on the staple tray F in the direction of sheet conveyance, as needed. Each hook 52*a* therefore plays the role of positioning means at the same time.

As shown in FIG. 2, a discharge motor 157 causes the discharge belt 52 to move via a discharge shaft 65. The discharge belt 52 and a drive pulley 62 therefor are positioned at the center of the discharge shaft 65 in the direction of sheet width. Discharge rollers 56 are mounted on the discharge shaft 65 in a symmetrical arrangement. The discharge rollers 56 rotate at a higher peripheral speed than the discharge belt 52.

More specifically, torque output from the discharge motor 157 is transferred to the discharge belt 52 via a timing belt and the timing pulley 62. The timing pulley (drive pulley) 62 and discharge rollers 56 are mounted on the same shaft, i.e., the discharge shaft 65. An arrangement may be made such that when the relation in speed between the discharge rollers 56 and the discharge belt 52 should be varied, the discharge rollers 56 are freely rotatable on the discharge shaft 65 and driven by part of the output torque of the discharge motor 157. This kind of scheme allows a desired reduction ratio to be established.

The surface of the discharge roller 56 is formed of rubber or similar high-friction material. The discharge roller 56 nips a sheet stack between it and a press roller or driven roller 57 due to the weight of the driven roller 57 or a bias, thereby conveying the sheet stack.

As shown in FIG. 3, a solenoid 170 causes the knock roller 12 to move about a fulcrum 12*a* in a pendulum fashion, so that the knock roller 12 intermittently acts on sheets sequentially driven to the staple tray F and causes their trailing edges to abut against rear fences 51. The knock roller 12 rotates counterclockwise about its axis. A reversible jogger motor 158 drives the jogger fences 53 via a timing belt and causes them to move back and forth in the direction of sheet width.

A reversible stapler motor causes the edge stapler S1 to move in the direction of sheet width via a timing belt so as to staple a sheet stack at a preselected edge position. A stapler HP sensor is positioned at one side of the movable range of the edge stapler S1 in order to sense the edge stapler S1 brought to its home position. The stapling position in the direction off sheet width is controlled in terms of the displacement of the edge stapler S1 from the home position.

The edge stapler S1 is capable of selectively driving a staple into a sheet stack in parallel to or obliquely relative to the edge of the sheet stack. Further, at the home position, only the stapling mechanism portion of the edge stapler S1 is rotated by a preselected angle for the replacement of staples.

As shown in FIGS. 1 and 2, a pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The center staplers S2 are symmetrical to each other with respect to the center in the direction of sheet width. The center staplers S2 themselves are conventional and will not be described specifically. Briefly, after a sheet stack has been fully positioned by the jogger fences 53, rear fences 51 and knock rollers 5, the discharge belt 52 lifts the trailing edge of the sheet stack with its hook 52*a* to a position where the center of the sheet stack in the direction of sheet conveyance coincides with the stapling positions of the center staplers S2. The center staplers S2 are then driven to staple the sheet stack. The stapled sheet stack is conveyed to the fold tray G and folded at the center, as will be described in detail later.

There are also shown in FIGS. 1 and 2, a front side wall 64*a*, a rear side wall 64*b* and a sensor 310 responsive to the presence/absence of a sheet stack on the staple tray F.

A mechanism for steering a sheet stack will be described hereinafter. To allow the sheet stack stapled by the center staplers S2 to be folded at the center on the fold tray G, sheet steering means is located at the most downstream side of the staple tray F in the direction of sheet conveyance in order to steer the stapled sheet stack toward the fold tray G.

Figure 5:
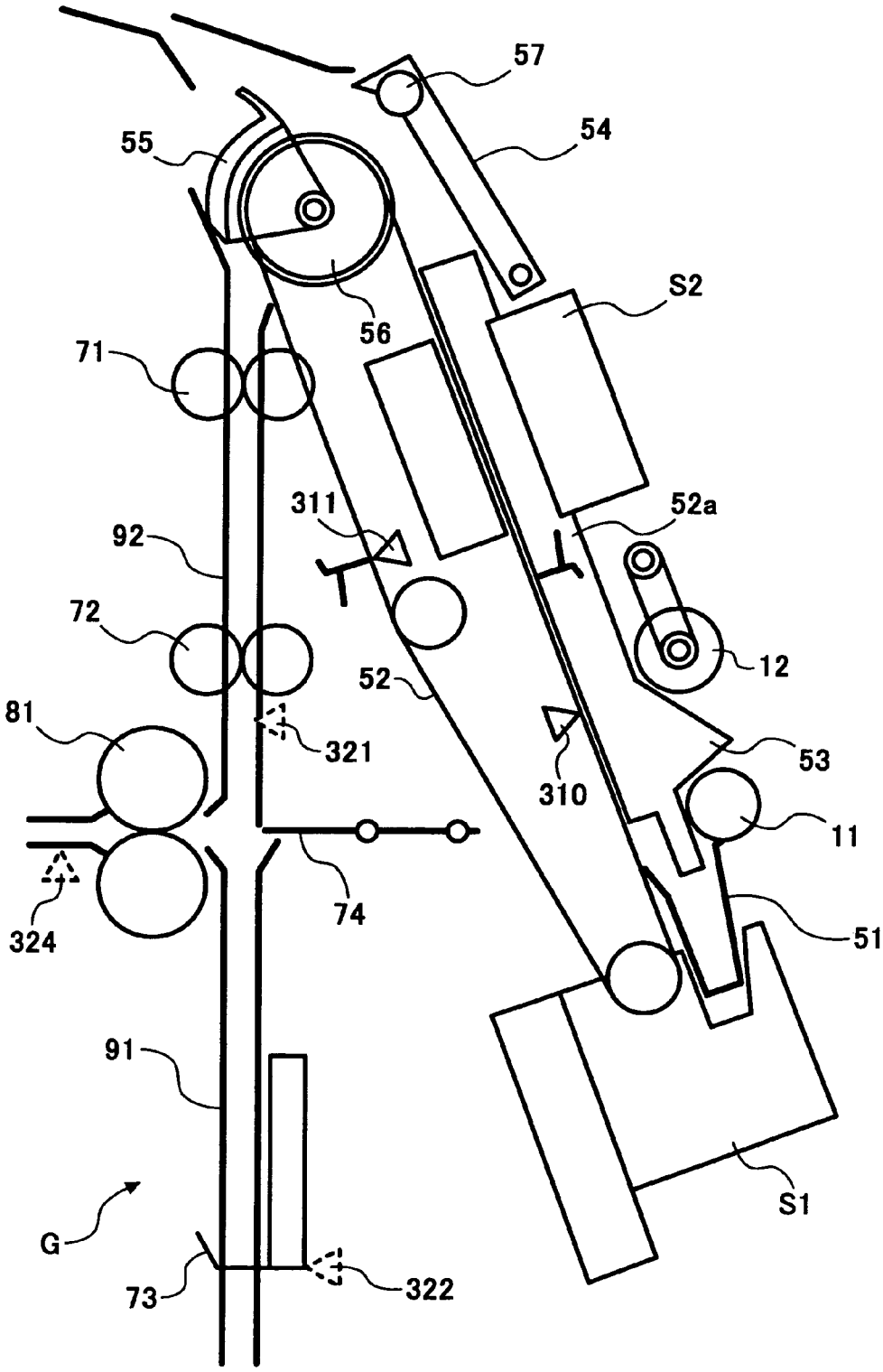
FIG. 5 is a view showing the staple tray and a fold tray also included in the finisher in detail.
Figure 6:
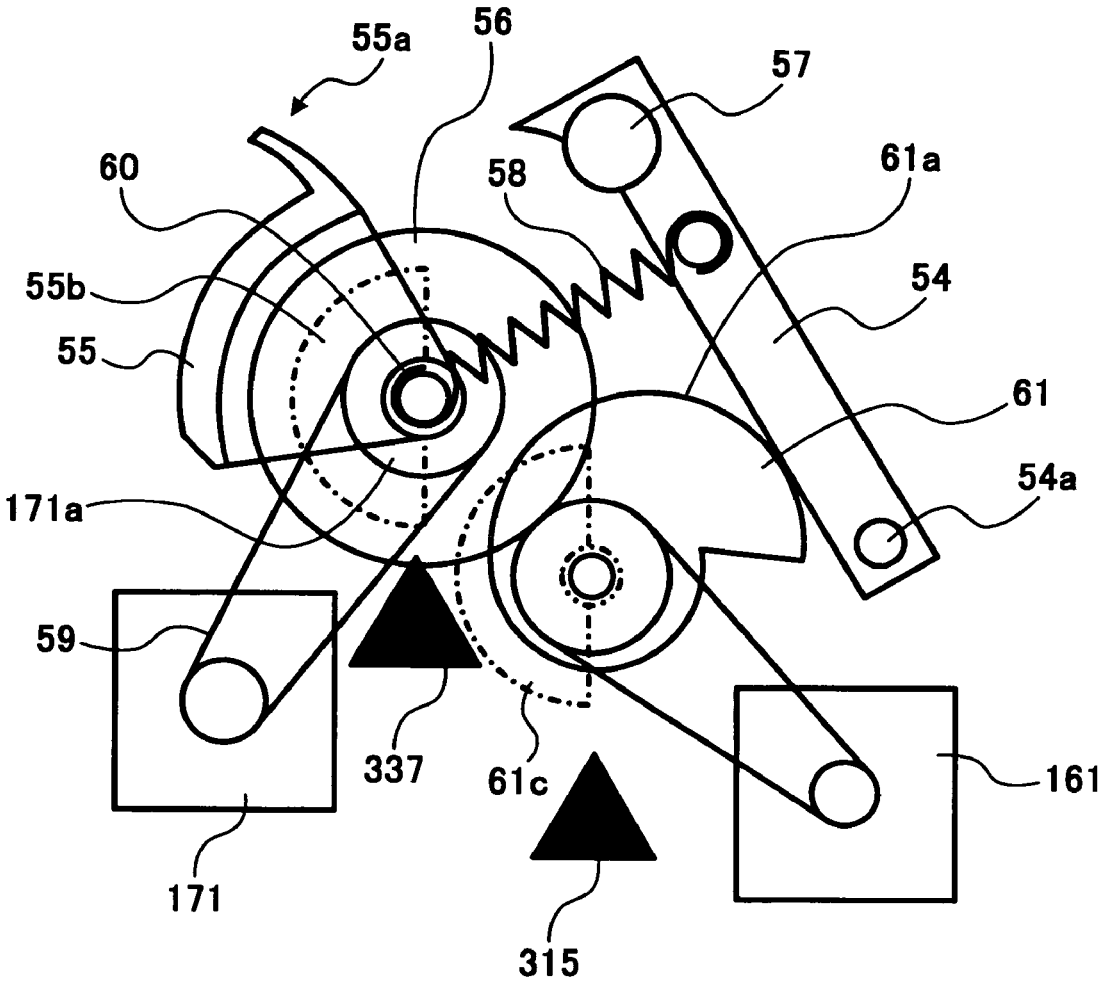
FIG. 6 shows a guide plate and a movable guide included in the sheet finisher in the initial condition wherein a steering mechanism steers a sheet stack stapled at the center on the staple tray in a center staple and bind mode.
Figure 7:
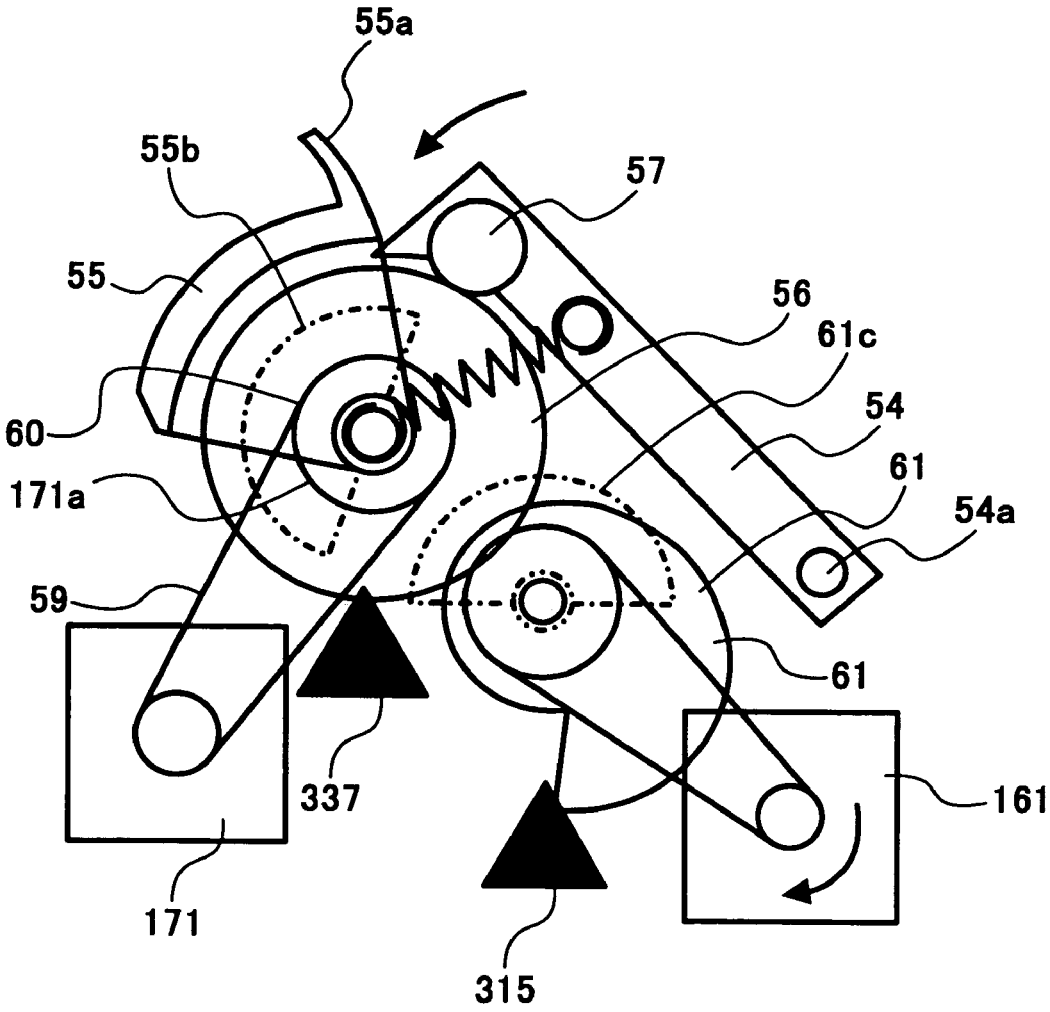
FIG. 7 shows the guide plate and movable guide in the condition wherein the steering mechanism steers the sheet stack stapled at the center on the staple tray in the center staple and bind mode toward the fold tray.

As best shown in FIG. 5, which is an enlarged view of the staple tray F and fold tray G, the sheet steering mechanism includes the guide plate 54 and movable guide 55 mentioned earlier. As shown in FIGS. 6 and 7, the guide plate 54 is angularly movable about a fulcrum 54*a* in the up-and-down direction and supports the press roller 57, which is freely rotatable, on its downstream end. A spring 58 constantly biases the guide plate 54 toward the discharge roller 56. The guide plate 54 is held in contact with the cam surface 61*a* of a cam 61, which is driven by a steer motor 161.

The movable guide 55 is angularly movably mounted on the shaft of the discharge roller 56 together with a driven pulley 60, which is movable integrally with the movable guide 55. A timing belt 59 is passed over the driven pulley 60 and a drive pulley 171*a* mounted on the output shaft of a movable guide motor 171 and determines the stop position of the movable guide 55. A movable guide HP sensor 337 is responsive to an interrupter portion 55*b* included in the movable guide 55. Drive pulses fed to the movable guide motor 171 are controlled on the basis of the home position of the movable guide 55 to thereby control the stop position of the movable guide 55.

A guide HP sensor 315 senses the home position of the cam 61 on sensing the interrupter portion 61*c* of the cam 61. Therefore, the stop position of the cam 61 is controlled on the basis of the number of drive pulses input to the steer motor 161 counted from the home position of the cam 61. The position of the guide plate 54 is controlled in accordance with the stop position of the cam 61, i.e., the number of pulses input to the steer motor 161. It is therefore possible to freely set the distance between the discharge roller 56 and the press roller 57, as will be described later in detail.

FIG. 6 shows a positional relation to hold between the guide plate 54 and the movable guide 5S when the cam 61 is held at its home position. As shown, the guide surface 55*a* of the movable guide 55 is curved and spaced from the surface of the discharge roller 56 by a preselected distance. While part of the guide plate 55 downstream of the press roller 57 in the direction of sheet conveyance is curved complementarily to the surface of the discharge roller 56, the other part upstream of the same is flat in order to guide a sheet stack toward the shift outlet roller 6. In this condition, the mechanism is ready to convey a sheet stack to the path C. More specifically, the movable guide 55 is sufficiently retracted from the route along which a sheet stack is to be conveyed from the staple tray F to the path C. Also, the guide plate 54 is sufficiently retracted from the surface of the discharge roller 56. The guide plate 54 and movable guide 55 therefore open the above route sufficiently wide; the opening width is generally dependent on the stapling ability of the edge stapler S1 and usually corresponds to the thickness of fifty ordinary sheets or less.

In the above condition, the movable guide motor 171 is rotated to move the movable guide 55 to the position where the movable guide 55 guides a sheet stack toward the fold tray G. Also, the steer motor 161 is rotated by a preselected number of pulses from its home position to thereby move the guide plate 54 counterclockwise, as viewed in FIG. 6, via the cam 61. As a result, the press roller 57 is spaced from the discharge roller 56 by a small gap. As the cam 61 is further rotated, the guide plate 54 is further moved counterclockwise until the press roller 57 has been pressed against the discharge roller 56. The pressure of the press roller 57 acting on the discharge roller 56 is determined by the force of the spring 58.

In the condition shown in FIG. 6, a sheet stack positioned and stapled on the staple tray F can be delivered to the shift tray 202 while, in the condition shown in FIG. 7, the sheet stack can be delivered to the fold tray G. The movable guide 55 is moved clockwise from the above position to cause its guide surface 55*a* to block the space in which the guide 55 is movable, allowing a sheet stack to be smoothly delivered to the fold tray G. In this manner, the guide plate 54 and movable guide 55 are sequentially moved in this order while overlapping each other, forming a smooth path for conveyance.

In the condition shown in FIG. 7, the guide plate 54 contacts the discharge roller 56 obliquely relative to the direction of sheet conveyance, compared to the condition shown in FIG. 6. The guide plate 54 therefore guides the leading edge of the sheet stack toward the press roller 57 while restricting it in a wedge fashion. Although a sheet stack to be delivered to the fold tray G has been stapled at the center with the leading edge remaining free, such a sheet stack is restricted, as stated above, and pressed by the press roller 57 and then introduced into the gap between the movable guide 55 and the discharge roller 66. The leading edge of the sheet stack can therefore enter the above gap without becoming loose. Subsequently, the movable guide 55 turns, or steers, the sheet stack toward the fold tray G.

Further, as shown in FIG. 7, the press roller 57 and discharge roller 56 are spaced from each other by the preselected gap. This, coupled with the fact that the press roller 57 presses a sheet stack having passed by a preselected amount, reduces a load to act on the sheet stack when it enters the above gap. This prevents the leading edge of the sheet stack from being disturbed during steering and therefore minimizes the probability of a jam.

The fold tray G will be described more specifically with reference to FIG. 8. As shown, the fold tray G includes a fold plate 74 for folding a sheet stack at the center. The fold plate 74 is formed with elongate slots 74*a* each receiving one of pins 64*c* studded on each of the front and rear side walls 64*a* and 64*b*. A pin 74*b* studded on the fold plate 74 is movably received in an elongate slot 76*b* formed in a link arm 76. The link arm 76 is angularly movable about a fulcrum 76*a*, causing the fold plate 74 to move in the right-and-left direction as viewed in FIG. 8. More specifically, a pin 75*b* studded on a fold plate cam 75 is movably received in an elongate slot 76*c* formed in the link arm 76. In this condition, the link arm 76 angularly moves in accordance with the rotation of the fold plate cam 75, causing the fold plate 74 to move back and forth perpendicularly to a lower guide plate 91 and an upper guide plate 92 (see FIG. 5).

Figure 8:
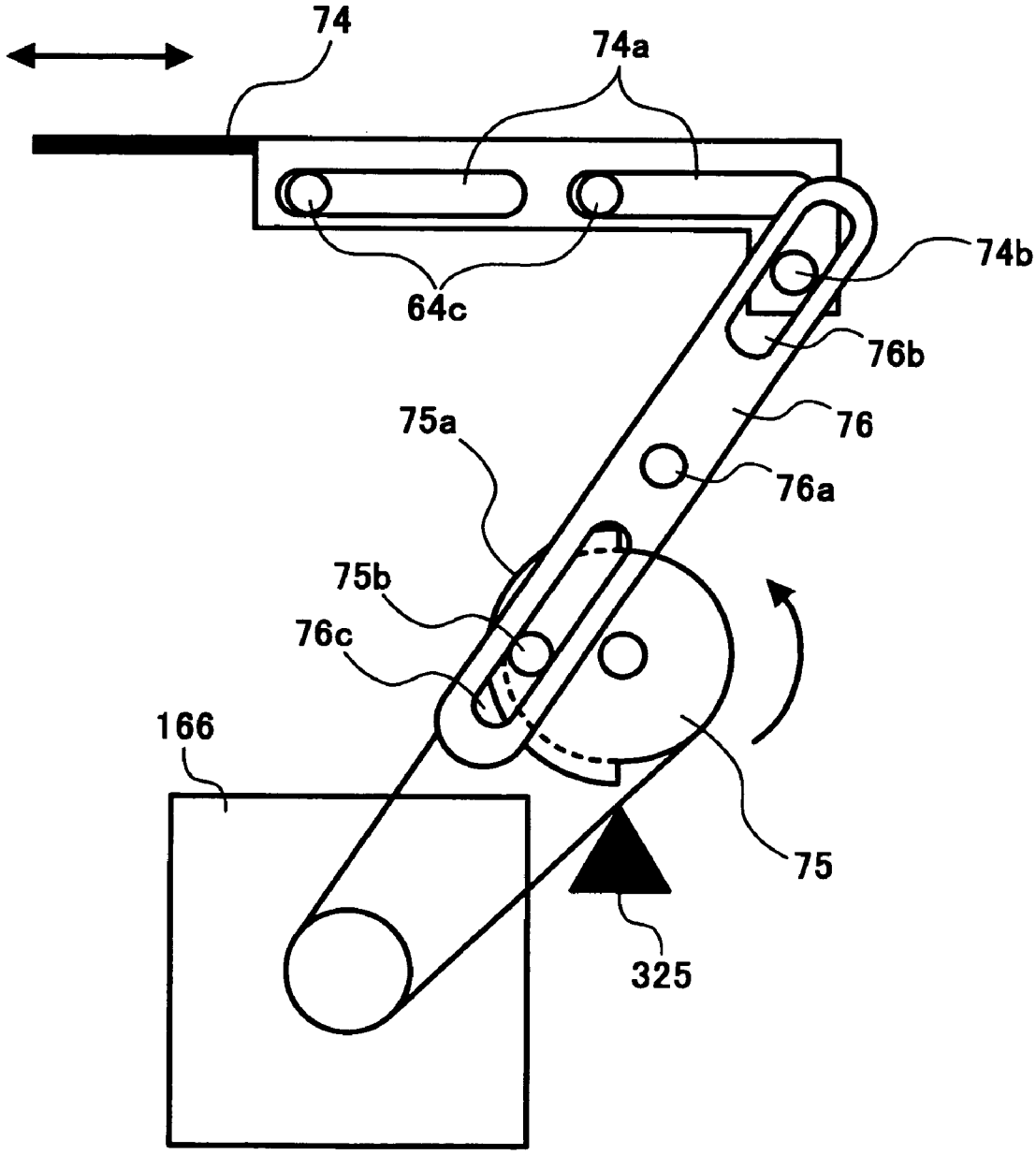
FIG. 8 shows the operation of a mechanism for moving the fold plate for folding the sheet stack.

A fold plate motor 166 causes the fold plate cam 75 to rotate in a direction indicated by an arrow in FIG. 8. The stop position of the fold plate cam 75 is determined on the basis of the output of a fold plate HP sensor 325 responsive to the opposite ends of a semicircular interrupter portion 75*a* included in the cam 75. FIG. 8 shows the fold plate 74 in the home position where the fold plate 74 is fully retracted from the sheet stack storing range of the fold tray G. When the fold cam 75 is rotated in the direction indicated by the arrow, the fold plate 74 is moved in the direction indicated by an arrow and enters the sheet stack storing range of the fold tray G. When the fold plate cam 75 is rotated in a direction indicated by an arrow, the fold plate 74 moves in a direction indicated by an arrow out of the sheet stack storing range.

While the illustrative embodiment is assumed to fold a sheet stack at the center, it is capable of folding even a single sheet at the center. In such a case, because a single sheet does not have to be stapled at the center, it is fed to the fold tray G as soon as it is driven out, folded by the fold plate 74, and then delivered to the lower tray 203.

Figure 9:
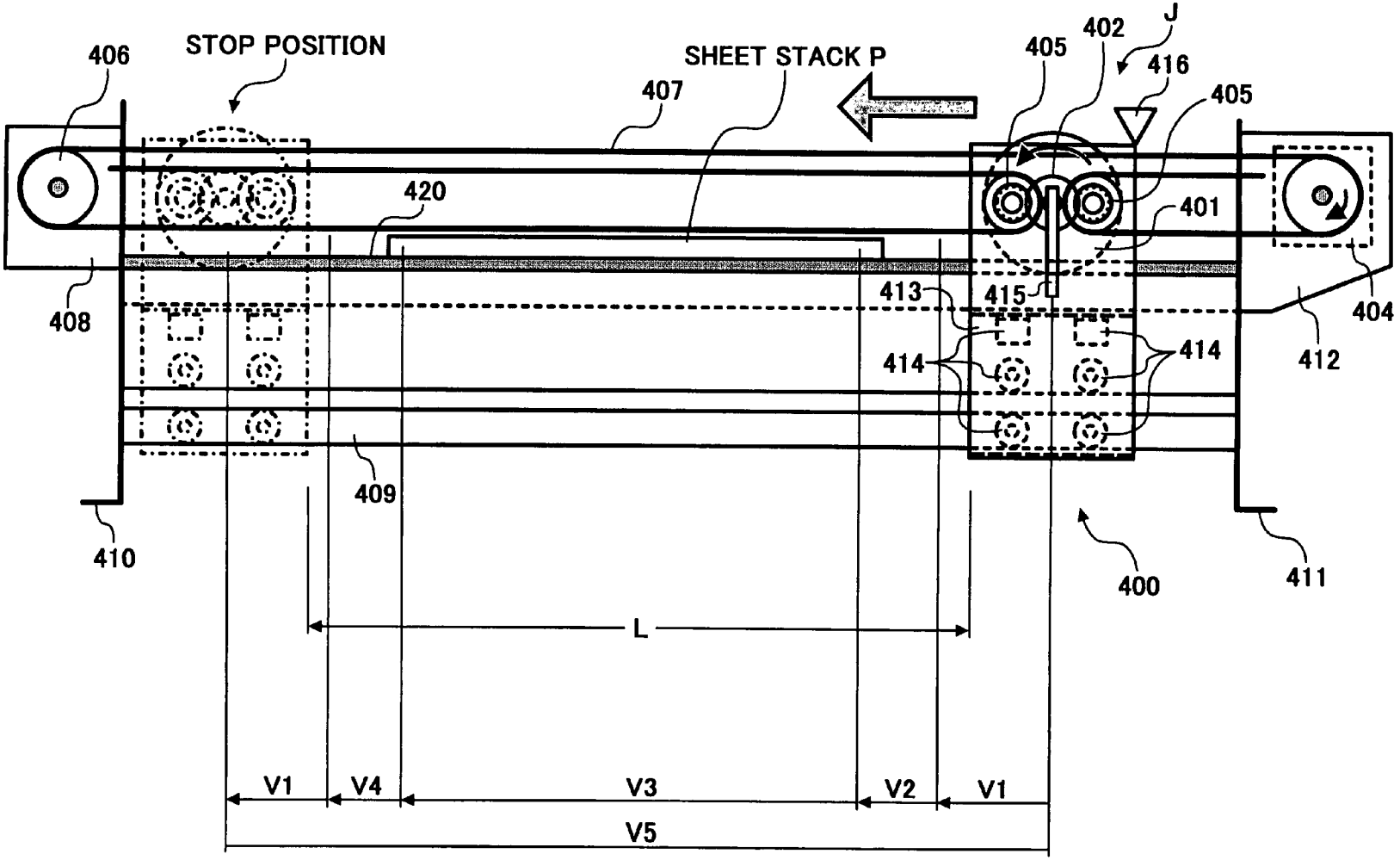
FIG. 9 is a front view showing a cutter unit included in the sheet finisher.
Figure 10:
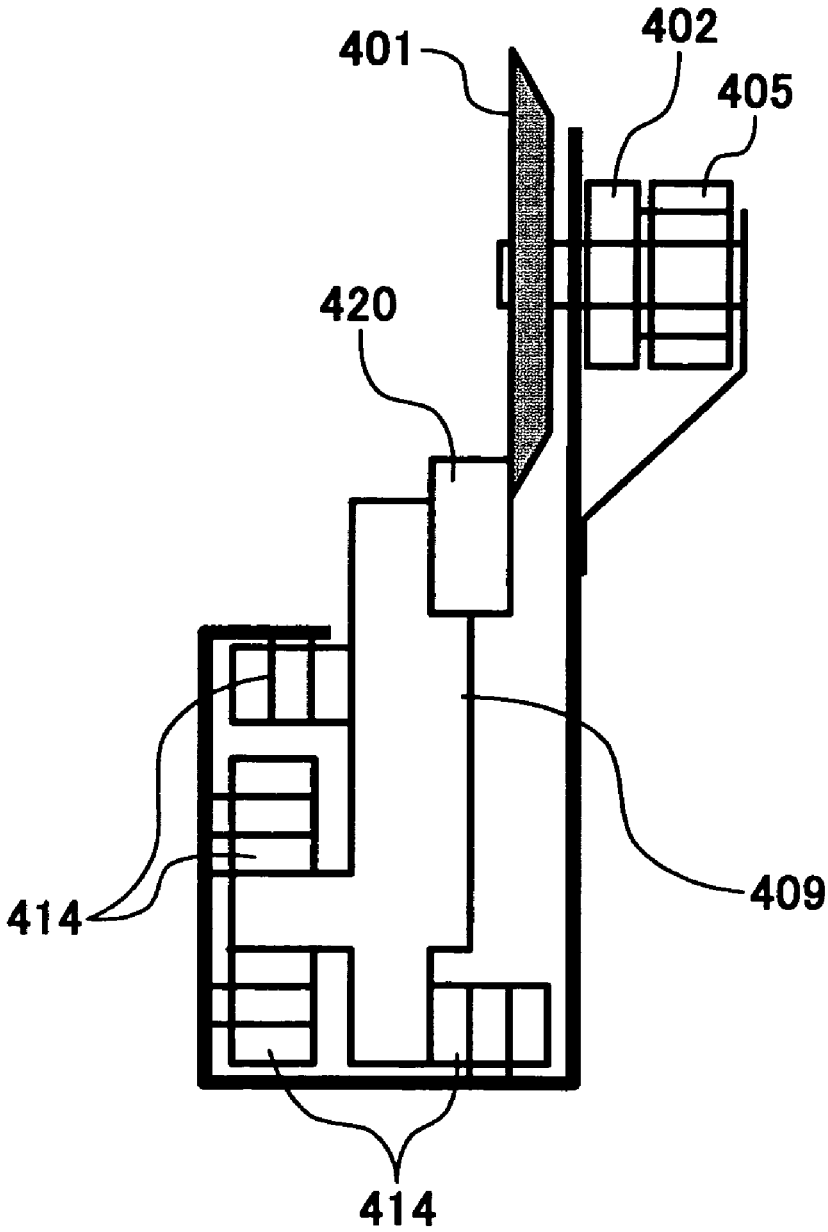
FIG. 10 is a side elevation of the cutter unit, as seen from the right.

FIGS. 9 and 10 are respectively a front view and a side elevation, as seen from the right, showing the cutter unit J specifically. As shown, the cutter unit J includes a stationary edge 420 affixed to a stay 409, which is affixed to side walls 410 and 411. Brackets 408 and a motor bracket 412 are respectively affixed to the side walls 410 and 411 while an idle pulley 406 and a cutter motor 404 are respectively affixed to the bracket 408 and motor bracket 412. Rollers 414 are freely rotatably mounted on a slider base 413 in such a manner as to sandwich the stay 409, so that the slider base 413 is linearly movable along the stay 409. Stepped idle gears 405 are mounted on the slider base 413, and each is formed with belt teeth and gear teeth.

A circular rotary edge 401 is connected to a drive gear 402 in such a manner as to sandwich it between the rotary edge 401 and the slider base 413. When the idle gears 405 rotate, the rotary edge 401 also rotates. A leaf spring 415 constantly biases the rotary edge 401 from the drive gear 402 side, pressing the rotary edge 401 against the stationary edge 420 with constant pressure.

A timing belt 407, which is not endless, has its opposite ends affixed as shown in FIG. 9, and is passed over the pulley of the cutter motor 404, idle pulley 406, and two idle gears 405. In this configuration, when the cutter motor 404 is rotated clockwise, as viewed in FIG. 9, the slide unit 400 moves to the left with the rotary edge 401 rotating counterclockwise. At this instant, if a sheet stack P is present between the rotary edge 401 and the stationary edge 420, then the edges 401 and 420 cooperate to cut the sheet stack. A cutter HP sensor 416 senses the slide unit 402 brought to its home position. An arrival sensor 417 is located at a position where the slide unit 400 moved from its home position surely cuts the entire sheet stack of the maximum sheet size that can be dealt with. A hopper 479 (see FIG. 1) is positioned below the cutter unit J for collecting sheet scraps.

Figure 11:
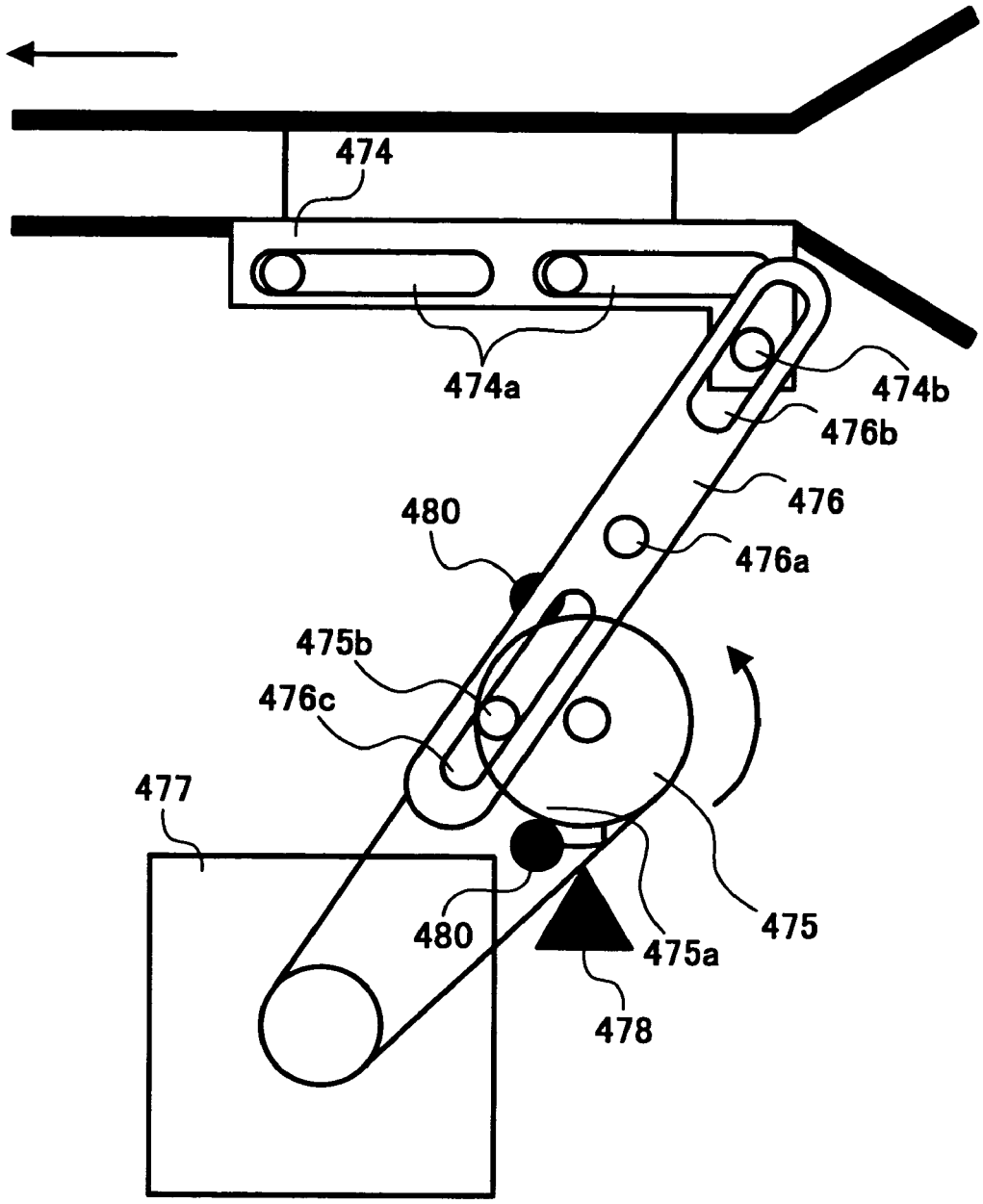
FIG. 11 shows a retraction guide plate included in the sheet finisher and held in a retracted position.
Figure 12:
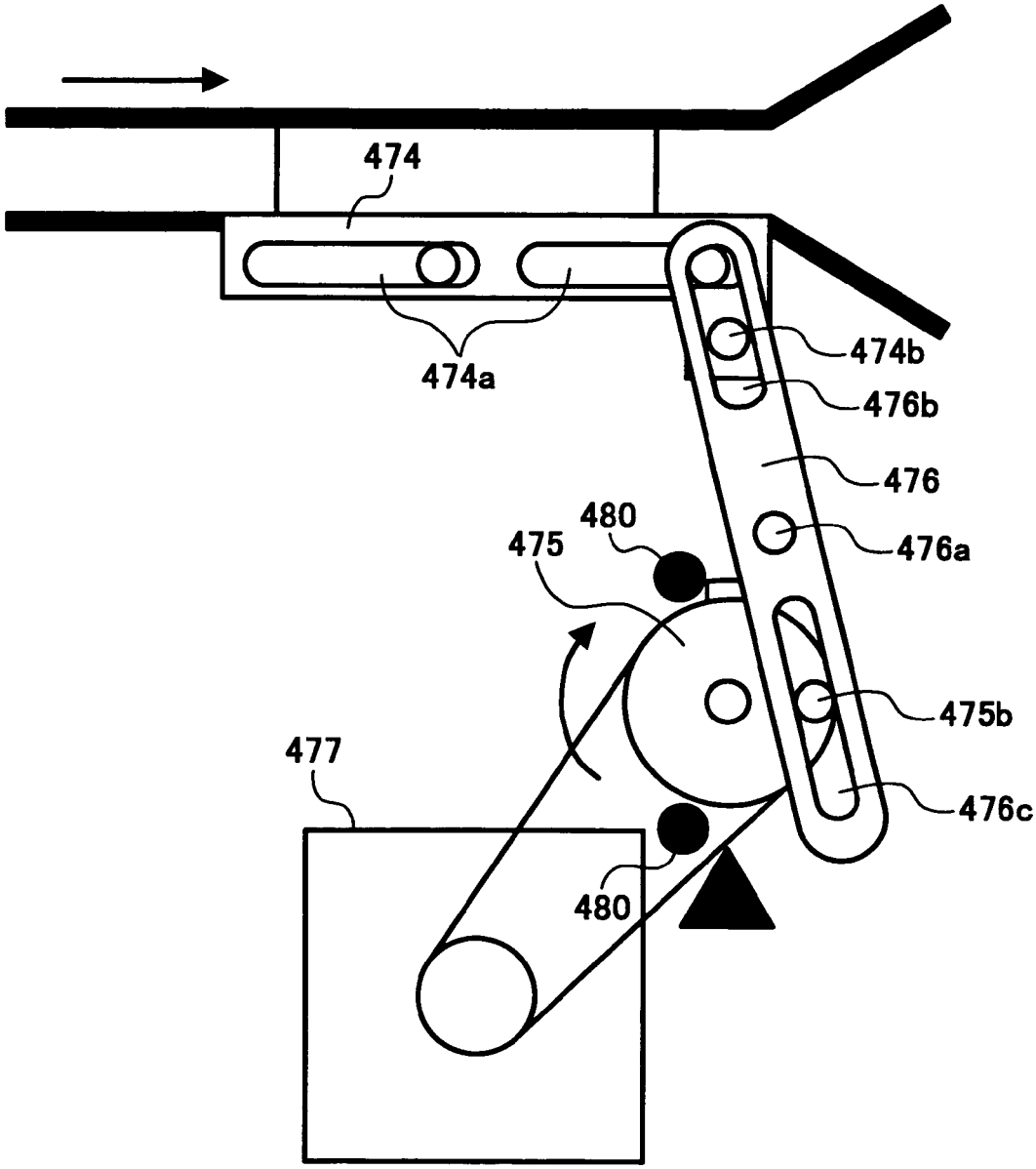
FIG. 12 is a view similar to FIG. 11, showing the retraction guide plate held in an advanced position.

FIGS. 11 and 12 demonstrate the movement of a retraction guide plate 474. As shown in FIG. 1, the retraction guide plate 474 is selectively movable toward or away from the cutter unit J. As shown in FIG. 1, the retraction guide plate 474 is formed with elongate slots 474*a* in which pins studded on the front and rear side walls are received. A pin 474*b* studded on the retraction guide plate 474 is received in an elongate slot 476*b* formed in a link arm 476. The link arm 476 is angularly movable about a fulcrum 476*a* to selectively move the retraction guide plate 474 leftward or rightward, as shown in FIG. 11 or 12, respectively. A pin 475*b* is studded on a retraction guide cam 475 and received in another slot 476*c* formed in the link arm 476, so that the link arm 476 is caused to angularly move by the rotation of the retraction guide cam 475. A retraction guide motor 477 causes the retraction guide cam 475 to rotate in directions indicated by arrows in FIGS. 11 and 12. The stop position of the retraction guide cam 475 is determined on the basis of the output of a retraction guide HP sensor 478 responsive to an interrupter portion included in the cam 475.

FIG. 11 shows the retraction guide plate 474 held in a home position where it is fully retracted from the range over which the slider unit 400 moves (retracted position P1, FIG. 1). In the home position or retracted position P1, the retraction guide plate 474 has slid outward of a stationary guide plate 473 (see FIG. 13) and does not interfere with a sheet or a sheet stack when guiding it. When the retraction guide cam 475 is rotated in the direction indicated by an arrow in FIG. 1, the retraction guide plate 474 moves in the direction indicated by an arrow over the stationary edge 420 of the cutter unit J. FIG. 12 shows a condition wherein the leading edge of the retraction guide plate 474 has advanced over the stationary edge 420 (advanced position P2, FIG. 1). When the retraction guide cam 475 is rotated counterclockwise, as indicated by the arrow in FIG. 12, the retraction guide plate 474 moves out of the range of movement of the slider unit 400, as indicated by an arrow.

Stops 480 adjoin the circumference of the retraction guide cam 475. The interrupter portion 475*a* of the cam 475 prevents the retraction guide cam 475 from moving more than necessary on abutting against either one of the stops 480. Therefore, the retraction guide plate 474 is caused to move forward or backward by the forward or reverse rotation of the motor 477. Before the slide unit 400 starts moving, whether or not the retraction guide plate 474 is located at the retracted position P1 is determined. If the answer of this decision is positive, then the slid unit 400 is caused to move. If the answer is negative, then the retraction guide plate 474 is moved to the home position before the start of movement of the guide plate 474.

Figure 13:
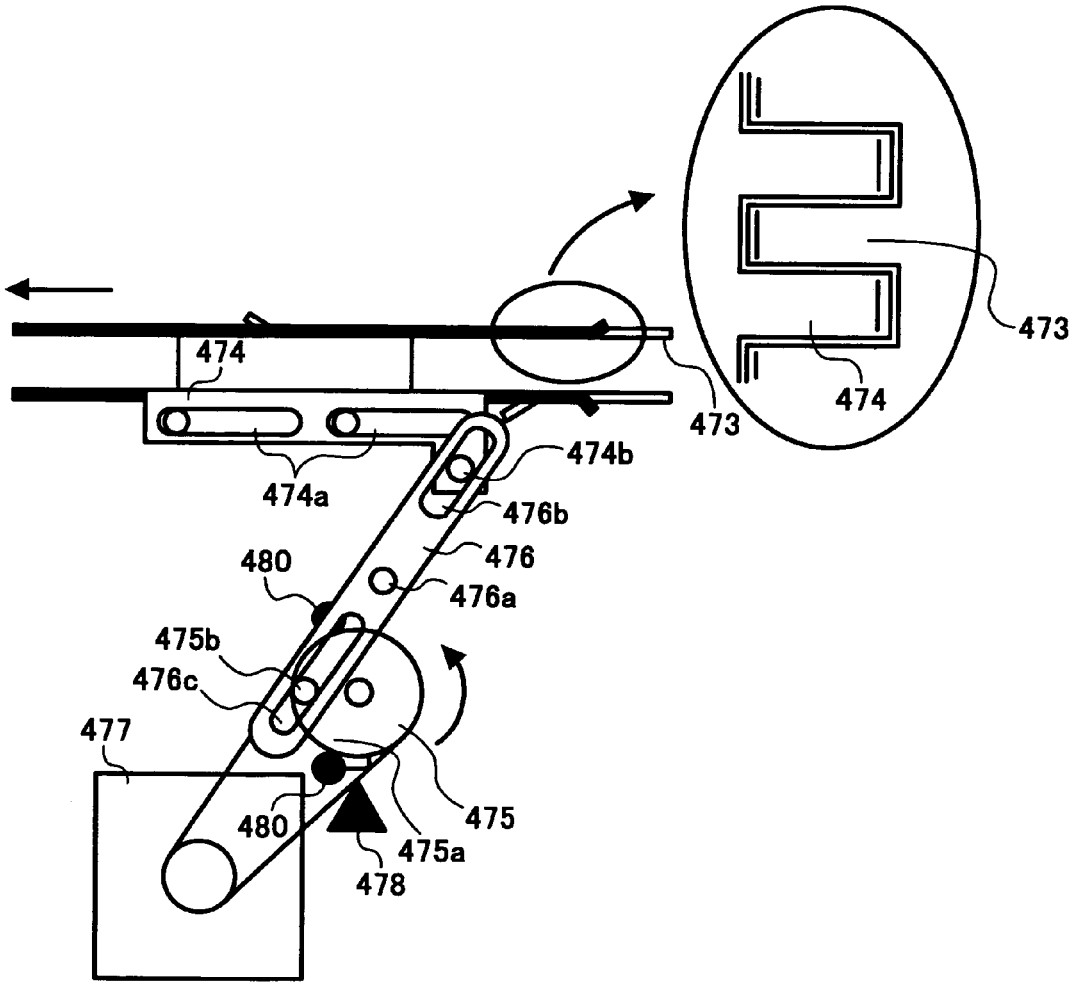
FIG. 13 shows a modification of the retraction guide plate and stationary guide plate.

FIG. 13 shows a modification of the retraction guide plate 474. As shown, the upstream end of the retraction guide plate 474 in the direction of sheet conveyance and the downstream end of the stationary guide plate 473 facing each other are provided with a comb-like configuration each. When the retraction guide plate 474 is in the home position, the comb-like ends mentioned above intersect each other in the same plane, as shown in an enlarged view in FIG. 13. This allows a sheet or a sheet stack to be conveyed without any interference with the retraction guide plate 474 on a path H. In addition, the retraction guide plate 474 is prevented from interfering with structural parts arranged above and below the stationary guide plate 473.

In FIG. 13, the retraction guide plate 474 has a size, as measured in the direction perpendicular to the direction of sheet conveyance, slightly smaller than the minimum sheet size that can be dealt with (A4 profile size in the modification) . The retraction guide plate 474 with such a size allows the rotary edge 401 to start moving after the retraction, but before the start of cutting. Further, the retraction guide plate 474 allows the rotary edge 401 to even fully move to a cutting start position adjacent a sheet stack during the retraction and start cutting the sheet stack on the completion of the retraction. By so configuring the retraction guide plate 474 and controlling the movement of the rotary edge 401, it is possible to efficiently cut a sheet stack of relatively small size.

The rotary edge 401 starts cutting a sheet stack after the retraction guide plate 474 has retracted to the home position P1 in consideration of the reliability of cutting operation. It is therefore necessary to reduce wasteful cutting time as far as possible. In light of this, in the modification, the retraction guide plate 474 is caused to start retracting after the leading edge of a sheet stack has arrived at the rotary edge 420, but before the sheet stack is brought to a stop. In this configuration, the retraction guide plate 474 starts retracting at the earliest timing that does not cause a sheet stack to jam the path. Subsequently, at the time when the retraction guide plate 474 fully retracts, the rotary edge 401 has already moved to the cutting start position close to a sheet stack. It is therefore possible to start cutting the sheet stack as soon as the sheet stack is brought to a stop, thereby minimizing wasteful cutting time.

As shown in FIG. 1, the drive timing of the retraction guide plate 474 and that of the rotary edge 401 are set up on the basis of the time at which a pass sensor 323 positioned downstream of the fold roller pair 81 senses the leading edge of a sheet or a sheet stack. Alternatively, the above drive timings may be set up by using the output of a discharge sensor 324 responsive to the leading edge of a sheet or a sheet stack as a trigger.

Figure 14:
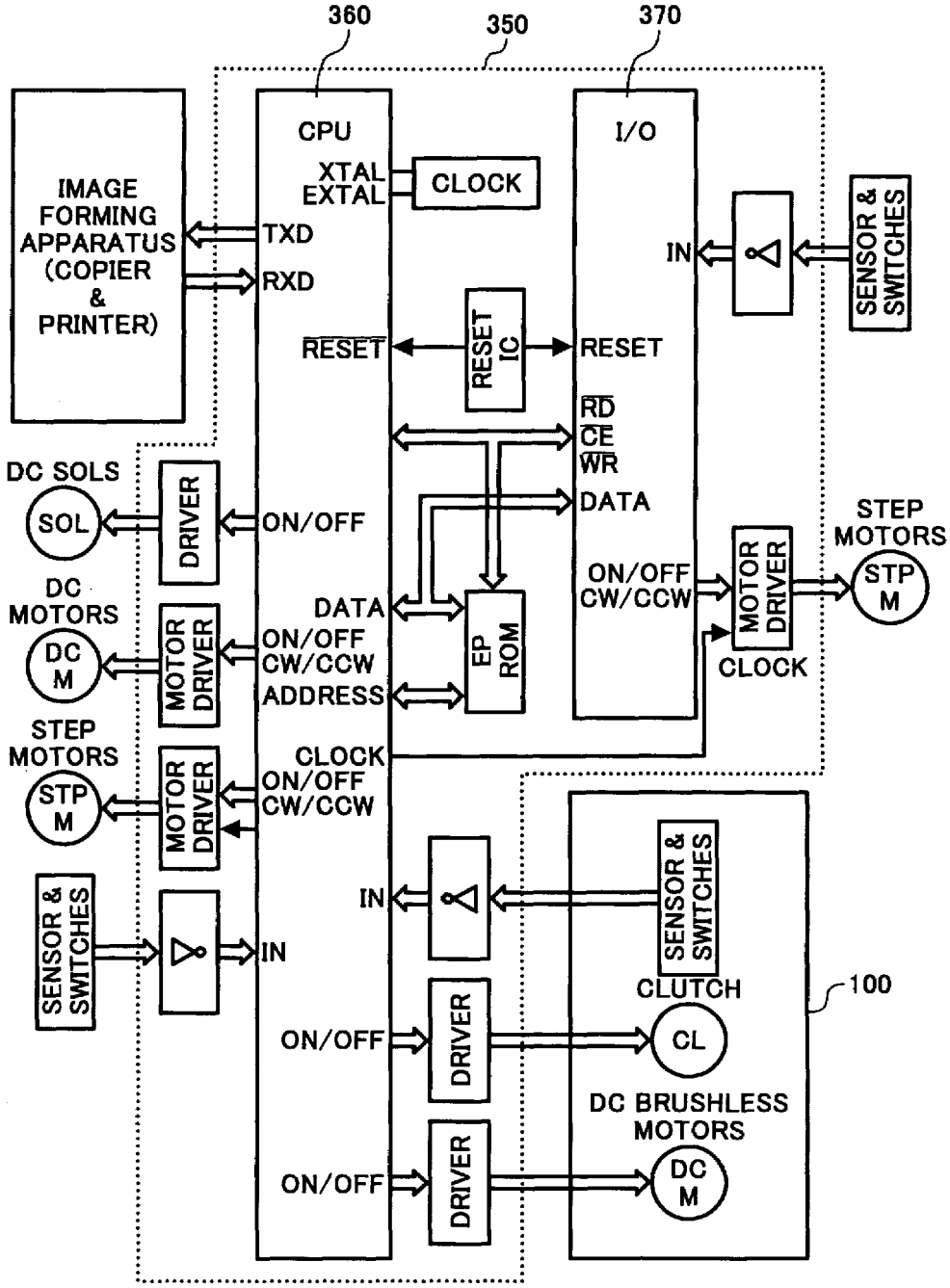
FIG. 14 is a schematic block diagram showing a control system included in the image forming system, particularly arrangements for controlling the sheet finisher, and with which the preferred embodiments are practicable.

Reference will be made to FIG. 14 for describing a control system included in the illustrative embodiment. As shown, the control system includes a control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also input to the control unit 350 via the I/O interface 370 are the output of the inlet sensor 301, the output of an upper outlet sensor 302, the output of a shift outlet sensor 303, the output of a prestack sensor 304, the output of a staple discharge sensor 305, the output of a sheet sensor 310, the output of the belt HP sensor 311, the output of the staple HP sensor, the output of a fold plate HP sensor 325, and the output of the sheet surface sensors 330.

The CPU 360 controls, based on the above various inputs, the tray motor 168 assigned to the shift tray 202, the guide plate motor assigned to the guide plate, the shift motor assigned to the shift tray 202, a knock motor, not shown, assigned to the knock roller 12, solenoids including one assigned to a knock solenoid (SOL) 170, a motor assigned to various rollers for conveyance, the discharge motor 157 assigned to the discharge belt 52, the stapler motor assigned to the edge stapler S1, the steer motor 161 assigned to the guide plate 54 and movable guide 55, a conveyance motor, not shown, assigned to rollers that convey a sheet stack, a rear fence motor assigned to the movable rear fence 73, the fold plate motor 166 assigned to the fold plate 74, a fold roller motor assigned to the fold roller 81, and other motors and solenoids.

The pulse signals of a staple conveyance motor, not shown, that drives the staple discharge rollers are input to the CPU 360 and counted thereby. The CPU 360 controls the knock solenoid 170 and jogger motor 158 in accordance with the number of pulses counted. Also, the CPU 360 causes the punch unit 100 to operate by controlling a clutch or a motor. The CPU 360 controls the retraction guide motor 477 and cutter motor 404 as well. The CPU 360 controls the finisher PD in accordance with a program stored in a ROM (Read Only Memory), not shown, by using a RAM (Random Access Memory) as a work area.

Specific operations to be executed by the CPU 360 in various modes available with the illustrative embodiment will be described hereinafter.

First, in a non-staple mode A, a sheet is conveyed via the paths A and B to the upper tray 201 without being stapled. To implement this mode, the path selector 15 is moved clockwise, as viewed in FIG. 1, to unblock the path B. The operation of the CPU 360 in the non-staple mode will be described with reference to FIG. 15.

Figure 15:
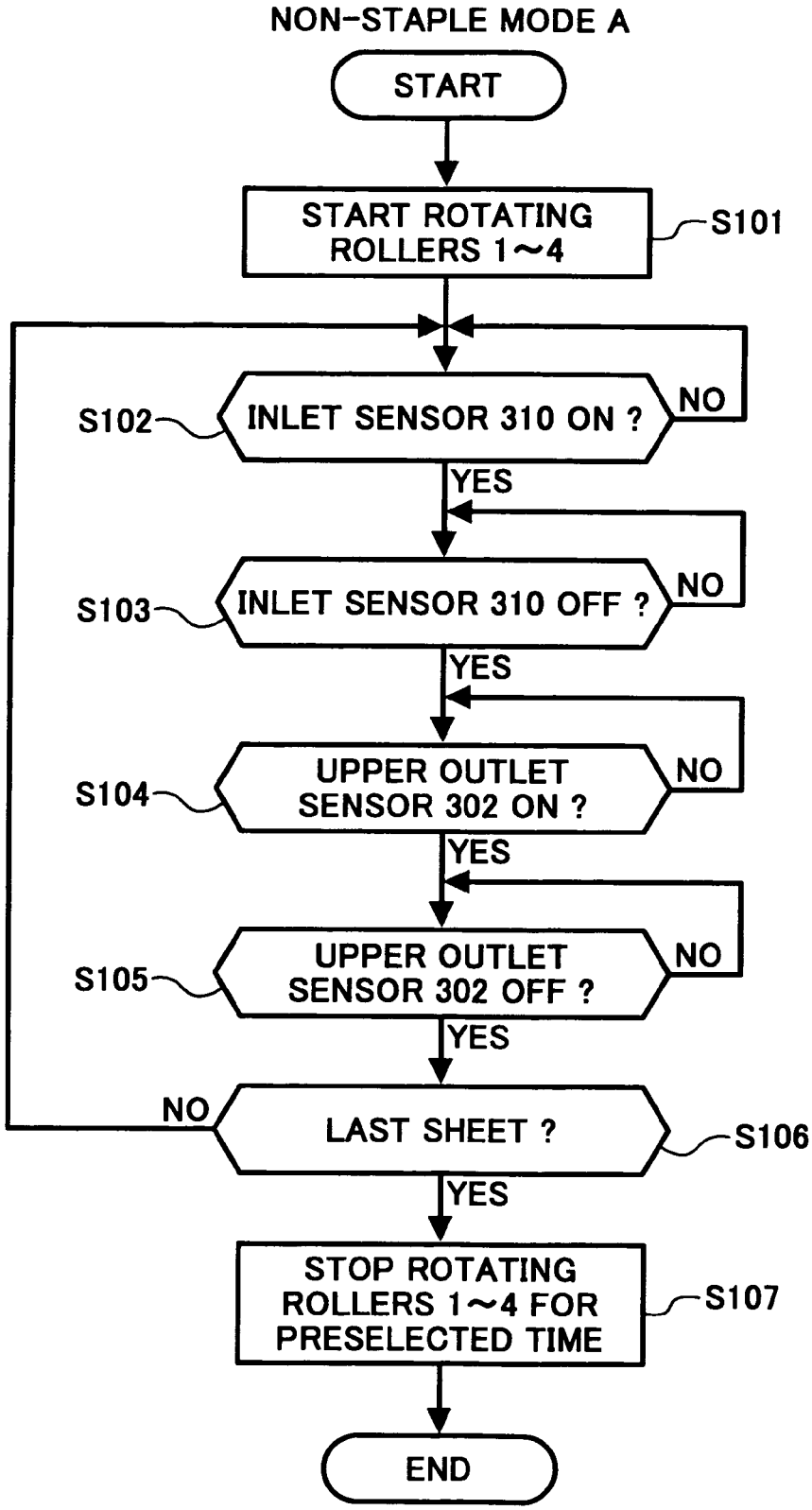
FIG. 15 is a flowchart demonstrating a non-staple mode A procedure relating to the preferred embodiments.

As shown in FIG. 15, before a sheet driven out of the image forming apparatus PR enters the finisher PD, the CPU 360 causes the inlet roller pair 1 and conveyor roller pair 2 on the path A to start rotating (step S101). The CPU 360 then checks the ON/OFF state of the inlet sensor 301 (steps S102 and S103) and that of the upper outlet sensor 302 (steps 5104 and S105) for thereby confirming the passage of sheets. When a preselected period of time elapses since the passage of the last sheet (YES, step S106), the CPU 360 causes the above rollers to stop rotating (step S107). In this manner, all the sheets handed over from the image forming apparatus PR to the finisher PD are sequentially stacked on the upper tray 201 without being stapled. If the desired, the punch unit 100, which intervenes between the inlet roller pair 1 and the conveyor roller pair 2, may punch the consecutive sheets.

In a non-staple mode B, the sheets are routed through the paths A and C to the shift tray 202. In this mode, the path selectors 15 and 16 are respectively moved counterclockwise and clockwise, unblocking the path C. The non-staple mode B will be described with reference to FIGS. 16A and 163.

Figure 16A:
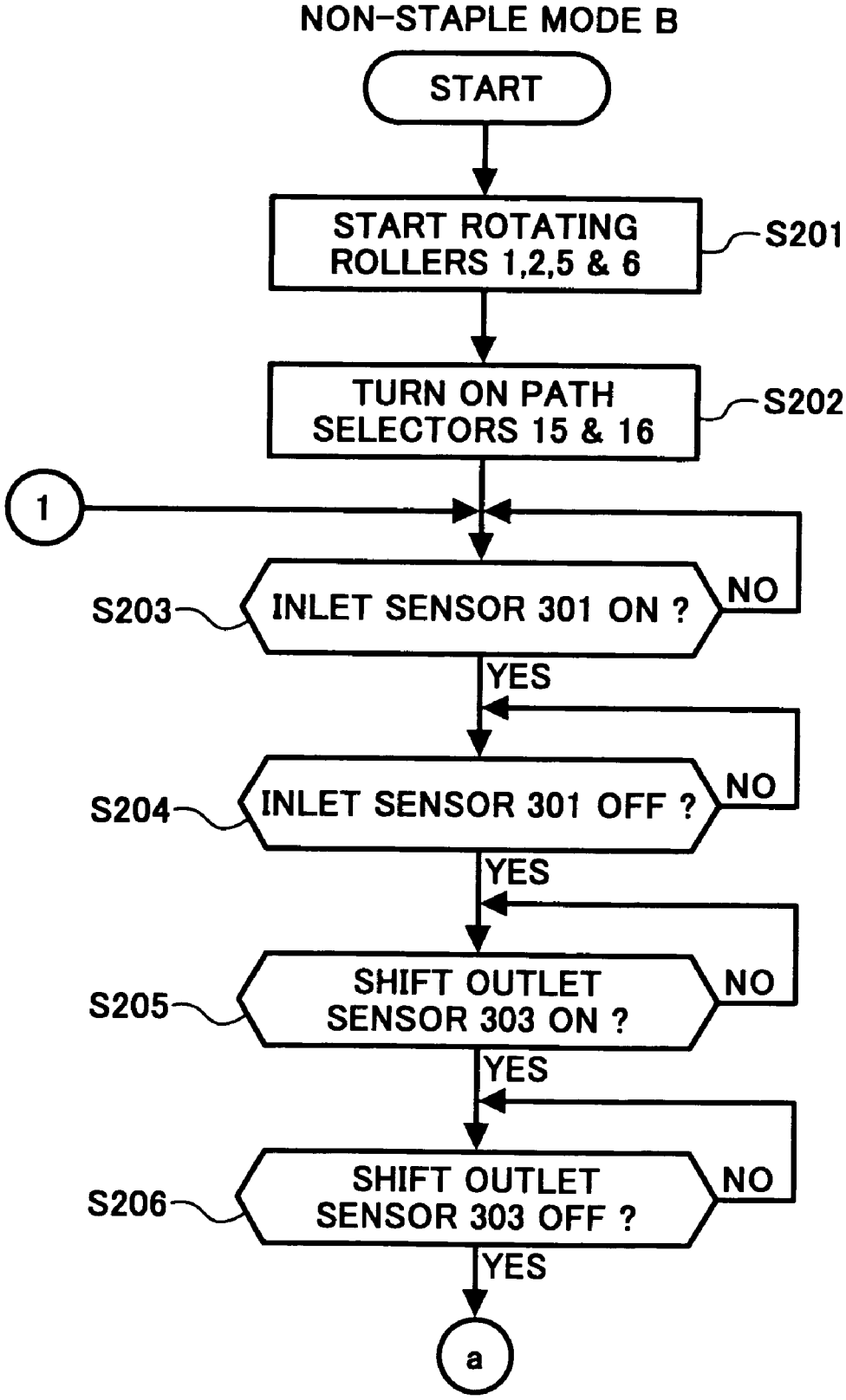
FIG. 16 is a flowchart demonstrating a non-staple mode B procedure relating to the preferred embodiments.
Figure 16B:
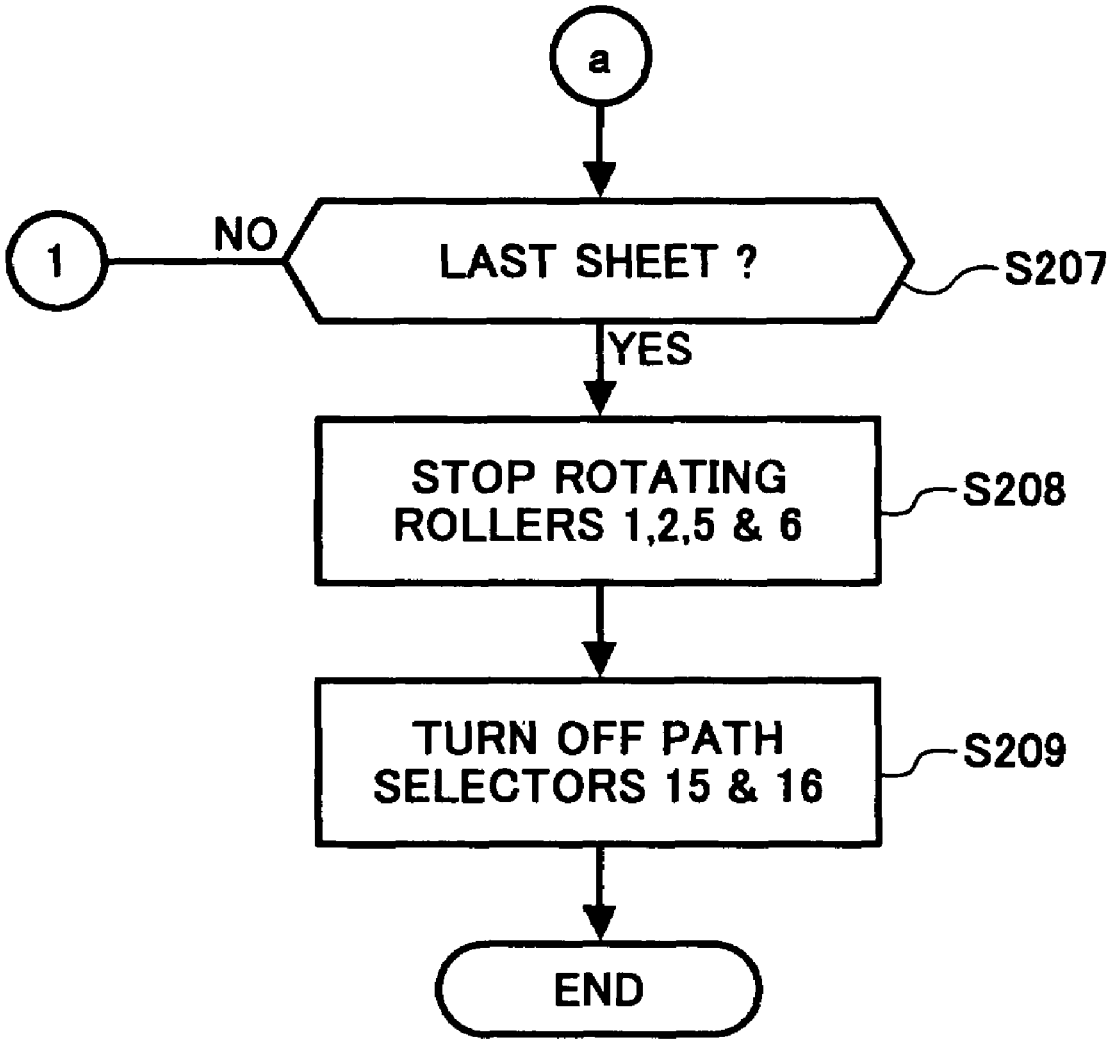

As shown in FIGS. 16A and 16B, before a sheet driven out of the image forming apparatus PR enters the finisher PD, the CPU 360 causes the inlet roller pair 1 and conveyor roller pair 2 on the path A and the conveyor roller pair 5 and shift outlet roller pair 6 on the path C to start rotating (step S201). The CPU 360 then energizes the solenoids assigned to the path selectors 15 and 16 (step S202) to thereby move the path selectors 15 and 16 counterclockwise and clockwise, respectively. Subsequently, the CPU 360 checks the ON/OFF state of the inlet sensor 301 (steps S203 and S204) and that of the shift outlet sensor 303 (steps 5205 and 5206) to thereby confirm the passage of the sheets.

On the elapse of a preselected period of time since the passage of the last sheet (YES, step S207), the CPU 360 causes the various rollers mentioned above to stop rotating (step S208) and turns off the solenoids (steps 5209). In this manner, all the sheets entered the finisher PD are sequentially stacked on the shift tray 202 without being stapled. Again, the punch unit 100 intervening between the inlet roller pair 1 and the conveyor roller pair 2 may punch the consecutive sheets, if desired.

In a sort/stack mode, the sheets are also sequentially delivered from the path A to the shift tray 202 via the path C. A difference is that the shift tray 202 is shifted perpendicularly to the direction of sheet discharge copy by copy in order to sort the sheets. The path selectors 15 and 16 are respectively rotated counterclockwise and clockwise as in the non-staple mode B, thereby unblocking the path C. The sort/stack mode will be described with reference to FIGS. 17A and 17B.

Figure 17A:
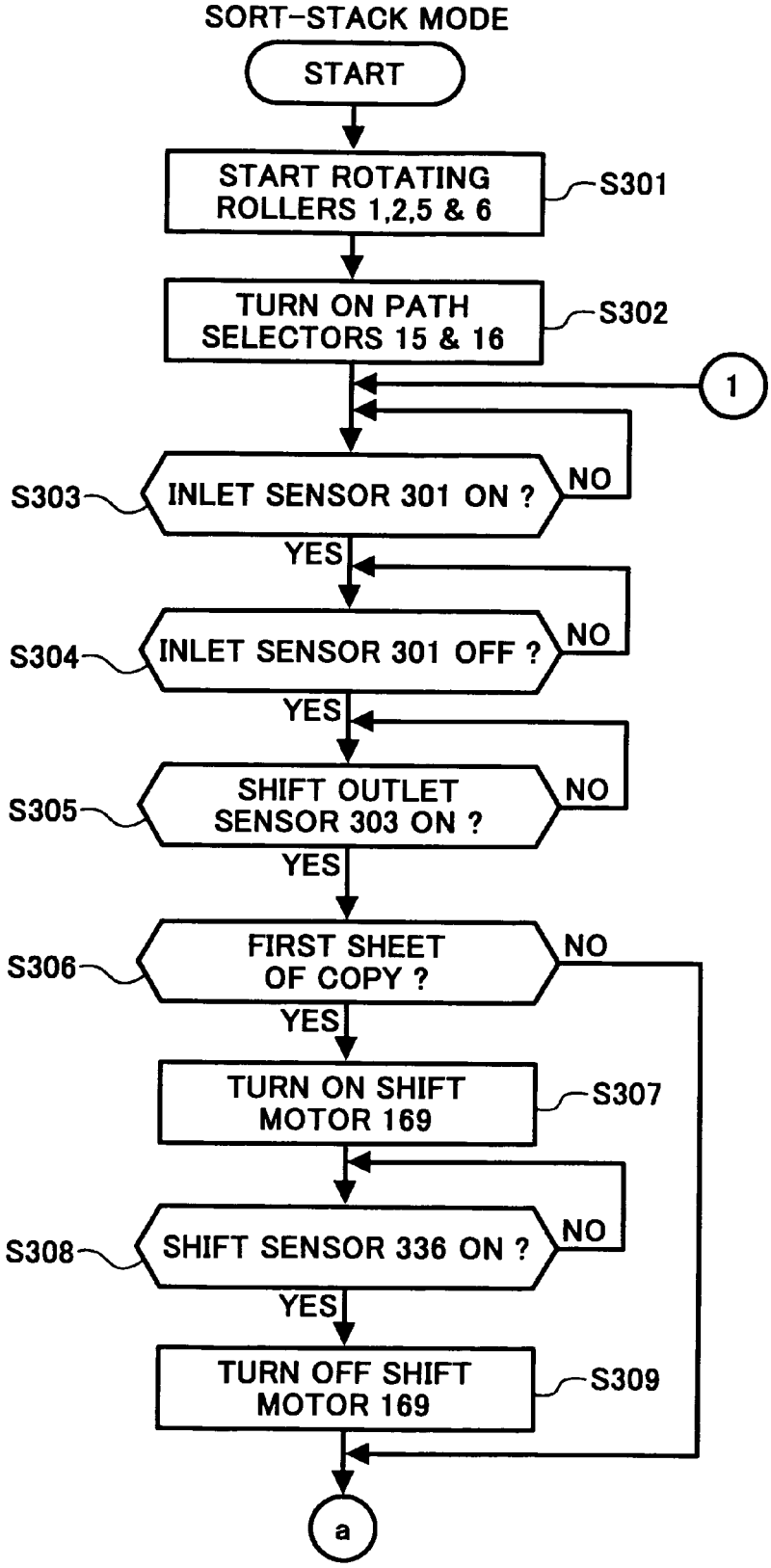
FIGS. 17A and 17B are flowcharts demonstrating a sort/stack mode procedure relating to the preferred embodiments.
Figure 17B:
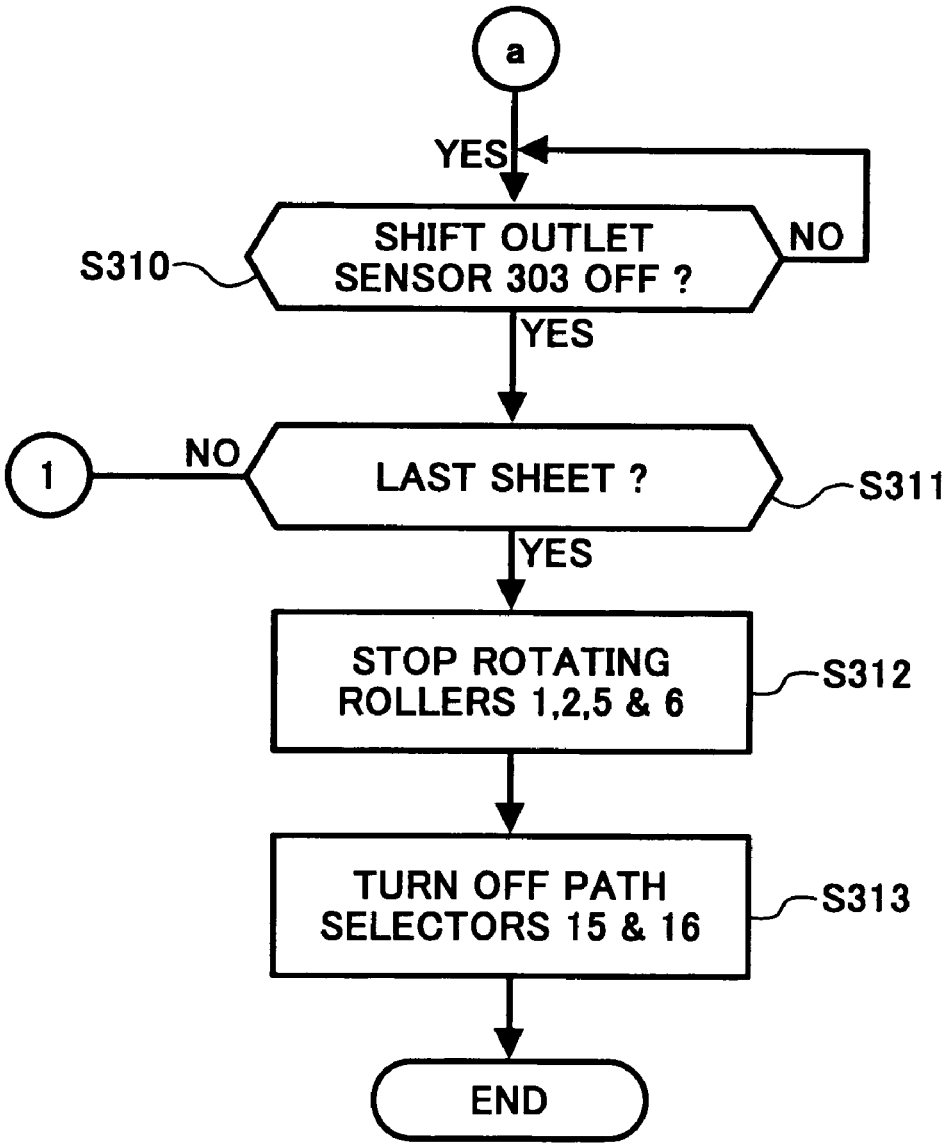

As shown in FIGS. 17A and 17B, before a sheet driven out of the image forming apparatus PR enters the finisher PD, the CPU 360 causes the inlet roller pair 1 and conveyor roller pair 2 on the path A and the conveyor roller pair 5 and shift outlet roller pair 6 on the path C to start rotating (step S301). The CPU 360 then turns on the solenoids assigned to the path selectors 15 and 16 (step 5302) to thereby move the path selectors 15 and 16 counterclockwise and clockwise, respectively. Subsequently, the CPU 360 checks the ON/OFF state of the inlet sensor 301 (steps 530,3 and S304) and that of the shift outlet sensor 303 (step S305).

If the sheet passed the shift outlet sensor 303 is the first sheet of a copy (YES, step S306), then the CPU 360 turns on the shift motor 169 (step 5307) to thereby move the shift tray 202 perpendicularly to the direction of sheet conveyance until the shift sensor senses the tray 202 (steps 5308 and S309). When the sheet moves away from the shift outlet sensor 303 (YES, step S310), the CPU 360 determines whether or not the sheet is the last sheet (step S311). If the answer of the step 5311 is NO, meaning that the sheet is not the last sheet of a copy, and if the copy is not a single sheet, then the procedure returns to the step S303. If the copy is a single sheet, the CPU executes a step 5312.

If the answer of the step S306 is NO, meaning that the sheet passed the shift outlet sensor 303 is not the first sheet or a copy, then the CPU 360 discharges the sheet (step S310) because the shift tray 202 has already been shifted. The CPU 360 then determines whether or not the discharged sheet is the last sheet (step S311). If the answer of the step S311 is NO, then the CPU 360 repeats the step S303 and successive steps with the next sheet. If the answer of the step S311 is YES, then the CPU 360 causes, on the elapse of a preselected period of time, the inlet roller pair 1, conveyor roller pairs 2 and 5 and shift outlet roller pair 6 to stop rotating (step 5312) and turns off the solenoids assigned to the path selectors 15 and 16 (step S313). In this manner, all the sheets sequentially entered the finisher PD are sorted and stacked on the shift tray 202 without being stapled. In this mode, too, the punch unit 100 may punch the consecutive sheets, if desired.

In a staple mode, the sheets are conveyed from the path A to the staple tray F via the path D, positioned and stapled on the staple tray F, and then discharged to the shift tray 202 via the path C. In this mode, the path selectors 15 and 16 are rotated counterclockwise to unblock the route extending from the path A to the path D. The staple mode will be described with reference to FIGS. 18A through 18C.

Figure 18A:
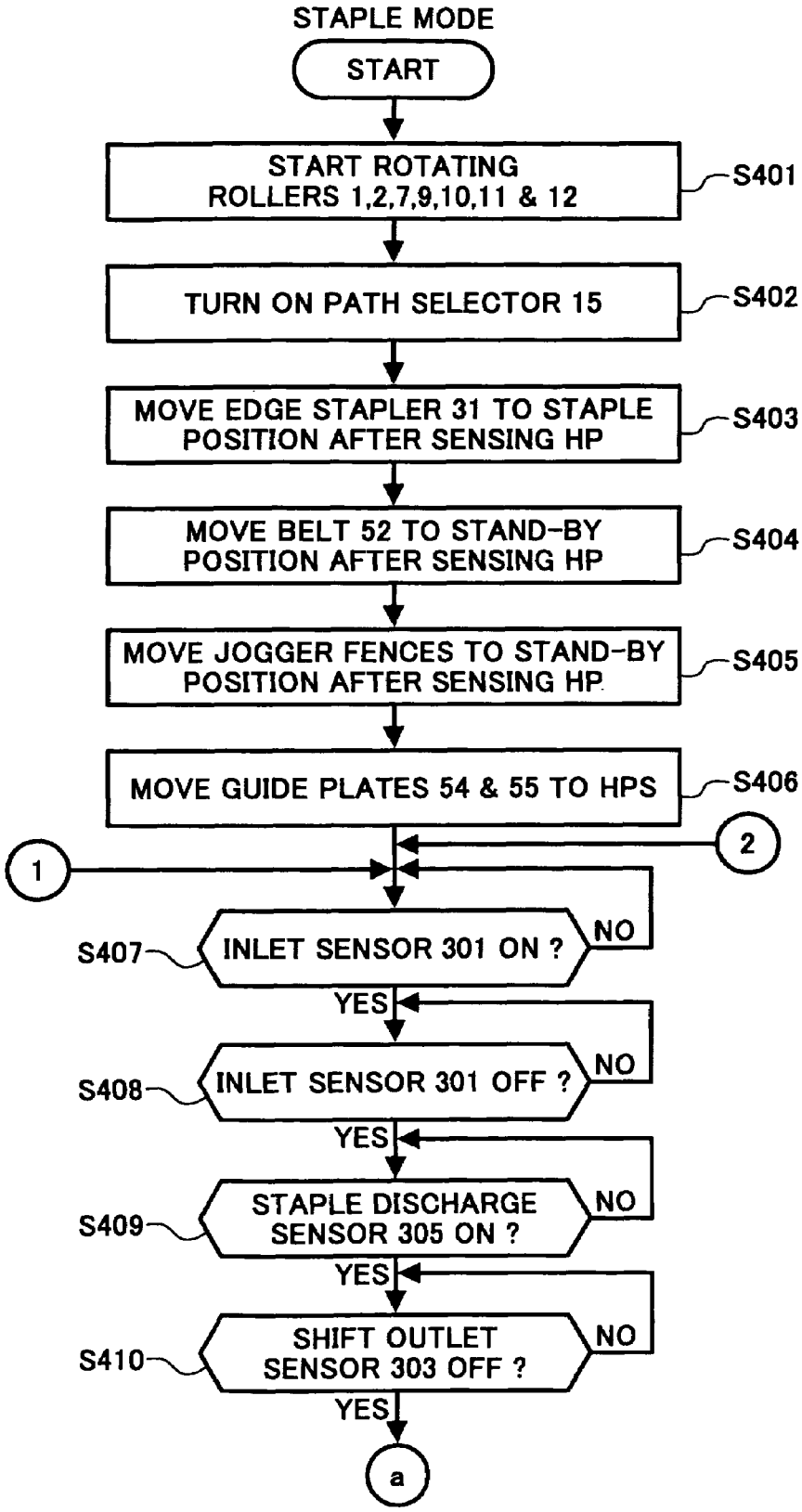
FIGS. 18A through 18C are flowcharts demonstrating a staple mode procedure relating to the preferred embodiment.
Figure 18B:
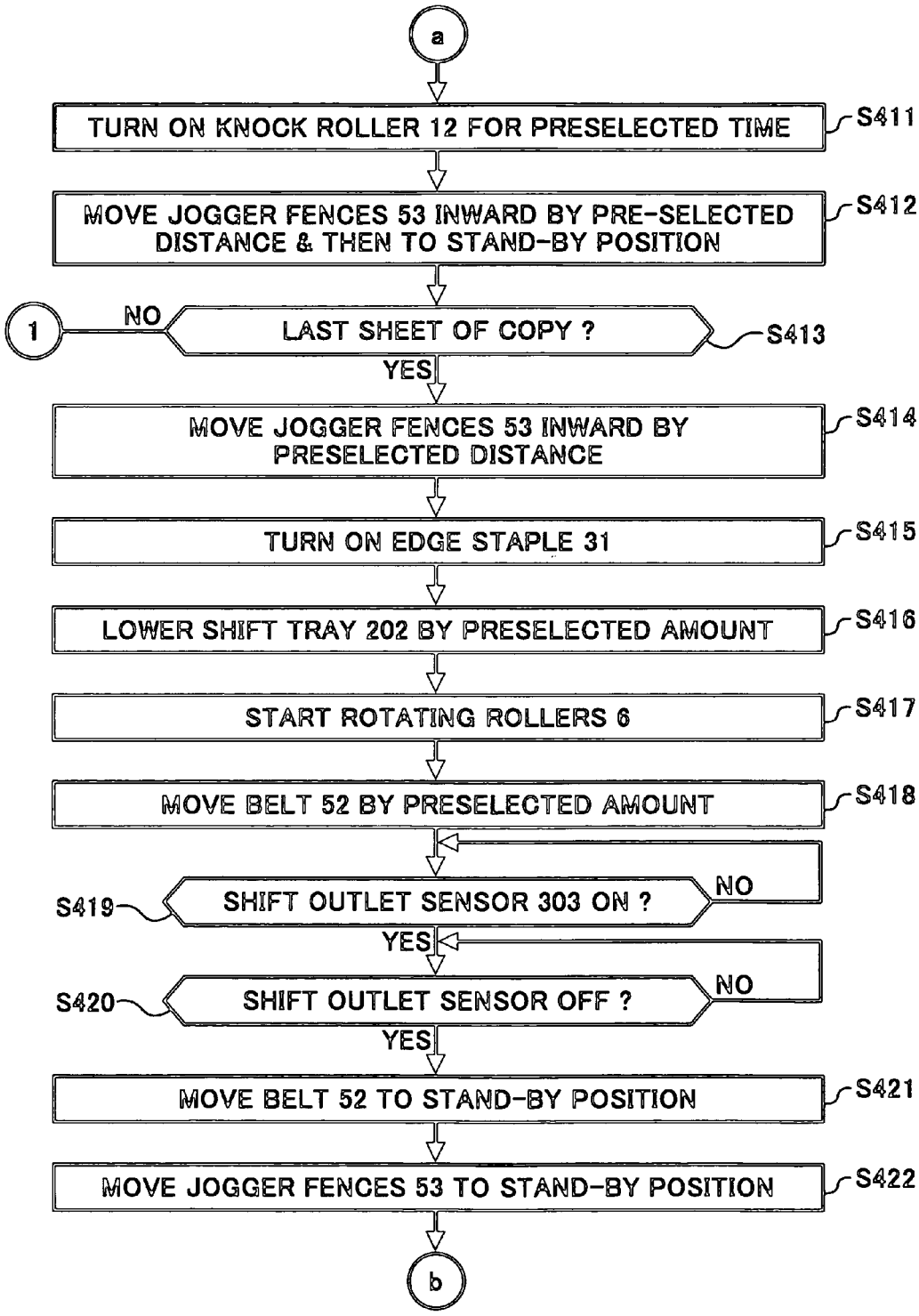
Figure 18C:
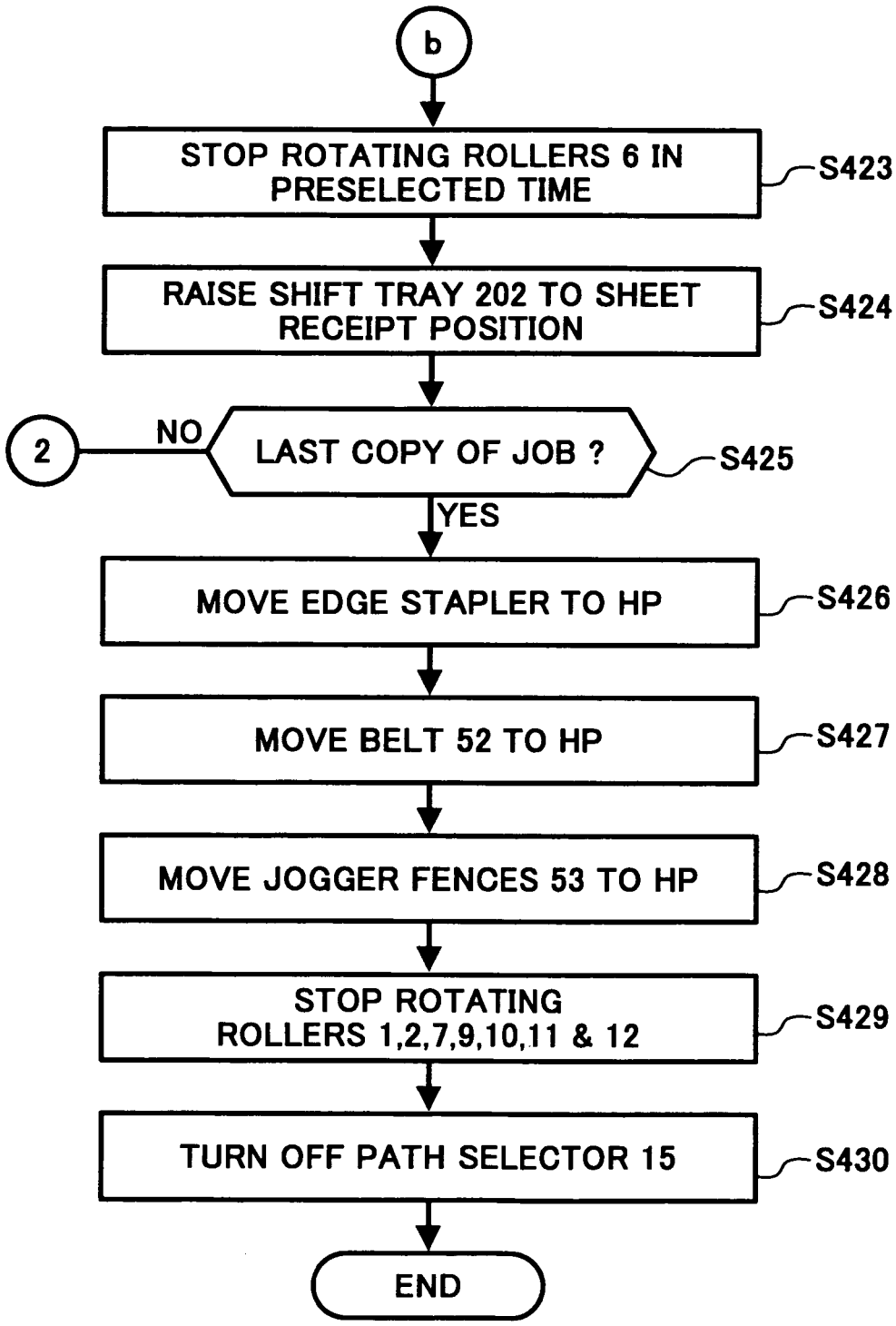

As shown in FIGS. 18A through 18C, when a sheet driven out of the image forming apparatus PR is about to enter the finisher PD, the CPU 360 causes the inlet roller pair 1 and conveyor roller pair 2 on the path A, conveyor roller pairs 7, 9 and 10 and staple outlet roller 11 on the path D and knock roller 12 to start rotating (step 5401). The CPU 360 then turns on the solenoid assigned to the path selector 15 (step S402) to thereby cause it to rotate counterclockwise.

After the stapler HP sensor 312 has sensed the edge stapler S1 at the home position, the CPU 360 drives the stapler motor 159 to move the edge stapler S1 to a preselected stapling position (step S403). Also, after the belt HP sensor 311 has sensed the belt 52 at the home position, the CPU 360 drives the discharge motor 157 to bring the belt 52 to a stand-by position (step S404). Further, after the jogger fence motor HP sensor has sensed the jogger fences 53 at the home position, the CPU 360 moves the jogger fences 53 to a stand-by position (step 5405). In addition, the CPU 360 causes the guide plate 54 and movable guide 55 to move to their home positions (step 406).

If the inlet sensor 301 has turned on (YES, step 5407) and then turned off (YES, step S408), if the staple discharge sensor 305 has turned on (YES, step S409) and if the shift outlet sensor 303 has turned on (YES, step S410), then the CPU 360 determines that a sheet is present on the staple tray F. In this case, the CPU 360 turns on the knock solenoid 170 over a preselected period of time to cause the knock roller 12 to contact the sheet and force it against the rear fences 51, thereby positioning the rear edge of the sheet (step S411). Subsequently, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position (step S412). The CPU 360 repeats the step S407 and successive steps with every sheet. When the last sheet of a copy arrives at the staple tray F (YES, step 5413), the CPU 360 moves the jogger fences 53 inward to a position where they prevent the edges of the sheet from being dislocated (step S414). In this condition, the CPU 360 turns on the edge stapler S1 and causes it to staple the edge of the sheet stack (step 5415).

On the other hand, the CPU 360 lowers the shift tray 202 by a preselected amount (step S416) in order to produce a space for receiving the stapled stack. The CPU 360 then drives the shift discharge roller pair 6 via the shift discharge motor (step S417) and drives the belt 52 by a preselected amount via the discharge motor 157 (step S418), so that the stapled sheet stack is raised toward the path C. As a result, the stapled sheet stack is driven out to the shift tray 202 via the shift outlet roller pair 6. After the shift outlet sensor S303 has turned on (step 5419) and then turned off (step S420), meaning that the sheet stack has moved away from the sensor 303, the CPU 360 moves the belt 52 and jogger fences 53 to their stand-by positions (steps 5421 and S422), causes the shift outlet roller pair 6 to stop rotating on the elapse of a preselected period of time (step S423), and raises the shift tray 202 to a sheet receiving position (step S424). The rise of the shift tray 202 is controlled in accordance with the output of the sheet surface sensor 330 responsive to the top of the sheet stack positioned on the shift tray 202.

After the last copy or set of sheets has been driven out to the shift tray 202, the CPU 360 returns the edge stapler S1, belt 52 and jogger fences 53 to their home positions (steps S426, S427 and S428) and causes the inlet roller pair 1, conveyor roller pairs 2, 7, 9 and 10, staple discharge roller pair 11 and knock roller 12 to stop rotating (step S429). Further, the CPU 360 turns off the solenoid assigned to the path selector 15 (step S430). Consequently, all the structural parts are returned to their initial positions. In this case, too, the punch unit 100 may punch the consecutive sheets before stapling.

The operation of the staple tray F in the staple mode will be described more specifically hereinafter. When the staple mode is selected, the jogger fences 53 each are moved from the home position to the stand-by position 7 mm short of one end of the width of sheets to be stacked on the staple tray F (step S405). When a sheet being conveyed by the staple discharge roller pair 11 passes the staple discharge sensor 305 (step S409), the jogger fence 53 is moved inward from the stand-by position by 5 mm.

The staple discharge sensor 305 senses the trailing edge of the sheet and sends its output to the CPU 360. In response, the CPU 360 starts counting drive pulses input to the staple motor, not shown, driving the staple discharge roller pair 11. On counting a preselected number of pulses, the CPU 360 turns on the knock solenoid 170 (step S411). The knock solenoid 170 causes the knock roller 12 to contact the sheet and force it downward when energized, so that the sheet is positioned by the rear fences 51. Every time a sheet to be stacked on the staple tray F passes the inlet sensor 301 or the staple discharge sensor 305, the output of the sensor 301 is sent to the CPU 360, causing the CPU 360 to count the sheet.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next sheet (step S412). The CPU 360 repeats such a procedure up to the last page (step S413). The CPU 360 again causes the jogger fences 53 to move inward by 7 mm and then stop, thereby causing the jogger fences 53 to retrain the opposite edges of the sheet stack to be stapled. Subsequently, on the elapse of a preselected period of time, the CPU 360 drives the edge stapler S1 via the staple motor for thereby stapling the sheet stack (step 5415). If two or more stapling positions are designated, then the CPU 360 moves, after stapling at one position, the edge stapler S1 to another desired position along the edge of the sheet stack via the stapler motor 159. At this position, the edge stapler S1 again staples the sheet stack. This is repeated when three or more stapling positions are designated.

After the stapling operation, the CPU 360 drives the belt 52 via the discharge motor 157 (step S418). At the same time, the CPU 360 drives the outlet motor to cause the shift outlet roller pair 6 to start rotating in order to receive the stapled sheet stack lifted by the hook 52*a* (step S417). At this instant, the CPU 360 controls the jogger fences 53 in a different manner in accordance with the size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack. When a preselected number of pulses are output since the turn-on of the sheet sensor 310 or the belt HP sensor 311, the CPU 360 causes the jogger fences 53 to retract by 2 mm and release the sheet stack. The preselected number of pulses corresponds to an interval between the time when the hook 52*a* contacts the trailing edge of the sheet stack and the time when it moves away from the upper ends of the jogger fences 53.

On the other hand, when the number of sheets stapled together or the sheet size is larger than the preselected value, the CPU 360 causes the jogger fences 53 to retract by 2 mm beforehand. In any case, as soon as the stapled sheet stack moves away from the jogger fences 53, the CPU 360 moves the jogger fences 53 further outward by 5 mm to the stand-by position (step S422) for thereby preparing it for the next sheet. If desired, the restraint to act on the sheet stack may be controlled on the basis of the distance of each jogger fence from the sheet stack.

In a center staple and bind mode (without edge cutting), the sheets are sequentially conveyed from the path A to the staple tray F via the path D, positioned and stapled at the center on the tray F, folded on the fold tray G, and then driven out to the lower tray 203 via the path H. In this mode, the path selectors 15 and 16 both are rotated counterclockwise to unblock the route extending from the path A to the path D. Also, the guide plate 54 and movable guide 55 are closed, as shown in FIG. 7, guiding the stapled sheet stack to the fold tray G. The center staple and bind mode (without edge cutting) will be described with reference to FIGS. 19A through 19C.

Figure 19A:
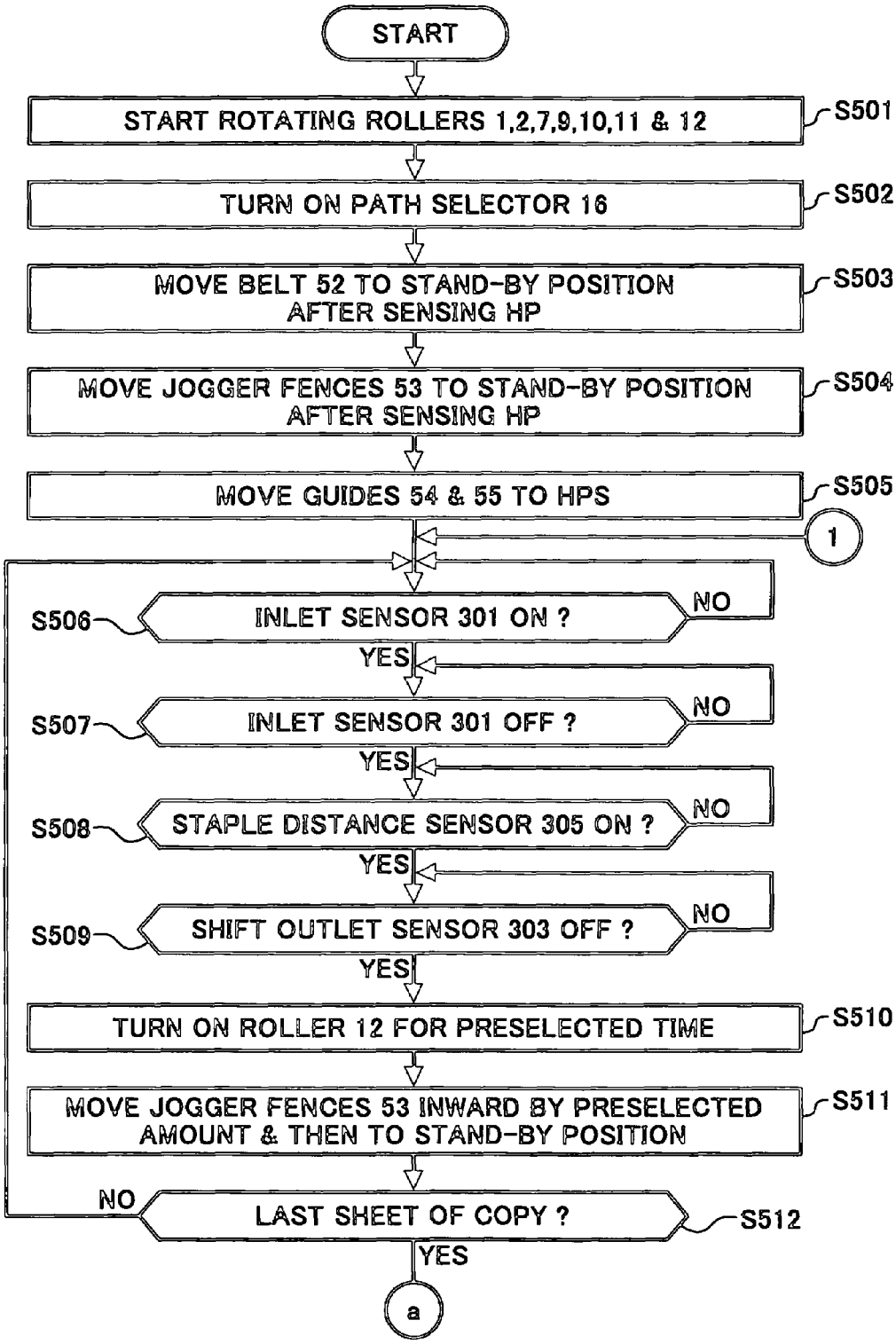
FIGS. 19A through 19C are flowcharts demonstrating a center staple and bind mode (without edge cutting) relating to the preferred embodiments.
Figure 19B:
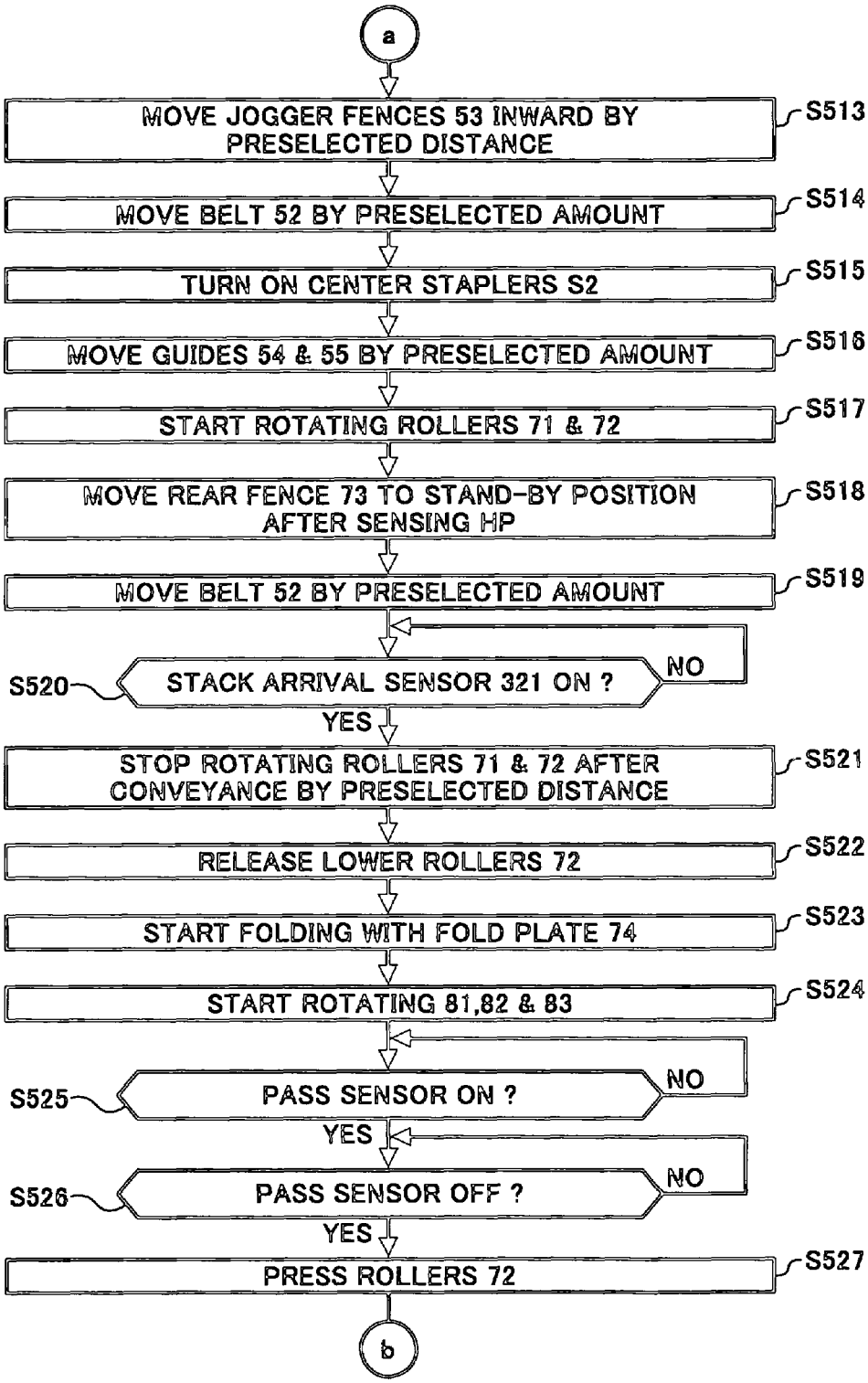
Figure 19C:
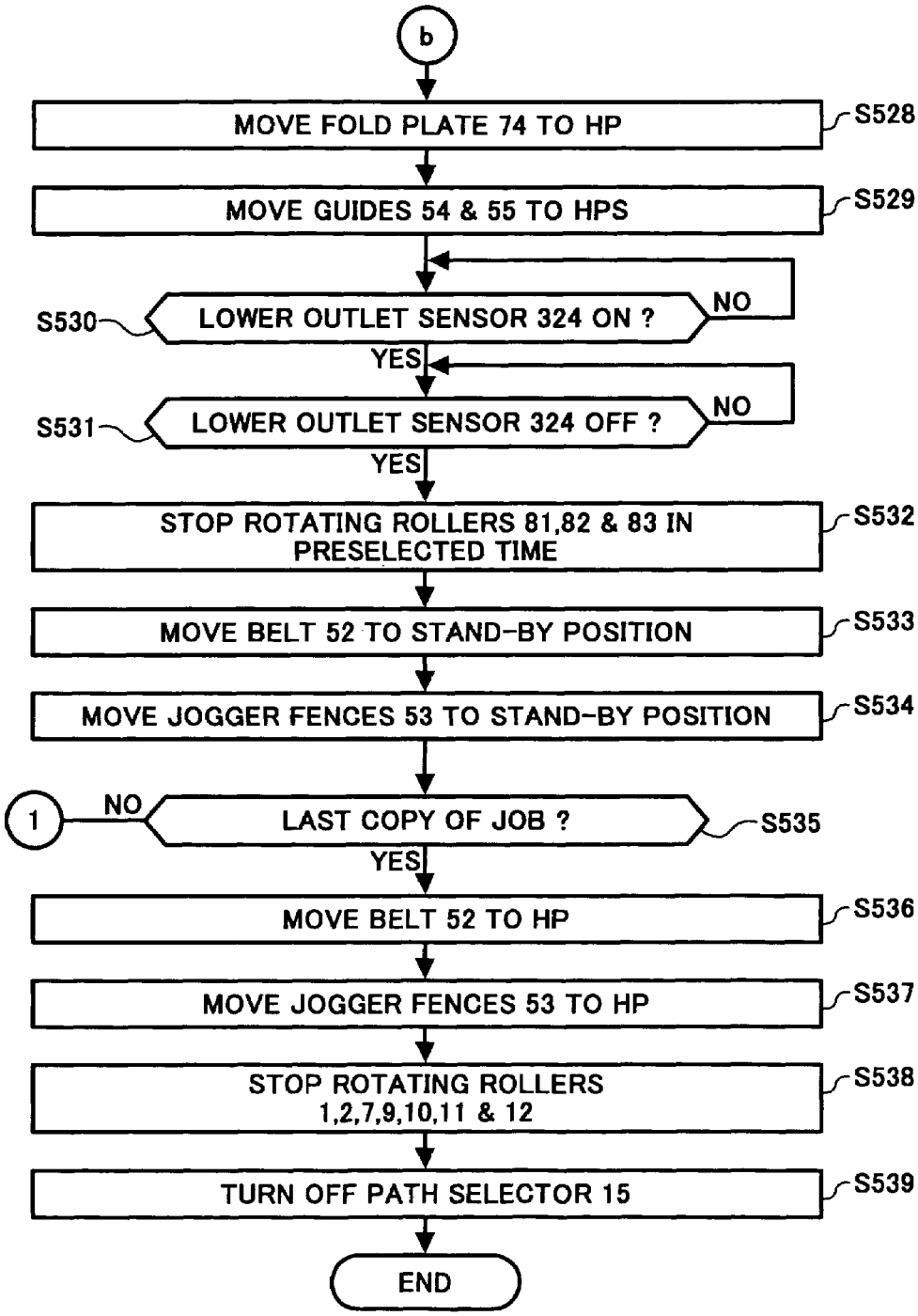

As shown in FIGS. 19A through 19C, before a sheet driven out of the image forming apparatus PR enters the sheet finisher PD, the CPU 360 causes the inlet roller pair 1 and conveyor roller pair 2 on the path A, the conveyor roller pairs 7, 9 and 10 and staple outlet roller 11 on the path D and knock roller 12 to start rotating (step 5501). The CPU 360 then turns on the solenoid assigned to the path selector 15 (step S502) to thereby cause the path selector 15 to rotate counterclockwise.

Subsequently, after the belt HP sensor 311 has sensed the belt 52 at the home position, the CPU 360 drives the discharge motor 157 to move the belt 52 to the stand-by position (step S503). Also, after the jogger fence HP sensor has sensed each jogger fence 53 at the home position, the CPU 360 moves the jogger fence 53 to the stand-by position (step S504). Further, the CPU 360 moves the guide plate 54 and movable guide 55 to their home positions (step S505).

If the inlet sensor 301 has turned on (YES, step S506) and then turned off (YES, step S507), if the staple discharge sensor 305 has turned on (YES, step 5508) and if the shift outlet sensor 303 has turned on (YES, step S509), then the CPU 360 determines that a sheet is present on the staple tray. In this case, the CPU 360 energizes the knock solenoid 170 for the preselected period of time to cause the knock roller 12 to contact the sheet and force it against the rear fences 51, thereby positioning the trailing edge of the sheet (step S510). Subsequently, the CPU 360 drives the jogger motor 158 to move each jogger fence 53 inward by the preselected distance for thereby positioning the sheet in the direction of width and then returns the jogger fence 53 to the stand-by position (step S511). The CPU 360 repeats the step S506 and successive steps with every sheet. When the last sheet of a copy arrives at the staple tray F (YES, step S512), the CPU 360 moves the jogger fences 53 inward to the position where they prevent the edges of the sheets from being dislocated (step S513).

After the step 5513, the CPU 360 turns on the discharge motor 157 to thereby move the belt 52 by a preselected amount (step S514), so that the belt 52 lifts the sheet stack to a stapling position assigned to the center staplers S2. Subsequently, the CPU 360 turns on the center staplers S2 at the intermediate portion of the sheet stack for thereby stapling the sheet stack at the center (step S515). The CPU 360 then moves the guides 54 and 55 by a preselected amount each in order to form a path directed toward the fold tray G (step S516) and causes the upper and lower roller pairs 71 and 72 of the fold tray G to start rotating (step S517). As soon as the movable rear fence 73 of the fold tray G is sensed at the home position, the CPU 360 moves the fence 73 to a stand-by position (step S518). The fold tray G is now ready to receive the stapled sheet stack.

After the step S518, the CPU 360 further moves the belt 52 by a preselected amount (step S519) and causes the discharge roller 56 and press roller 57 to nip the sheet stack and convey it to the fold tray G. When the leading edge of the stapled sheet stack is conveyed by a preselected distance past the stack arrival sensor 321 (step S520), the CPU 360 causes the upper and lower roller pairs 71 and 72 to stop rotating (step S521) and then releases the lower rollers 72 from each other. Subsequently, the CPU 360 causes the fold plate 74 to start folding the sheet stack (step 5523) and causes the fold roller pairs 81 and 82 and lower outlet roller pair 83 to start rotating (step S524). The CPU 360 then determines whether or not the folded sheet stack has moved away from the pass sensor 323 (steps S525 and S526). If the answer of the step S526 is YES, then the CPU 360 brings the lower roller 72 into contact (step S527) and moves the guides 64 and 55 to their home positions (steps S528 and S529).

It is to be noted that the pass sensor 323 plays the role of a sensor for determining the length of a sheet at the same time.

In the above condition, the CPU 360 determines whether or not the trailing edge of the folded sheet stack has moved away from the lower outlet sensor 324 (steps S530 and S531). If the answer of the step S531 is YES, then the CPU 360 causes the fold roller pairs 81 and 82 and lower outlet roller pair 83 to further rotate over a preselected period of time and then stop (step S532) and then causes the belt 52 and jogger fences 53 to return to the stand-by positions (steps 5533 and S534). Subsequently, the CPU 360 determines whether or not the above sheet stack is the last copy of a single job (step 5535). If the answer of the step 5535 is NO, then the procedure returns to the step S506. If the answer of the step 5535 is YES, then the CPU 360 returns the belt 52 and jogger fences 53 to the home positions (steps S536 and S537). At the same time, the CPU 360 causes the staple discharge roller pair 11 and knock roller 12 to stop rotating (step 5538) and turns off the solenoid assigned to the path selector 15 (step S539). As a result, all the structural parts are returned to their initial positions.

The stapling and folding operation to be performed in the center fold mode will be described in more detail hereinafter.

Figure 20:
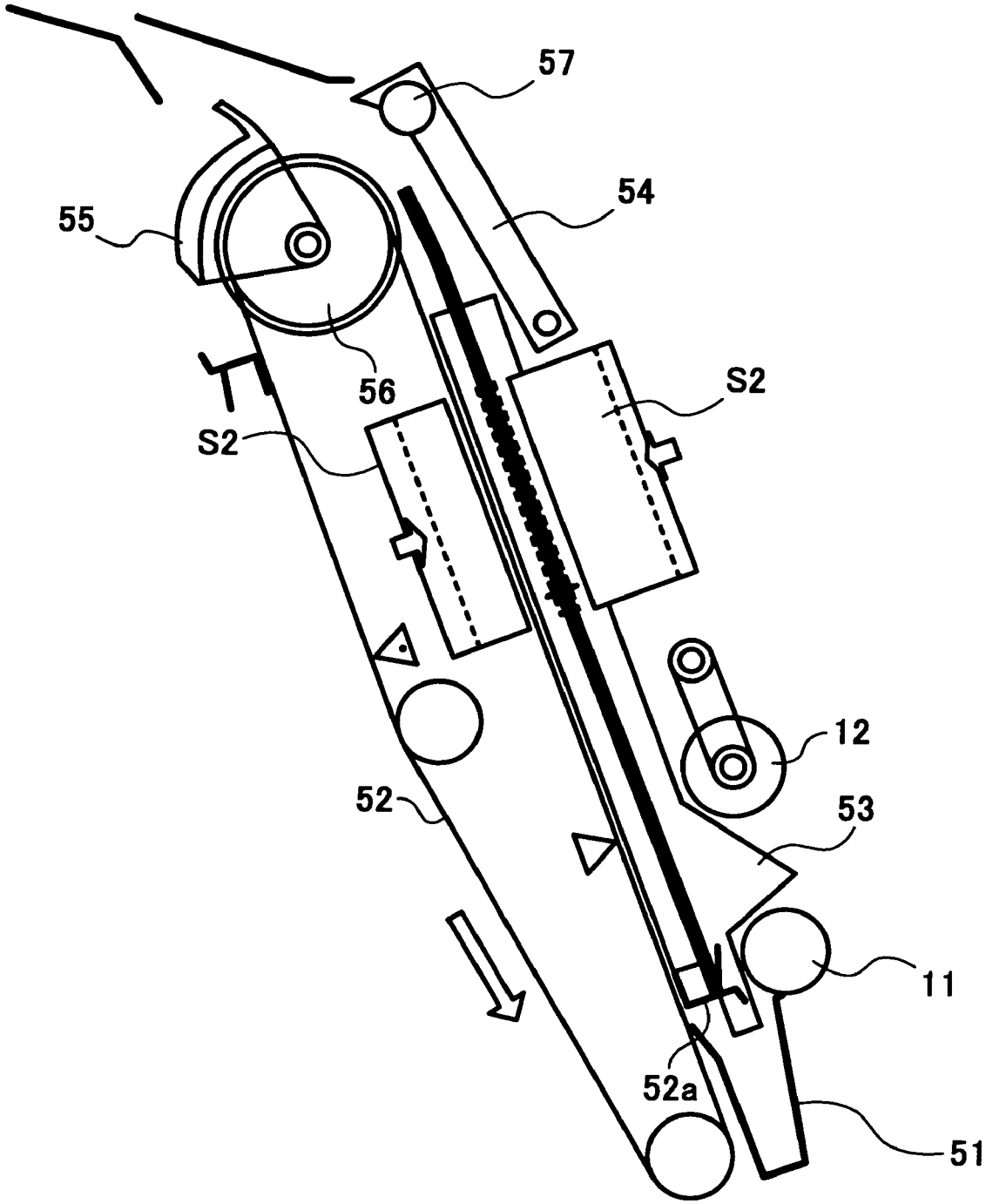
FIG. 20 shows a condition wherein a sheet stack on the staple tray is stapled at the center in the center staple and bind mode.

A sheet is steered by the path selectors 15 and 16 to the path D and then conveyed by the roller pairs 7, 9 and 10 and staple discharge roller 11 to the staple tray F. The staple tray F operates in exactly the same manner as in the staple mode stated earlier before positioning and stapling. Subsequently, as shown in FIG. 20, the hook 52*a* conveys the sheet stack to the downstream side by a distance matching with the sheet size. Thereafter the center staplers S2 staple the sheet stack at the center.

Figure 23:
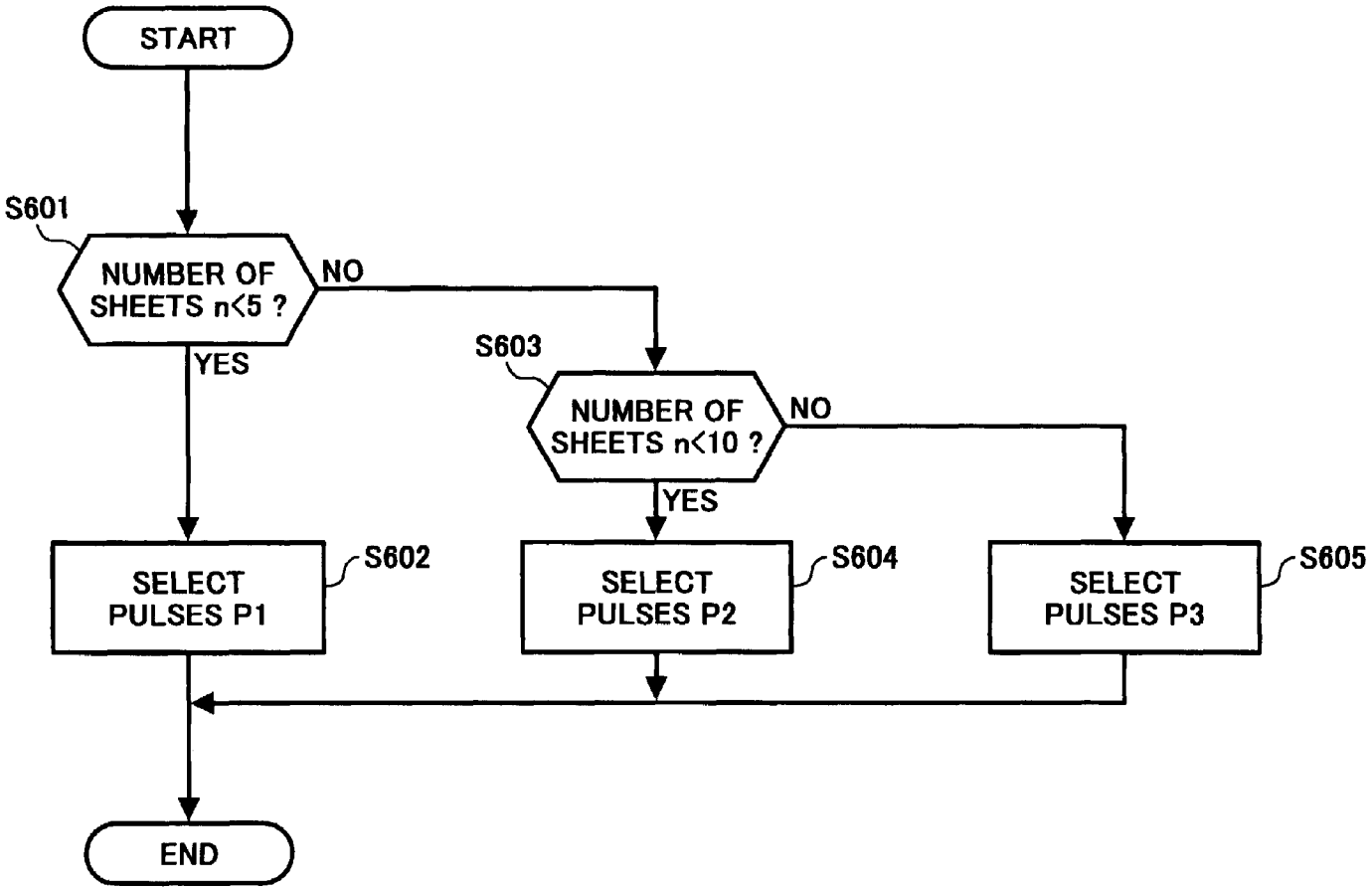
FIG. 23 is a flowchart demonstrating a procedure particular to a first embodiment of the present invention and executed to determine the number of sheets stapled together.

Subsequently, the movable guide 55 is angularly moved to steer the stapled sheet stack to the downstream path while the guide plate 54 is closed by a preselected amount to cause the press roller 57 to adjoin the discharge roller 56 at a small distance. In the illustrative embodiment, the small distance is varied stepwise in accordance with the number of sheets and smaller than the thickness of a sheet stack. For example, as shown in FIG. 23, the CPU 360 first determines whether or not the number of sheets n included in a stack is smaller than five (step S601). If the answer of the step S601 is NO, then the CPU 360 determines whether or not the number n is smaller than ten (step 5603). Motor drive pulses P1, P2 and P3 are set such that the above small distance is zero when the number n is two to four (step 5602) or 0.5 mm when the number n is five to nine (step S603) or 1 mm when the number n is ten or above. It is to be noted that the small distance is set in accordance with the motor pulses P1 through P3 and the configuration of the cam 61.

Subsequently, a stapled sheet stack starts being moved to the downstream side. As soon as the leading edge of the sheet stack moves away from the nip between the press roller 57 and the discharge roller 55, the CPU 360 further closes the guide plate 54 until the press roller 57 contacts the discharge roller 56. This closing timing is controlled on the basis of the drive pulses of the discharge motor 157 preselected on a sheet size basis, so that the pass distance is identical throughout all of the sheet sizes.

For example, assume that the distance by which the belt 52 with the hook 52*a* moves from the HP sensor 311 to the roller pair 56 and 57 is L1, that the preselected pass distance is 5 mm, and that the distance by which the hook 52*a* moves from the HP sensor 311 to the trailing edge of a sheet being stacked is Lh. Then, the operation timing is determined by the distance Ln by which the hook 52*a* has moved from the HP sensor 311 and controlled in terms of the number of pulses. Assuming that the sheet length is Lp, then the distance Ln is produced by:

$$Ln=L1-Lh-Lp+5 \text{ mm}$$

Figure 24:
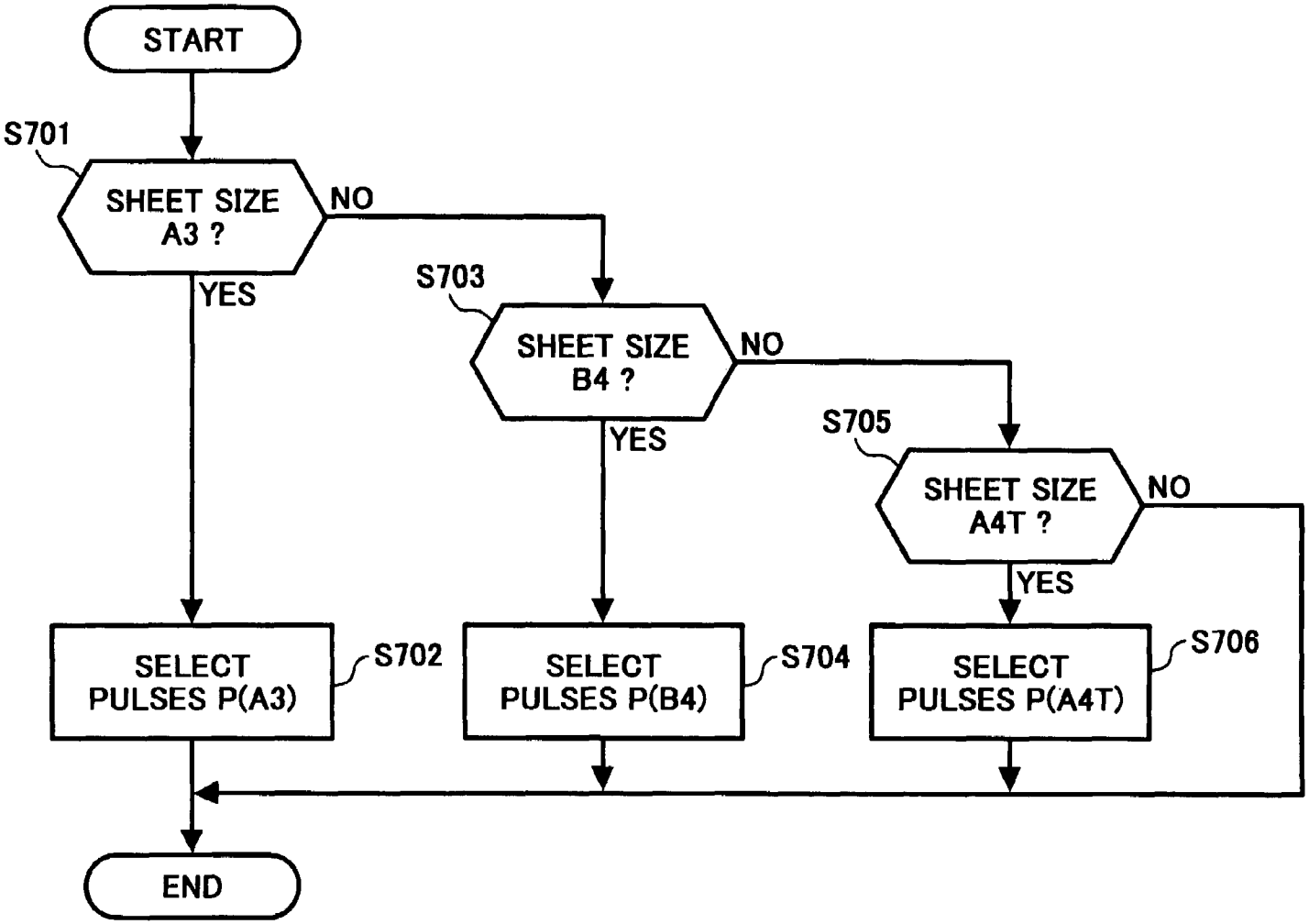
FIG. 24 is a flowchart demonstrating a procedure particular to the first embodiment and executed to determine a sheet size.
Figure 25A:
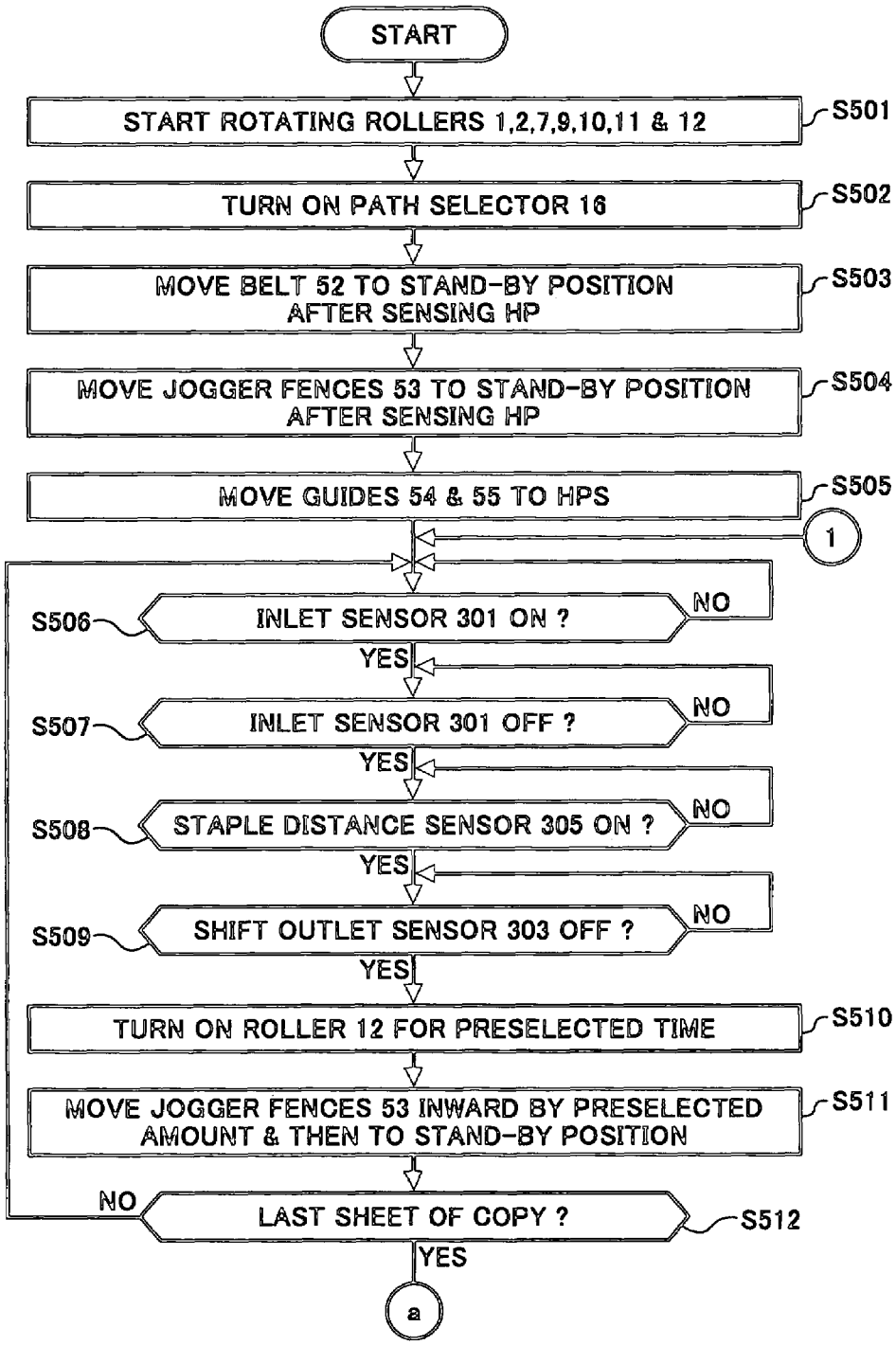
FIGS. 25A through 25D are flowcharts demonstrating a center staple and bind mode (with edge cutting) procedure particular to the first embodiment to a third embodiment.
Figure 25B:
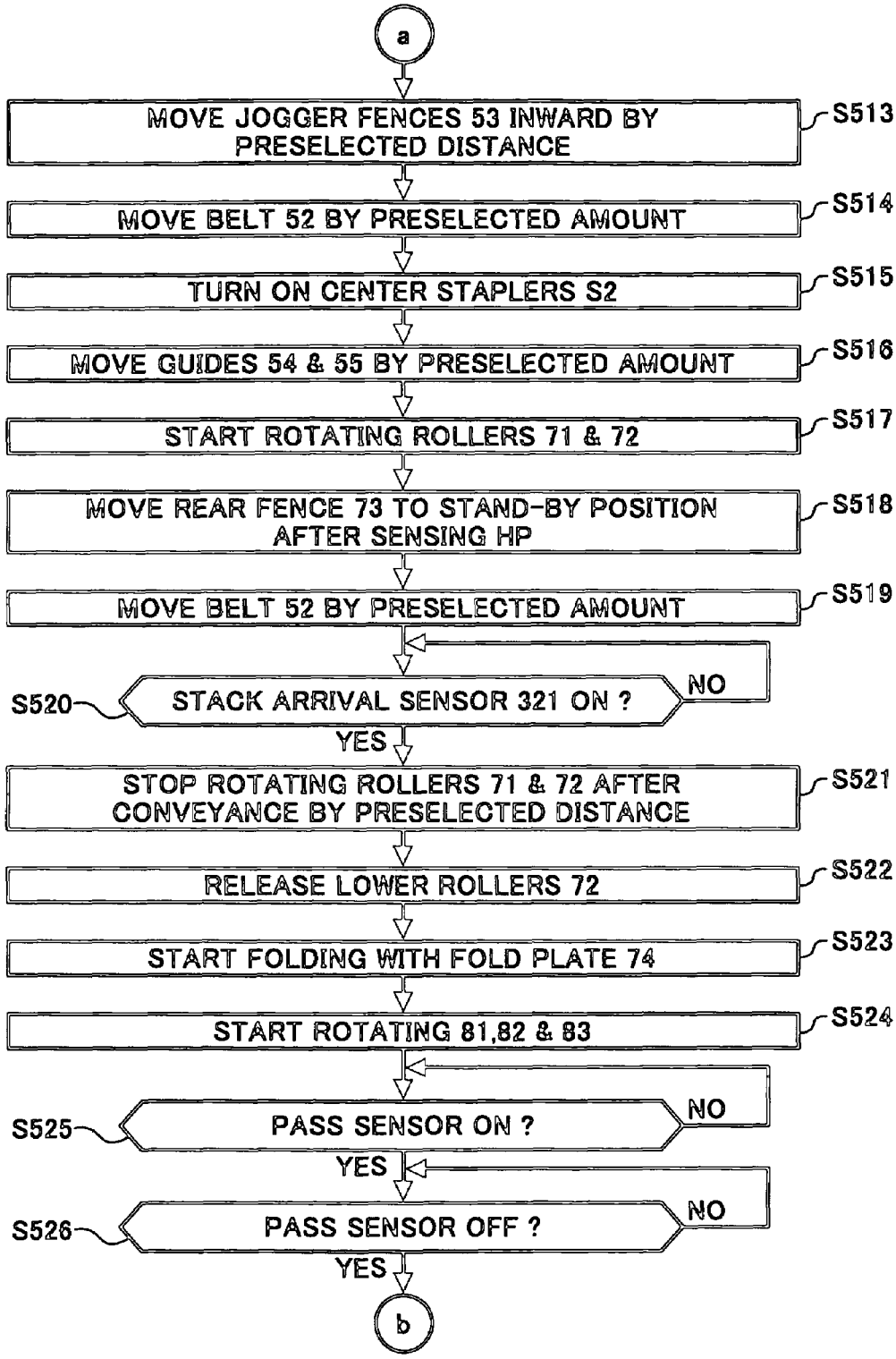
Figure 25C:
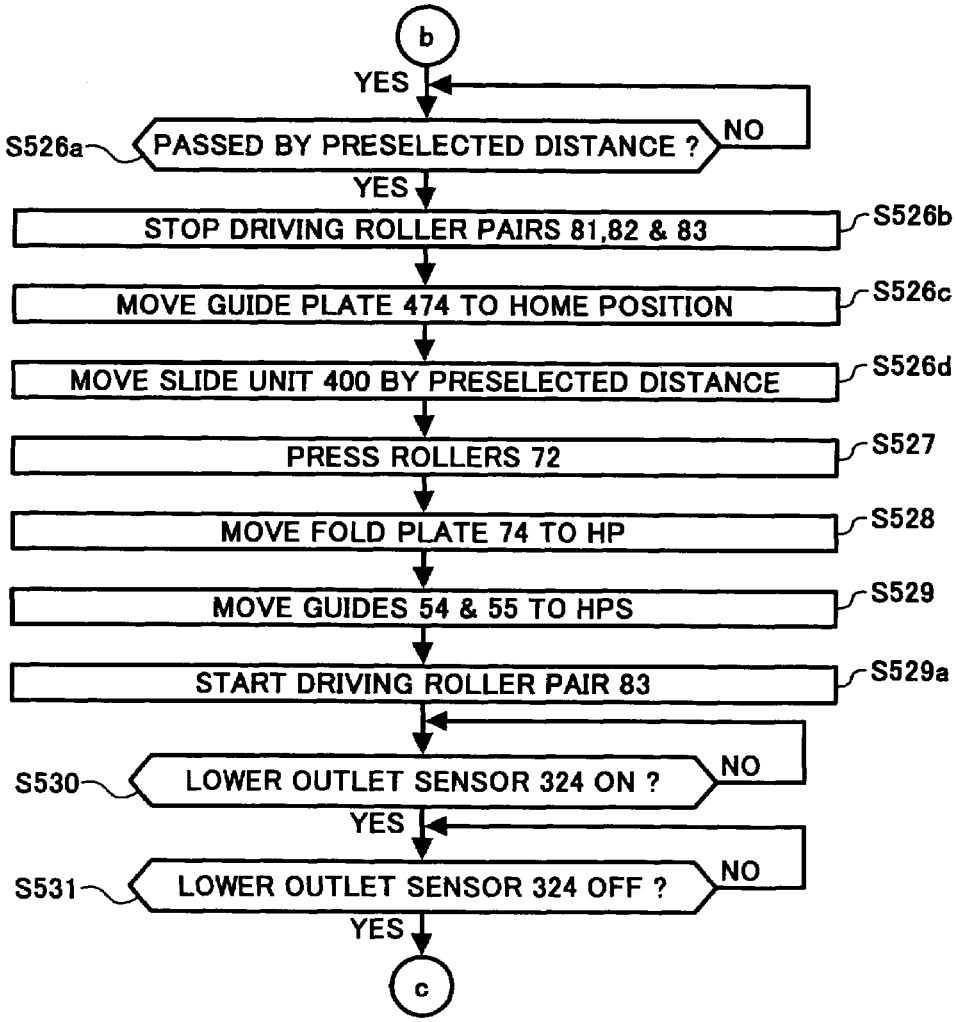
Figure 25D:
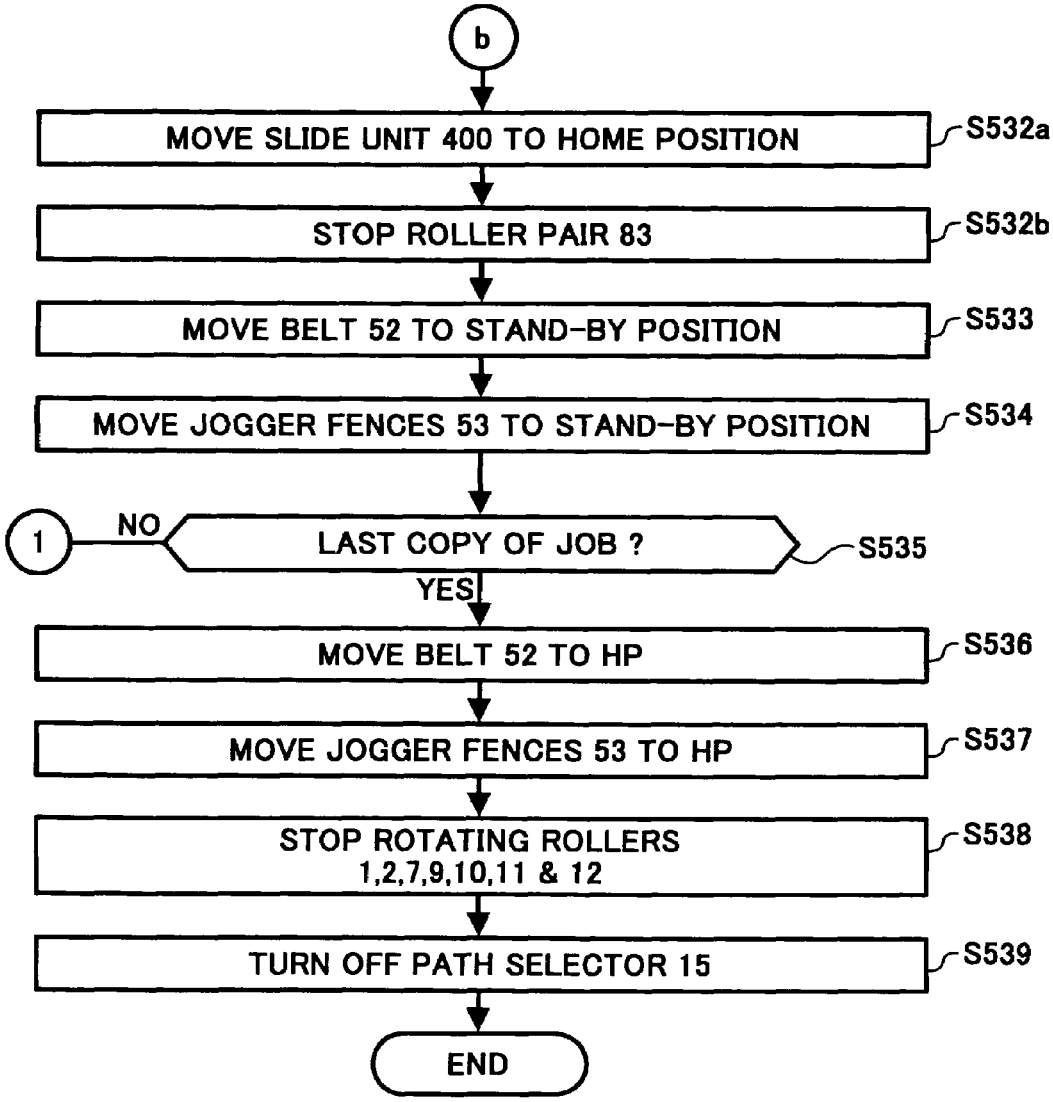

A particular number of pulses are assigned to each sheet size. As shown in FIG. 24, size checking steps S701, S703 and S705 and pulse setting steps S702, S704 and S706 are selectively executed in accordance with the sheet size, so that the press roller 57 can press a sheet at the same timing without regard to the sheet size.

While the illustrative embodiment executes control based on the output of the HP sensor 311, sensing means responsive to the leading edge of a sheet stack may be located in the vicinity of the roller pair 56 and 57. In such a case, the control can be executed without resorting to size information output from the image forming apparatus PR.

Figure 21:
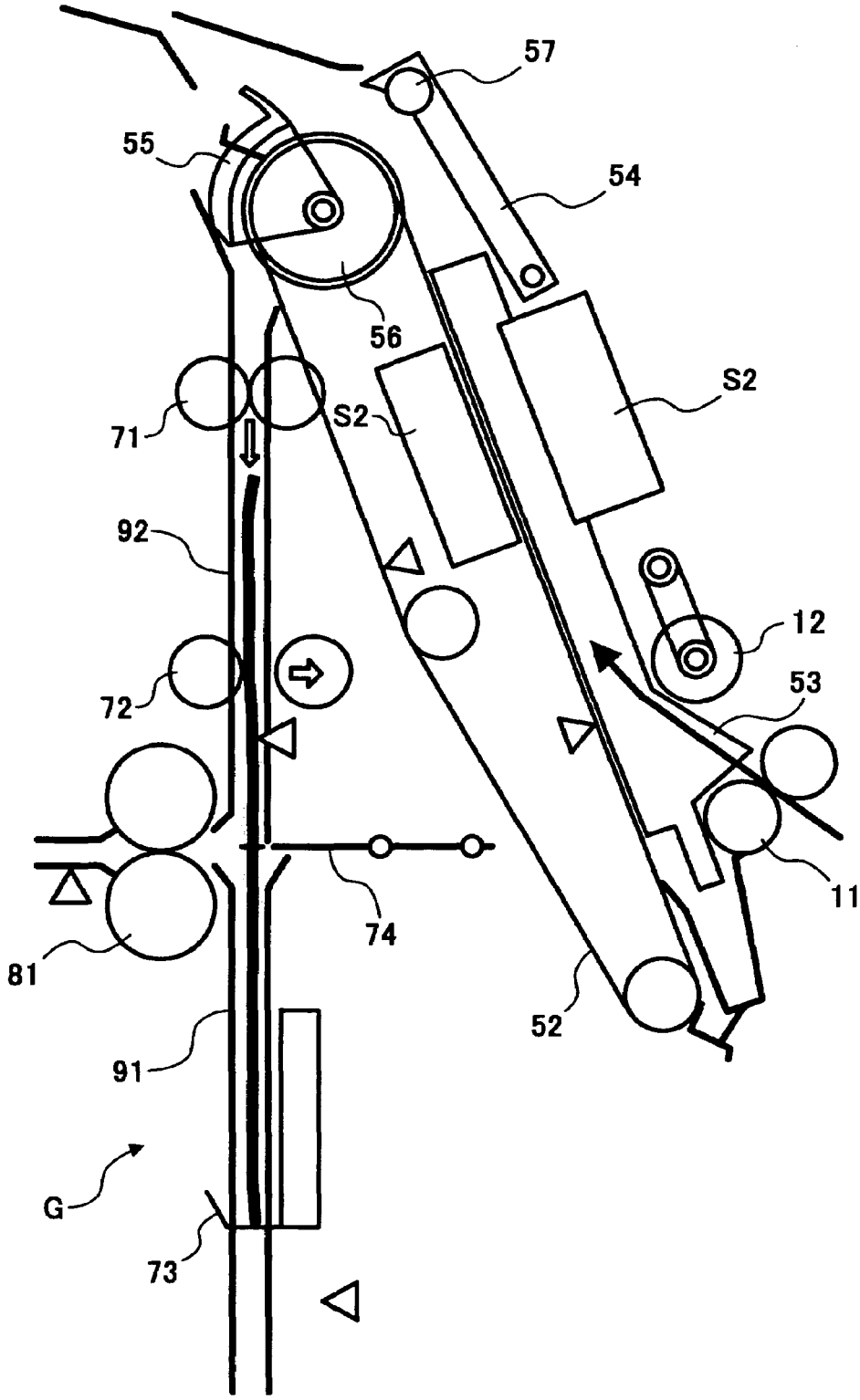
FIG. 21 shows a condition wherein the sheet stack stapled at the center is steered by the steering mechanism.

Subsequently, the sheet stack is nipped by the discharge roller 56 and press roller 57 and then conveyed by the hook 52*a* and discharge roller 56 to the downstream side such that it passes through the path formed between the guides 54 and 55 and extending to the fold tray G. The discharge roller 56 is mounted on the drive shaft 65 associated with the belt 52 and therefore driven in synchronism with the belt 52. Subsequently, as shown in FIG. 21, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52*a* on the belt 52 arrives at a position close to the rear fence 51, the hook 52*a* is brought to a stop while the guides 54 and 55 are returned to the home positions to wait for the next sheet stack.

Figure 22:
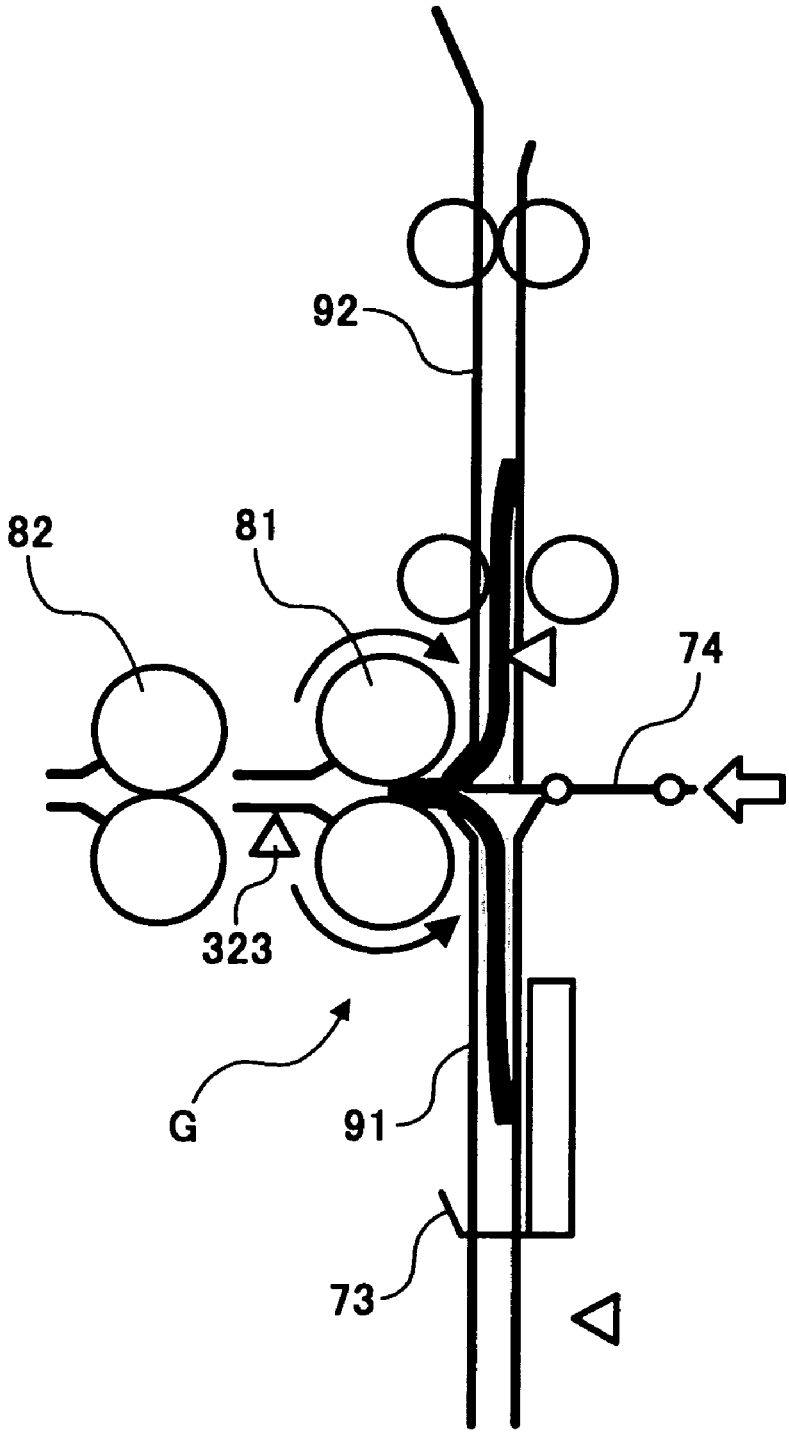
FIG. 22 shows a condition wherein the sheet stack stapled at the center and steered by the steering mechanism is brought to the fold tray.

The sheet stack abutted against the movable rear fence 73 is freed from the pressure of the lower roller pair 72. Subsequently, as shown in FIG. 22, the fold plate 74 pushes part of the sheet stack close to a staple toward the nip of the fold roller pair 81 substantially perpendicularly to the sheet stack. The fold roller pair 81, which is caused to rotate beforehand, conveys the sheet stack reached its nip while pressing it. As a result, the sheet stack is folded at its center.

The second fold roller pair 82 positioned on the path H makes the fold of the folded sheet stack more share. Thereafter, the lower outlet roller pair 83 conveys the sheet stack to the lower tray 203. When the trailing edge of the sheet stack is sensed by the pass sensor 323, the fold plate 74 and movable rear fence 73 are returned to their home positions. At the same time, the lower roller pair 72 is again brought into contact to prepare for the next sheet stack. If the next job is identical in sheet size and number of sheets with the above job, then the movable rear fence 73 maybe held at the standby position.

If an edge cut mode is selected, then after the pass sensor 323 has sensed the trailing edge of the sheet stack, the sheet stack is continuously conveyed over a preselected distance and then brought to a stop. At this instant, the outlet roller pair 83 nips the sheet stack for thereby holding it stationary. This stop position of the sheet stack is determined on the basis of the output of the pass sensor 323. Subsequently, the retraction guide plate 474 is moved to the retracted position, and then the slide unit 400 is moved to cut the edge of the sheet stack. The sheet stack is then driven out to the lower tray 203 by the roller pair 83. Thereafter, the slide unit 400 is returned to the home position. On the elapse of a preselected period of time or at the beginning of the next job, the retraction guide plate 474 is again moved to the advanced position.

The edge cut mode will be described more specifically with reference to FIGS. 25A through 25D. As shown, a step S522*a* is executed after the step S522 included in the non-cut mode operation described with reference to FIGS. 19A through 19C. Also, steps S526*a* through S526*d* are executed after the step S526 while a step S529*a* is executed after the step S529. Further, steps S532*a* and S532*b* are substituted for the step S532 following the step S531.

In the step S522*a*, after the pressure of the lower roller pair 72 has been canceled, the retraction guide plate 474 is moved to the advanced position indicated by a solid line in FIG. 1, allowing the fold plate 74 to fold the sheet stack. In the step S526*a*, the CPU 360 determines whether or not the trailing edge of the sheet stack has moved away from the pass sensor 323 by a preselected distance. If the answer of the step S526*a* is YES, then the CPU 360 causes the fold roller pairs 81 and 32 and lower outlet roller pair 83 to stop rotating (step S526*b*). Subsequently, the CPU 360 causes the retraction guide plate 474 to return to the home position P1, indicated by a phantom line in FIG. 1, where it is fully retracted from the movable range of the slider unit 400 (step S526*c*).

After the step S526*c*, the CPU 360 causes the slide unit 400 to move by a preselected distance and cut away the trailing edge portion of the sheet stack in the direction of sheet conveyance with the lower outlet roller pair 83 nipping the folded side of the stack (step S526*d*). In the step S529, the CPU 360 causes the guide plate 54 and movable guide 55 to move to their home positions and wait for the next sheet stack. Subsequently, the CPU 360 discharges the sheet stack to the lower tray 203 via the rotation of the lower roller pair 83 (step S529*a*). When the lower outlet sensor 324 turns off, the CPU 360 causes the slide unit 400 to return to the home position (step S532*a*). On the elapse of a preselected period of time in which the sheet stack is expected to be fully discharged, the CPU 360 causes the lower roller pair 83 to stop rotating (step S532*b*). The steps S501 through S539 are identical with the corresponding steps of FIGS. 19A through 19C and will not be described specifically.

Figure 26:
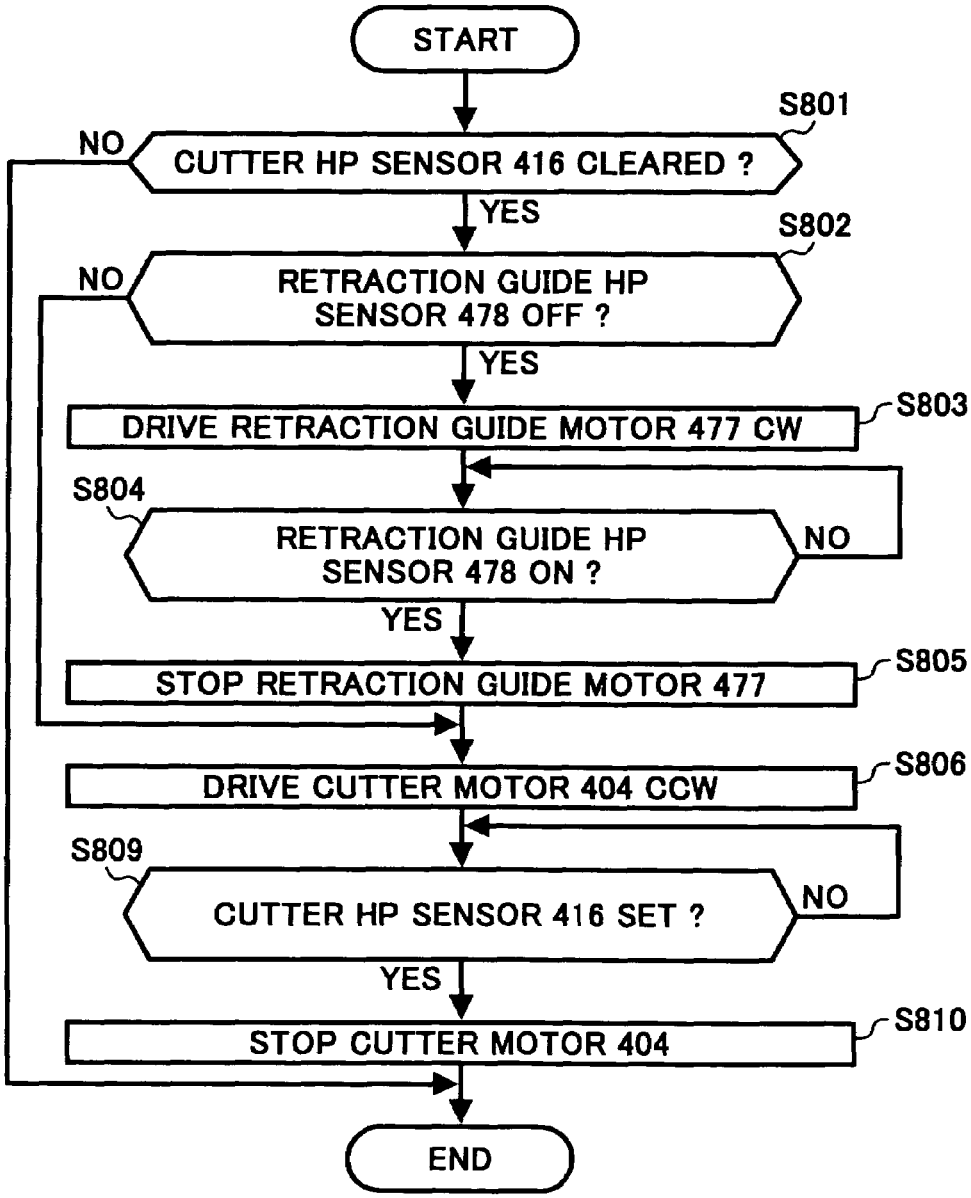
FIG. 26 is a flowchart demonstrating a procedure particular to the first and second embodiments and executed to initialize the cutter unit.

FIG. 26 demonstrates a procedure for initializing the cutter unit J. As shown, if the cutter HP sensor 416 is in an OFF state (YES, step 5801) and if the retraction guide HP sensor 478 is in an OFF state (YES, step S802), then the CPU 360 causes the retraction guide motor 477 to rotate clockwise (step S803). As soon as the retraction guide HP sensor 478 turns on (YES, step S804), meaning that the retraction guide plate 474 has reached the retracted position or home position, the CPU 360 turns off the retraction guide motor 477 (step 5805) and drives the cutter motor 404 counterclockwise (step S806). If the answer of the step S802 is NO, then the CPU 360 executes the step 5806, skipping the steps S803 through 5805. After the step S806, when the cutter HP sensor 416 turns on (YES, step S809), the CPU 360 turns off the cutter motor (step S810) to thereby locate the slide unit 400 at the initial position shown in FIG. 9.

Figure 27:
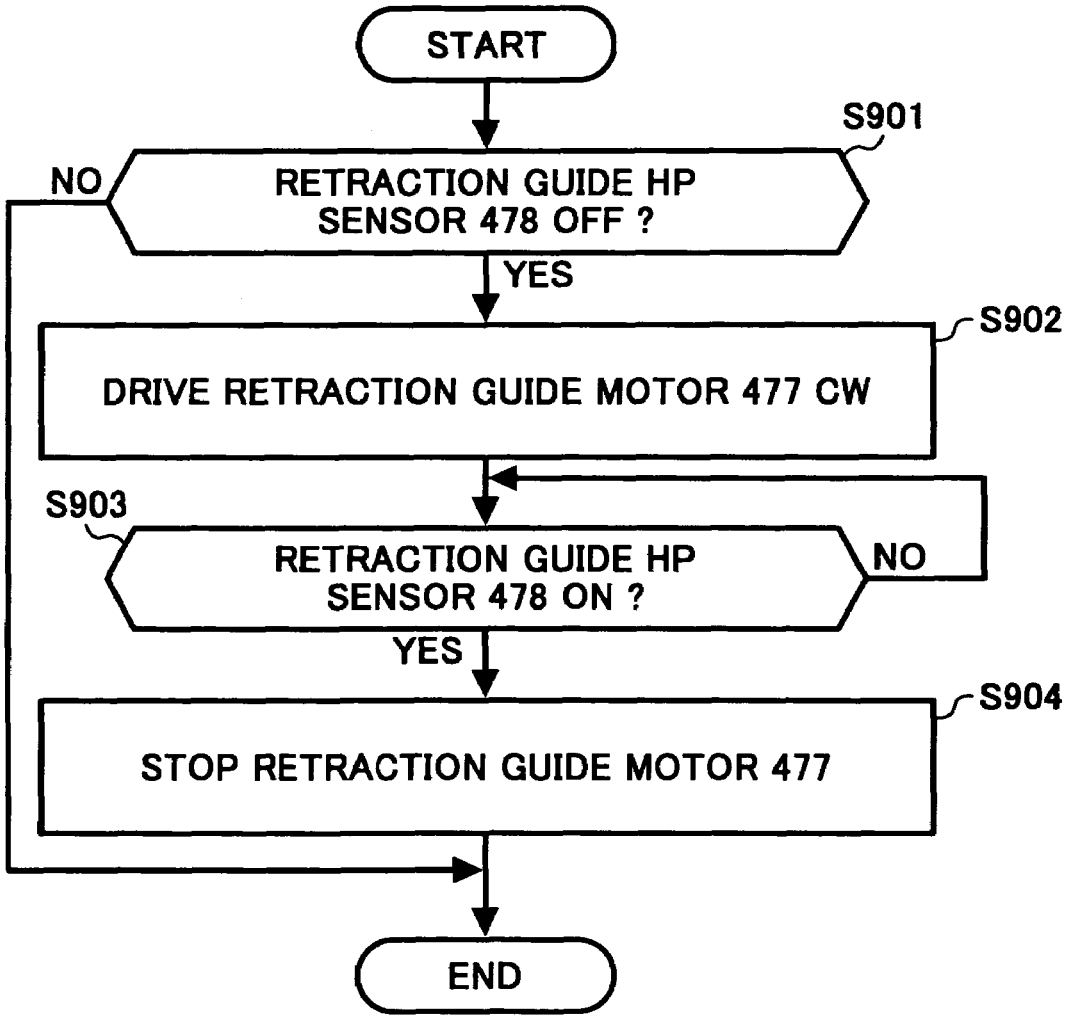
FIG. 27 is a flowchart demonstrating a procedure particular to the first and second embodiments and executed to initialize the retraction guide plate.

FIG. 27 demonstrates a procedure for initializing the retraction guide plate 474. As shown, if the retraction guide HP sensor 478 is in an OFF state (YES, step S901), then the CPU 360 drives the retraction guide motor 471 clockwise (step S902). Subsequently, when the retraction guide HP sensor 478 turns on (YES, step S903), the CPU 360 turns off the retraction guide motor 477 (step S904) for thereby locating the retraction guide plate 474 at the initial position shown in FIG. 11. If the answer of the step 5901 is NO, then the CPU 360 immediately ends the procedure of FIG. 27.

As stated above, the retraction guide plate 474 serves to guide a sheet stack during the folding and feeding operation. At the time of cutting, the guide plate 474 is retracted from the cutting position. The cutter unit J is therefore smaller in size than the conventional guillotine type of cutter unit and needs a minimum of torque, thereby contributing to power saving.

While the guillotine type of cutter divides a conveyance path by the thickness of a movable edge, the shuttle type of cutter divides it by the movable range of the slide unit 400 (sectional area) and is therefore disadvantageous from the conveyance quality standpoint. However, in the illustrative embodiment, the retraction guide plate 474 guarantees a conveyance path during conveyance and obviates defective conveyance and jam. The guide plate 474 is, of course, applicable even to the guillotine type of cutter, in which case the stroke of the guide plate 474 will naturally be reduced.

The guide plate 474 moves to the advanced position only for a minimum necessary period of time, allowing sheet scraps to be introduced into the hopper 479. Further, in the shuttle type of cutter, the rotary edge 401 remains in contact with the stationary edge 420 at all times, so that the opening of the hopper 479 surely remains open even during the return of the rotary edge 401 to the home position and insures the collection of the scraps. In addition, in the advanced position, the guide plate 474 overlaps the stationary edge 420 for thereby insuring the conveyance of a sheet stack.

As stated above, the illustrative embodiment has various unprecedented advantages, as enumerated below.

(1) The sheet finisher surely guides and cuts a sheet stack.

(2) The sheet finisher is smaller in size than the conventional sheet finisher including a guillotine type of cutter.

(3) At the time of conveyance of a sheet stack, the retraction guide plate advances to guarantee a conveyance path for thereby surely guiding the sheet stack.

(4) In a guillotine type of cutter, a movable edge needs a stroke and therefore a space in the up-and-down direction. By contrast, the cutter unit of the illustrative embodiment needs only a space corresponding to the height of the slide unit, so that the effective height of the cutting portion is reduced.

(5) The retraction guide plate has a size, as measured in the direction perpendicular to the direction of sheet conveyance, smaller than the dimension of the smallest sheet size to be dealt with in the above direction. The timing for causing the retraction guide plate to start moving and the timing for causing the rotary edge to start moving are matched to the above size of the guide plate. The cutter unit can therefore efficiently cut a sheet stack.

(6) The retraction guide plate is positioned at the advanced position only for a minimum necessary period of time, so that sheet scraps can be introduced into the hopper at all times except for such a short period of time. Further, the retraction guide plate overlaps the stationary edge and obviates defective cutting and jam.

Second Embodiment

This embodiment is a solution to the problems (2) and (3) stated earlier and mainly directed toward the sixth to eighth objects. The second embodiment is essentially similar to the first embodiment except for the following.

In the illustrative embodiment, the CPU 360 of the control unit 350 controls the cutting operation of the cutter unit J and the conveying operation of the fold roller pair 82 and lower outlet roller pair 83 as well. In the illustrative embodiment, the length of a sheet is determined on the basis of the duration of the ON state of the pass sensor 323 and conveying speed.

Figure 28:
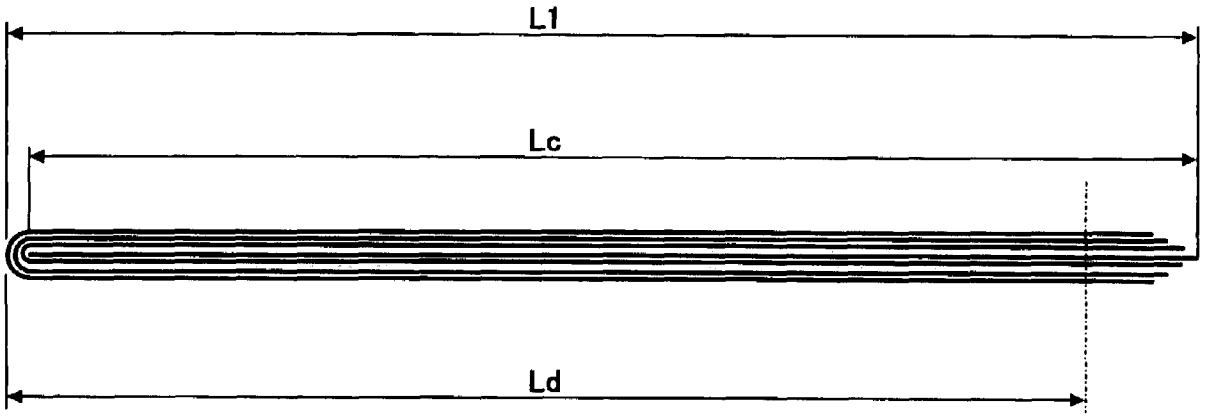
FIG. 28 shows a condition wherein the fold of a sheet stack is positioned at the center of the sheet stack.
Figure 29:
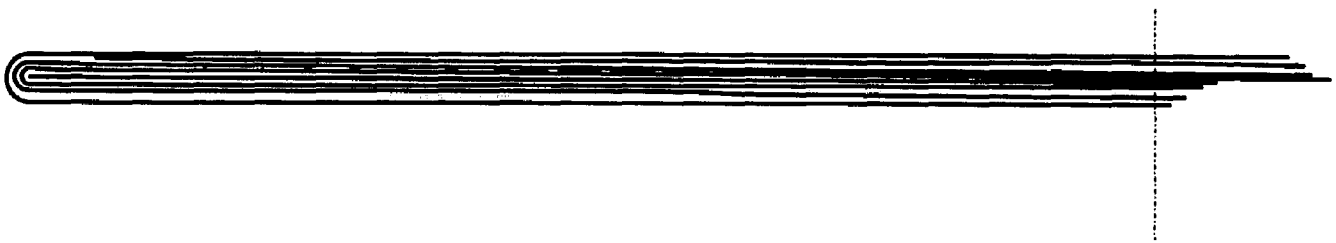
FIG. 29 shows a condition wherein the fold of a sheet stack is shifted from the center of the sheet stack.

Generally, a cut margin will be constant if a folded sheet stack is cut at a small length on the basis of a distance from the leading edge of the sheet stack. However, the constant cut margin is not achievable unless the sheet stack is accurately folded at the center. Stated another way, if the fold of the sheet stack is shifted from the center, then it is likely that a cut margin is lost. More specifically, as shown in FIG. 28, assume that a sheet stack is folded at the center, and that the length of the folded sheet stack is L1. Then, the length Lc of the sheet stack before folding is L/2 while the length Lc is smaller than the length L1. By contrast, as shown in FIG. 29, when the fold of the sheet stack is shifted from the center, the remaining margin is smaller than in the condition of FIG. 28 because the length Ld at which the sheet stack should be cut is determined beforehand. In the worst case, the remaining margin is practically lost. Further, if the fold is shifted from the center, then the sheet stack cannot be cut at a desired width.

Figure 30:
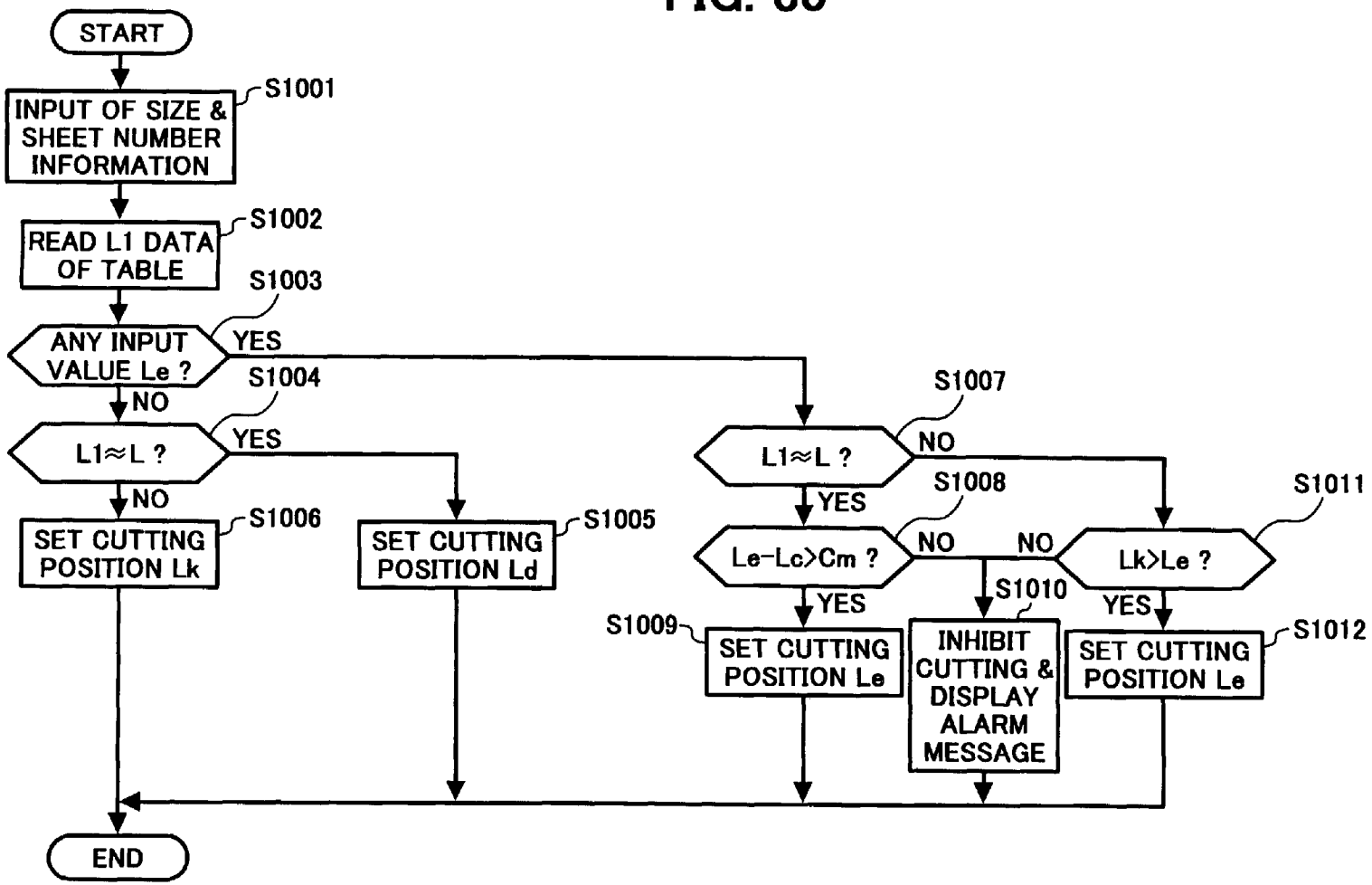
FIG. 30 is a flowchart demonstrating a procedure to be executed by the second embodiment for determining a cutting position.

FIG. 30 shows a cutting position decision procedure unique to the illustrative embodiment. As shown, size information and information representative of the number of sheets to be stapled together are input (step 51001). Subsequently, the CPU 360 scans a table shown in FIG. 31 so as to find a matching set value L1 (step S1002) and then determines whether or not a desired cutting length Le has been input (step S1003). If the answer of the step 51003 is NO, meaning that a default length Ld is to be used, then the CPU 360 compares a sheet length sensed by the pass sensor 323 with the set value L1 (step S1004). As shown in FIG. 28, the set value L1 is selected to be slightly larger than the actual length of a sheet stack in consideration of the amount of a wedge-like shift appearing at the edge of a folded sheet stack. The set value L1 therefore increases little by little in accordance with the number of sheets to be stapled together.

If the values L1 and L are noticeably different from each other (NO, step S1004), then the CPU 360 determines that the fold of the sheet stack is shifted from the center. If the values L1 and L are nearly equal to each other, then the CPU 360 determines that the fold of the shift stack is positioned substantially at the center, and delivers the sheet stack to the cutting portion such that the sheet width will have a system default value Ld (step S1005). It is to be noted that the system default value Ld guarantees a sufficient cut margin Ca of about 5 mm if the sheets stack is folded at the center. When the answer of the step S1004 is NO, then the CPU 360 feeds the sheet stack to a position where the following equation holds (step S1006):

$$Lk=L-\{2(L-Lc)+Cm\}$$

where L denotes the sensed length, Lc denotes the ideal length (one-half of the sheet length before folding), and Cm denotes the minimum cut margin (about 3 mm). The sheet stack is then cut. The CPU 360 performs the above decision with the first copy of a job.

If the answer of the step 51003 is YES, meaning that a desired value different from the default value Ld is input on, e.g., the operation panel of the image forming apparatus PR, then the CPU 360 compares the length L sensed by the pass sensor 323 with the set value L1 (step S1 007). If the two values L and L1 are noticeably different from each other, then the CPU 360 determines that the fold of the sheet stack is not positioned at the center of the entire length. If the answer of the step 51007 is YES, i.e., if the fold is located substantially at the center, then the CPU 360 subtracts the length Lc (one-half of the length before folding) from the input value Le and then determines whether or not the minimum cut margin Cm is obtainable (step S1008). If the answer of the step S1008 is YES, then the CPU 360 feeds the sheet stack to the cutting position such that it is cut at the desired value Le (step S1009). If the answer of the step 51008 is N0, then the CPU 360 inhibits cutting and interrupts a job to follow while displaying an alarm message (step 51010).

If the answer of the step S1007 is NO, then the CPU 360 calculates a length Lk by using the previously stated equation and compares the length Lk with the input value Le (step S1011). If the length Lk is greater than the length Le (YES, step 51011), then the CPU 360 feeds the sheet stack to a position where it will be cut at the length Le (step S1012), and then cuts it. If the answer of the step S1011 is N0, then the CPU 360 inhibits cutting and interrupts a job to follow while displaying an alarm message (step S1010).

With the above procedure, it is possible to guarantee a cut margin even when the fold of a sheet stack is shifted from the center or not neatly stapled. Further, even when the dimension input by the user is unable to guarantee a cut margin, it is possible to determine, based on the actual condition of a sheet stack, whether or not the sheet stack can be cut and therefore to accept the user's intention as far as possible while obviating troubles ascribable to the loss of the minimum cut margin. In addition, by performing the above decision with the first copy of a job, sheet stacks dealt with by a single job are provided with the same size.

Figure 32:
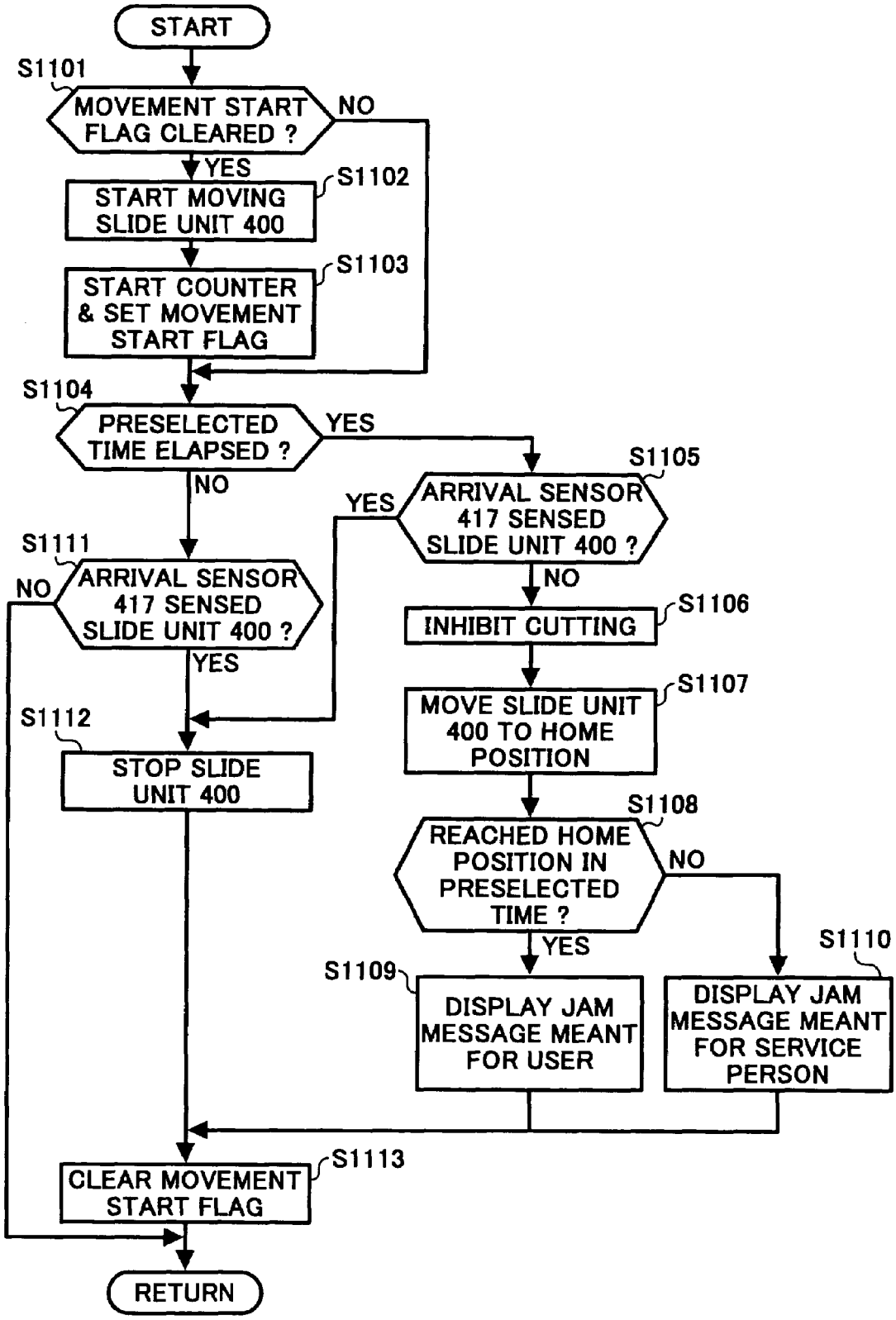
FIG. 32 is a procedure to be executed by the second embodiment for detecting an error.

FIG. 32 demonstrates a procedure for dealing with an error occurred in the cutter unit J. After the first fold roller pair 81 has folded a sheet stack, the second fold roller pair 82 makes the fold of the folded sheet stack more sharp, as described with reference to FIG. 22. Thereafter, the lower outlet roller pair 83 conveys the sheet stack to the lower tray 203. When the trailing edge of the sheet stack is sensed by the pass sensor 323, the fold plate 74 and movable rear fence 73 are returned to their home positions. At the same time, the lower roller pair 72 is again brought into contact to prepare for the next sheet stack. If the next job is identical in sheet size and number of sheets with the above job, then the movable rear fence 73 maybe held at the stand-by position.

Again, if the edge cut mode is selected, then after the pass sensor 323 has sensed the trailing edge of the sheet stack, the sheet stack is continuously conveyed over the preselected distance and then brought to a stop. At this instant, the outlet roller pair 83 nips the sheet stack for thereby holding it stationary. Subsequently, the retraction guide plate 474 is moved to the retracted position, and then the slide unit 400 is moved to cut off the edge of the sheet stack.

As shown in FIG. 32, as for the movement of the slide unit 400, the CPU 360 determines whether or not a movement start flag F is cleared (step S1101). If the answer of the step S1101 is YES, meaning that the slide unit 400 is not moved, the CPU 360 causes the slide unit 400 to move (step S1102) while starting a counter for counting the duration of movement. The CPU 360 then. sets the movement start flag (step S1103). Assume that when the counter reaches a period of time long enough for the slide unit 400 to move the distance L, FIG. 9, (step S1104), the slide unit 400 is not sensed by the arrival sensor 417 (N0, step 51105). Then, the CPU 360 determines that the slide unit 400 stopped moving halfway and determines, if a job to follow exists, that cutting should be inhibited (step 51106). Subsequently, the CPU 360 causes the slide unit 400 to return to the home position (step 51107). If the slide unit 400 is sensed at the home position within a preselected period of time (YES, step 51108), then the CPU 360 determines that a jam capable of being dealt with by the user has occurred, stops the system, and displays a jam message for urging the user to remove the jam (step 51109). At this instant, the CPU 360 may also display a message for urging the user to decide whether or not to continue the next job without cutting.

If the answer of the step 51105 is YES, meaning that the movement of the slide unit 400 has successfully ended, the CPU 360 causes the slide unit 400 to stop moving (step S1112), clears the movement start flag F (step S1113), and then returns. As a result, the sheet stack is discharged to the lower tray 203 by the roller pair 83. After the conveyance of the sheet stack, the slide unit 400 is returned to the home position. Subsequently, on the elapse of the preselected period of time or at the beginning of the next job, the retraction guide plate is moved to the advanced or conveyance position.

On the other hand, if the answer of the step S1108 is NO, then the CPU 360 determines that the slide unit 400 has stopped moving on the conveyance path. In this case, the slide unit 400 has nipped the sheet stack and therefore does not allow the jam to be dealt with unless the slide unit 400 is retracted. However, this kind of jam should preferably be dealt with by a service person because the slide unit 400 includes sharp cutting edges. The CPU 360 therefore displays a message for urging the user to contact a service person (step 51110).

If the answer of the step S1104 is NO, then the CPU 360 determines whether or not the arrival sensor 417 has sensed the slide unit 400 (step S1111), and returns if the answer of the step 51111 is NO. If the answer of the step S1111 is YES, then the CPU 360 causes the slide unit 417 to stop moving (step S1112), clears the movement start flag F (step 51113), and then returns.

As the illustrative embodiment indicates, when a slide unit included in a shuttle type of cutter stops moving during cutting, it stays on the conveyance path and brings about a serious trouble due to consecutive sheet stacks if not sensed immediately. In light of this, the CPU 360 uses the output of the arrival sensor 147 and the interval corresponding to the distance between the home position and the destination of the slide unit 400, thereby surely, rapidly detecting the above jam.

Further, even if the error is detected, a decrease in productivity due to a long system down time or the loss of business chances cannot be avoided without resorting to recovering means. In a shuttle type of cutter, a slide unit, in many cases, stops halfway when its cutting ability yields to the object to be cut. This, in many cases, occurs just after the start of cutting movement and can be coped with by returning the slide unit. In this sense, automatically homing the slide unit 400 promotes the efficient removal of a sheet stack that the slide unit 400 has failed to fully cut.

Generally, a movable unit may be provided with a knob so as to allow the user to home the movable unit. However, the knob scheme is not desirable because it is difficult to show the user the direction and amount of movement to be effected by hand as well as a force to be exerted. Further, when the movable unit is fully locked, it is apt to damage even surrounding members if handled with a strong force. In addition, the knob increases the cost of the movable unit. The illustrative embodiment distinguishes an error that can be dealt with by the user and an error that cannot be done so, thereby minimizing the down time of the system. Moreover, by interrupting a job to follow, it is possible to safely end the job underway and to prevent the same error from repeatedly occurring.

As stated above, the illustrative embodiment has various unprecedented advantages, as enumerated below.

(1) Whether or not an error has occurred is determined on the basis of the output of the error sensing means, so that an error can be efficiently detected.

(2) When an error is detected, the movable edge is returned to its home position with or without an error message that urges the user to deal with a jam being displayed. The user can therefore see the condition of the cutting means and deal with, if possible, the error.

(3) When the movable edge fails to return to the home position, a message showing that the error should not be dealt with by the user is displayed. In addition, a job to follow is inhibited to thereby reduce the down time of the system.

(4) A cut margin is insured even if a sheet or a sheet stack is not folded at the center or a sheet stack is not neatly stapled.

(5) Even when the user inputs a size that cannot guarantee a cut margin, whether or not cutting is allowable effected is determined on the basis of the actual condition of a sheet stack. It is therefore possible to accept the user's intention as far as possible while obviating troubles ascribable to a short cut margin.

(6) Copies to be produced by a single job are provided with the same size because decision is made with the first copy of the job.

Third Embodiment

This embodiment is a solution to the problem (4) stated earlier and mainly directed toward the ninth and tenth objects. This embodiment is also practicable with the configurations and operations described with reference to FIGS. 1 through 12, 14 through 22 and 24. The following description will therefore concentrate on differences between the first embodiment and the illustrative embodiment.

In the illustrative embodiment, after a sheet stack has been brought to a stop at the preselected position, the slide unit 400 cuts the sheet stack by moving from the position of the cutter HP sensor 416 over a distance that exceeds the size of the sheet stack. More specifically, as shown in FIG. 9, the slide unit 400 moves to a position close to, but short of, one edge of a sheet stack at a speed V1, moves over a preselected distance at a speed v2, and then moves to a position close to, but short of, the other edge of the sheet stack at a speed V3. Subsequently, the slide unit 400 moves over a preselected distance at a speed V, moves over a preselected distance at a velocity V, and then stops. After the sheet stack thus cut by the slide unit 400 has been driven away from the slide unit 400, the slide unit 400 returns to the position of the cutter HP sensor 416 at a speed V5.

The speeds mentioned above are related as follows:

$$V1 \geqq V2$$

$$V2, V4 < V3$$

$$V5 > V3$$

FIG. 13 shows a procedure for initializing the cutter unit J particular to the illustrative embodiment. As shown, if the cutter HP sensor 416 is in an OFF state (YES, step S1201), then the CPU 360 drives the cutter motor 404 counterclockwise until the cutter HP sensor 404 turns on (steps 51202, 51203 and S1204), thereby returning the cutter unit J to the home position. If the answer of the step 51201 is NO, then the CPU 360 ends the procedure immediately.

As stated above, in the illustrative embodiment, the cutter unit J starts cutting a sheet stack at a low speed so as to obviate a noticeable change in load at the initial stage of cutting, so that the driveline can be relatively freely configured. In addition, because a force tending to shift the sheet stack is reduced, there can be obviated the shift and scratches of the sheet stack. After the initial stage, the cutter unit J moves at higher speeds so as to prevent productivity from being lowered.

Fourth Embodiment

This embodiment is a solution to the problem (5) stated earlier and mainly directed toward the eleventh object. This embodiment is also practicable with the configurations and operations described with reference to FIGS. 1 through 12 and 14 through 22. The following description will therefore concentrate on differences between the foregoing embodiments and the illustrative embodiment.

Figure 34:
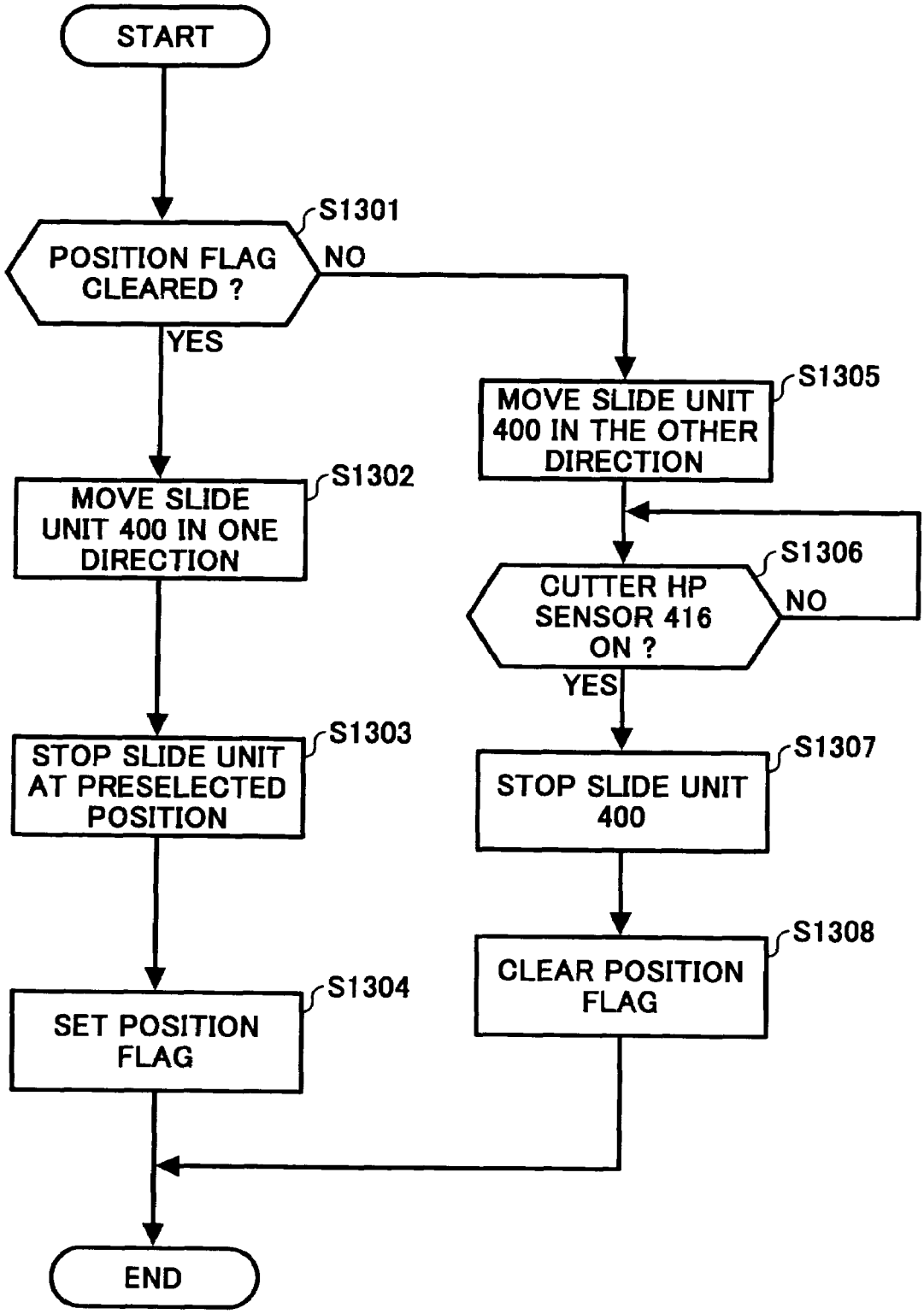
FIG. 34 is a flowchart demonstrating a procedure to be executed by a fourth embodiment of the present invention for causing a slide unit to cut consecutive sheet stacks in opposite directions alternately.

In the illustrative embodiment, too, when a sheet stack is brought to a stop at the adequate cutting position, the cutter motor 404 is driven to move the slide unit 400 for thereby cutting the sheet stack. More specifically, as shown in FIG. 34, the CPU 360 determines whether or not a slide unit position flag is cleared (step S1301). If the answer of the step 51301 is YES, then the CPU 360 determines that the slide unit 400 is located at the home position side, and then causes the slide unit 400 to move for cutting the sheet stack (step S1302). After the slide unit 400 has fully cut the sheet stack, the CPU 360 causes the slide unit 400 to stop at a preselected position farther than the maximum sheet width, as seen from the home position (step S1303). At the same time, the CPU 360 sets the slide unit position flag (step 51304).

If the answer of the step 51301 is NO, then the CPU 360 causes the slide unit 400 to move in the direction opposite to the direction mentioned above (step 51305) while cutting the sheet stack. As soon as the cutter HP sensor 416 senses the slide unit 400 (step S1306), the CPU 360 causes the slide unit 400 to stop moving (step 51307) and then clears the slide unit position flag (step 51308).

Figure 35:
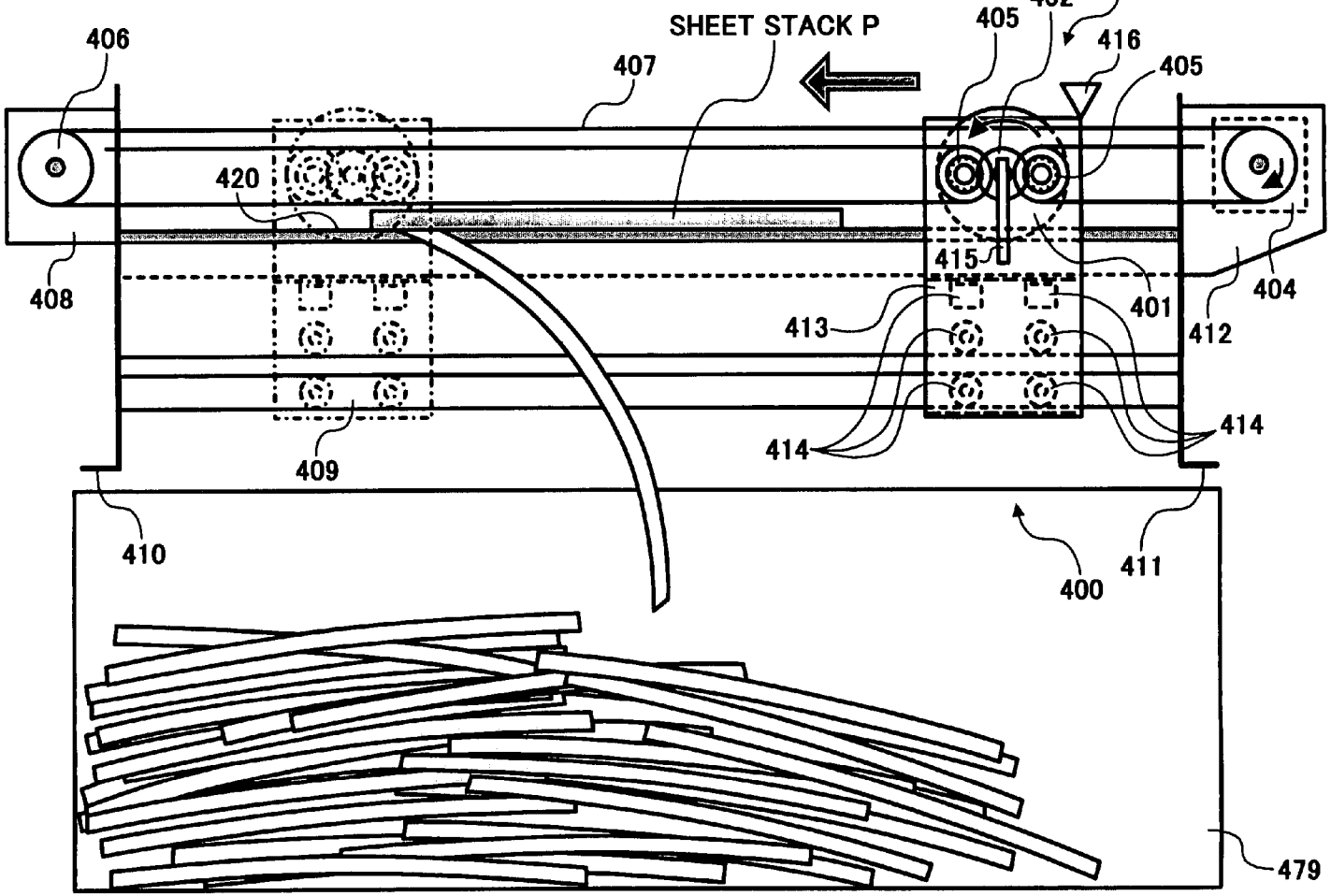
FIG. 35 is a front view showing how sheet scraps are piled up if the cutter unit of the fourth embodiment does not cut sheet stacks in opposite directions alternately.

As stated above, until the power supply of the entire apparatus has been reset, the cutter unit 400 repeatedly cuts consecutive sheet stacks in opposite directions alternately without regard to whether jobs are continuous or not. This prevents sheet scraps from being locally piled up in the hopper 479, as shown in FIG. 35.

Figure 33:
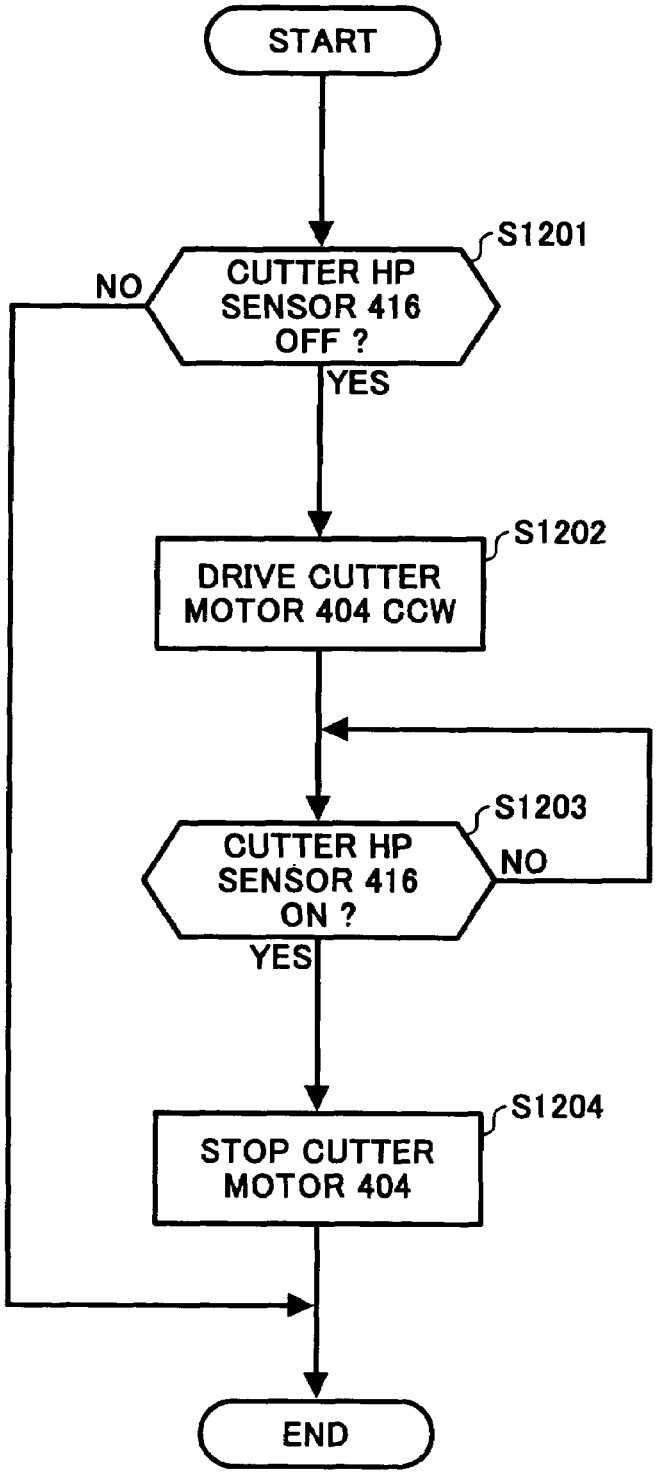
FIG. 33 is a flowchart to be executed by the third embodiment for initializing the cutter unit.

As shown in FIG. 33, in the event of initialization, the slide unit 400 is not moved if the cutter HP sensor 416 is in an ON state (step 51201) If the cutter HP sensor 416 is in an OFF state, then the cutter motor is driven counterclockwise until the cutter HP sensor 416 turns on (steps S1202 and 51203), and then stopped (step S1204). The slide unit 400 is therefore brought to its home position without regard to the slide unit position flag.

Figure 36:
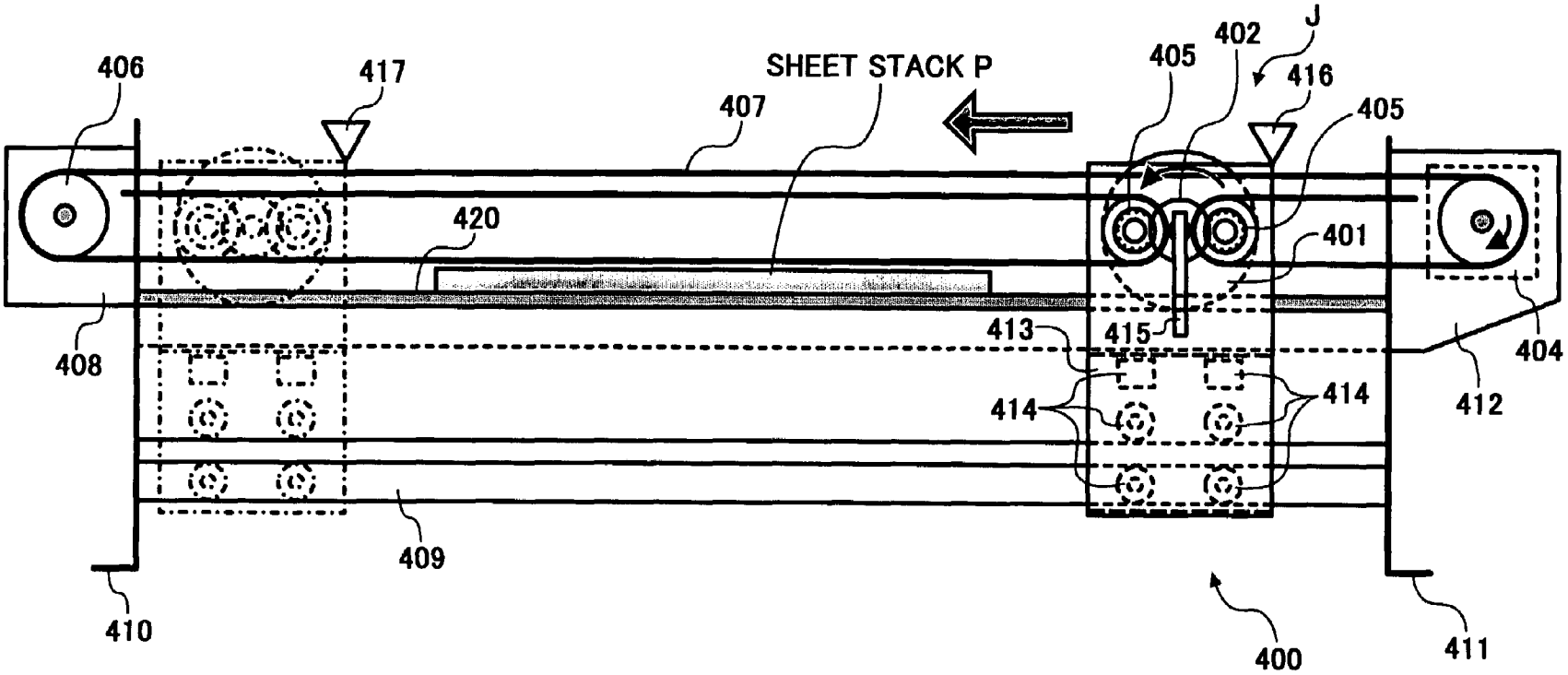
FIG. 36 is a front view showing a modification of the cutter unit of the fourth embodiment.
Figure 37:
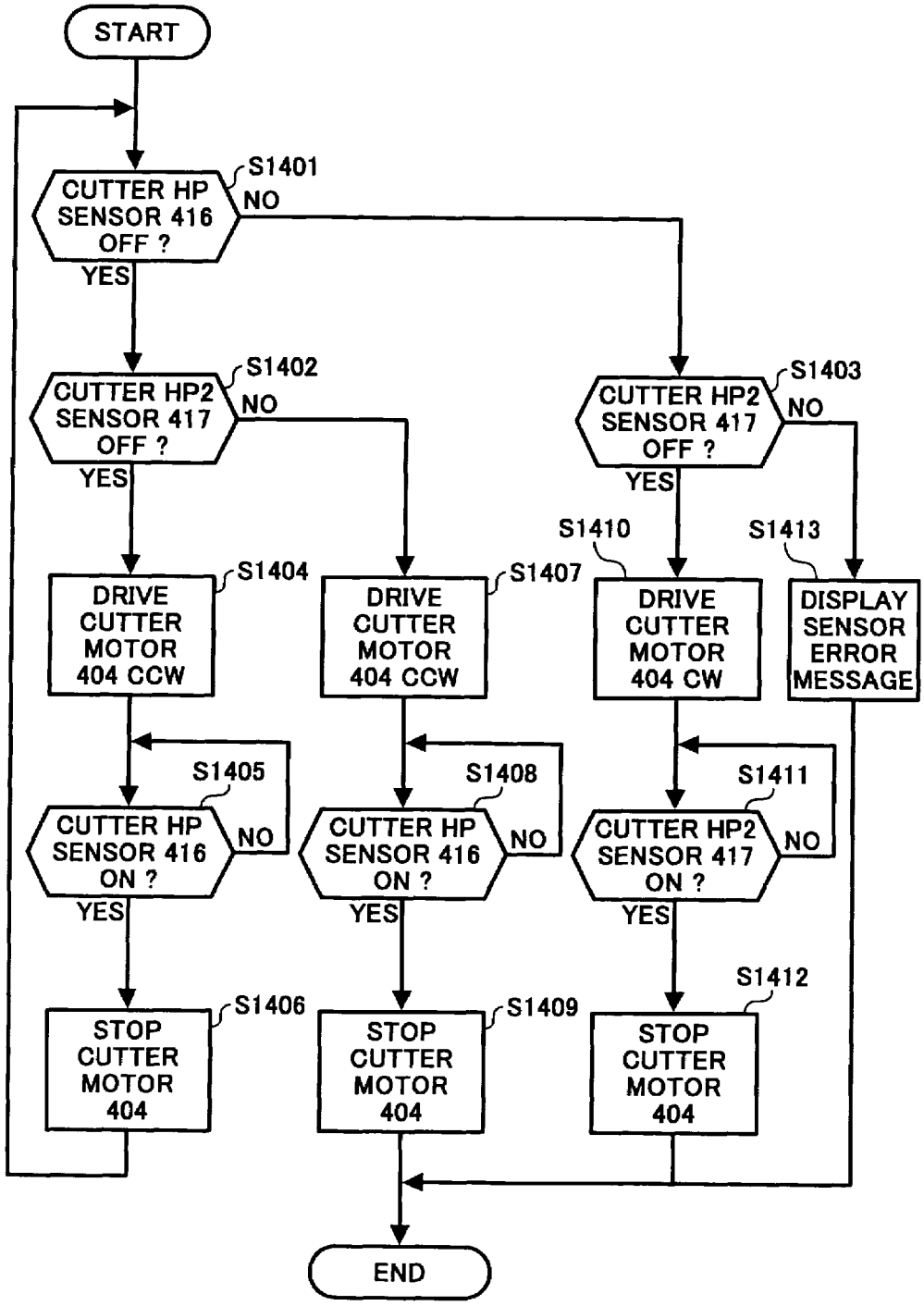
FIG. 37 is a flowchart demonstrating the operation of the slide unit to occur in the modification of FIG. 36.

A modification of the illustrative embodiment will be described with reference to FIG. 36. As shown, the modification includes a second cutter HP sensor (cutter HP2 sensor hereinafter) 417 in addition to the configuration shown in FIG. 9. The cutter HP2 sensor 417 is located at the opposite side of the cutting width to the cutter HP sensor 416. The operation of the modification is shown in FIG. 37. As shown, when a sheet stack is brought to a stop at the adequate cutting position, the cutter motor 404 is driven to move the slide unit 400 for thereby cutting the sheet stack. More specifically, the CPU 360 checks the ON/OFF states of the cutter HP sensors 416 and 417 in order to see the position of the slide unit 400 (steps S1401, S1402 and S1403). The CPU 360 then causes the slide unit 400 to move from the position of the sensor sensed the slide unit 400 toward the sensor not sensed it for thereby cutting the sheet stack (steps S1404 through S1412).

In the event of initialization, the CPU 360 determines whether or not either one of the cutter HP sensor 416 and cutter HP2 sensor 417 is sensing the cutter unit 400. If the answer of this decision is positive, then the CPU 360 causes the cutter unit 400 to start cutting the sheet stack at the position of the sensor sensing it. If neither one of the sensors 416 and 417 is sensing the slide unit 400, then the CPU 360 displays an error message (step S1413) while homing the slide unit 400 by using the sensor 416. With this procedure, it is possible to sense the position of the cutter unit even when, e.g., power supply to the system is interrupted for the energy saving purpose. This further promotes sure cutting in opposite directions.

Figure 38:
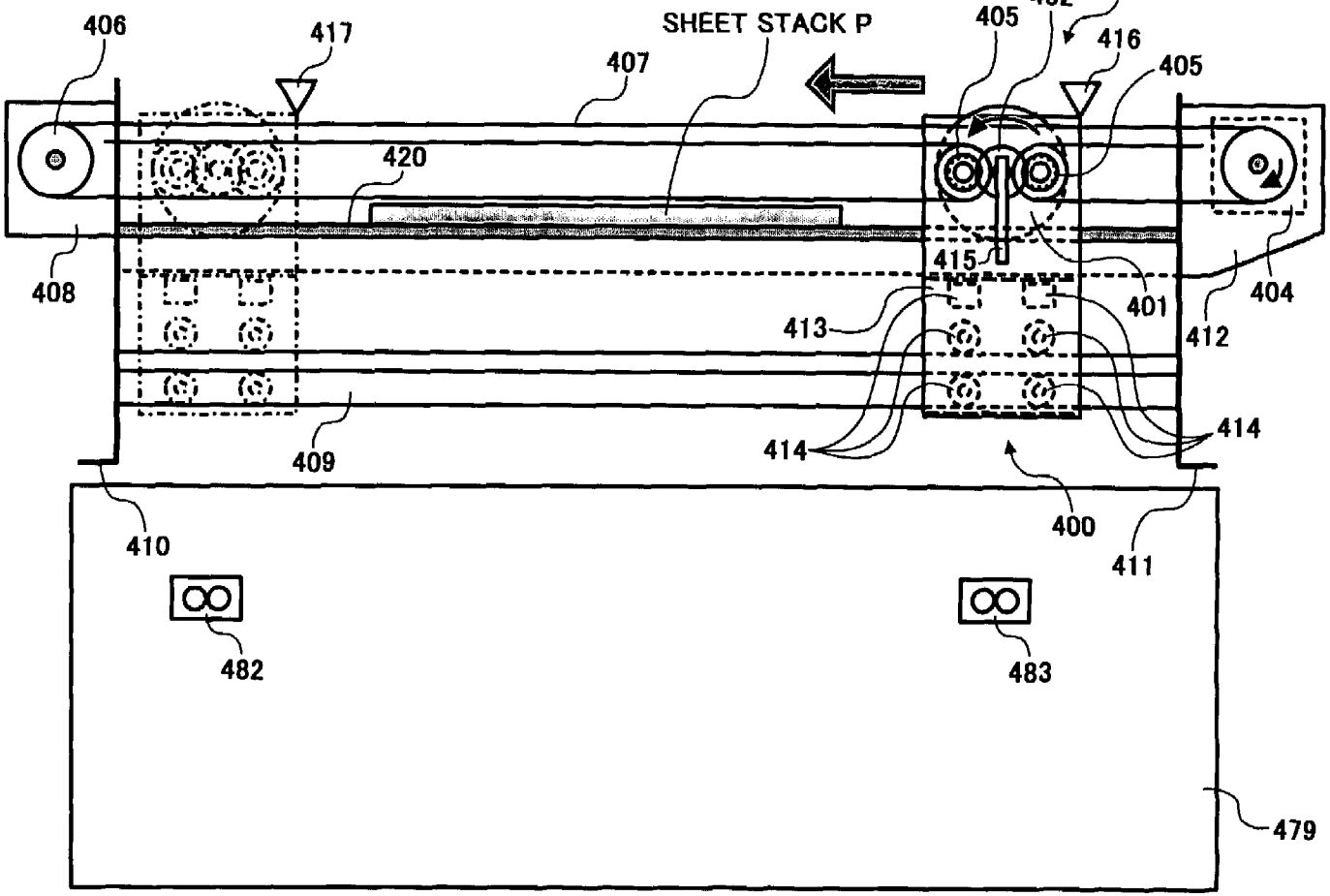
FIG. 38 is a front view showing another modification of the fourth embodiment.

FIG. 38 shows another modification of the illustrative embodiment. As shown, the modification includes a front and a rear scrap sensor 482 and 483 in addition to the configuration of FIG. 9 or 36. The front and rear scrap sensors 482 and 483 constitute means for sensing the localized piling of sheet scraps in the hopper 479. In operation, the CPU 360 first determines whether or not the front and rear scrap sensors 482 and 483 are sensing scraps. If neither one of the sensors 482 and 483 is sensing scraps, then the CPU 360 causes the slide unit 400 to cut a sheet stack in the direction selected by the procedure stated earlier. However, if only the front scrap sensor 482 is sensing scraps, then the CPU 360 determines that scraps are localized in the front portion of the hopper 479, and then causes the slide unit 400 to cut the sheet stack from the front toward the rear (opposite to a direction indicated by an arrow in FIG. 38). Likewise, if only the scrap sensor 483 is sensing scraps, then the CPU 360 causes the slide unit 400 to move from the rear toward the front, as indicated by the arrow in FIG. 38. With such a procedure, it is possible to level scraps piled up in the hopper 479.

In the illustrative embodiment, the center fold mode with edge cutting is executed in the same manner as described with reference to FIG. 25 except that the step S532*a* is omitted.

As stated above, the illustrative embodiments realizes a sheet finisher with a shuttle type of cutter capable of accommodating a large amount of sheet scraps without resorting to a large-capacity hopper.

Various modifications will become possible for those skilled in the art after receiving the teachings of the present disclosure without departing from the scope thereof.

What is claimed is:

1. A sheet finisher for performing preselected processing with a sheet conveyed thereto, said sheet finisher comprising:

cutting means for cutting the sheet in a direction perpendicular to a direction of sheet conveyance in which said sheet is conveyed;

guide means positioned upstream of said cutting means in the direction of sheet conveyance for guiding the sheet being conveyed; and moving means for moving said guide means in a direction parallel to the direction of sheet conveyance, wherein said moving means includes means for causing, during sheet conveyance, said guide means to advance to a position downstream of said cutting means or means for causing, during cutting, said guide means to retract to a position upstream of said cutting means.

2. The sheet finisher as claimed in claim 1, further comprising:

a stationary guide plate;

wherein said guide means includes a movable retraction guide plate positioned downstream of said stationary guide plate in the direction of sheet conveyance.

3. The sheet finisher as claimed in claim 2, wherein an end of said stationary guide plate and an end of said movable retraction guide plate facing each other are comb-like and intersect each other in a same plane.

4. The sheet finisher as claimed in claim 2, wherein said cutting means comprises a straight stationary edge extending in the direction perpendicular to the direction of sheet conveyance, and a rotary edge rotatable in contact with said stationary edge for cutting the sheet while moving in a horizontal direction, said rotary edge is affixed to a stationary member extending across the direction of sheet conveyance in the direction perpendicular to said direction of sheet conveyance, and said moving means causes, during sheet conveyance, said movable retraction guide plate to advance to a position downstream of a position where said rotary edge contacts said stationary edge or causes, during cutting, said movable retraction guide plate to retract to a position upstream of said stationary member.

5. The sheet finisher as claimed in claim 4, wherein said moving means causes said movable retraction guide plate to start retracting after a leading edge of the sheet or a leading edge of a sheet stack has arrived at said stationary edge, but before said sheet or said sheet stack is stopped at a preselected cutting position.

6. The sheet finisher as claimed in claim 4, further comprising:

control means for causing said rotary edge to move for cutting the sheet or a sheet stack, wherein said control means causes said rotary edge to start moving from a preselected home position toward a position adjacent a side edge of said sheet or said sheet stack before said movable retraction guide plate fully retracts.

7. The sheet finisher as claimed in claim 4, further comprising:

control means for causing said rotary edge to move for cutting the sheet or a sheet stack, wherein said control means causes said rotary edge to complete a movement from a preselected home position to a position adjacent a side edge of said sheet or said sheet stack before said movable retraction guide plate frilly retracts.

CLAIM8. The sheet finisher as claimed in claim 4, wherein in a range over which said rotary edge is movable, said movable retraction guide plate is dimensioned smaller than a minimum sheet size to be dealt with in the direction perpendicular to the direction of sheet conveyance.

CLAIM9. The sheet finisher as claimed in claim 8, further comprising:

sensing means for sensing said movable retraction guide plate fully retracted.

CLAIM10. An image forming system, comprising:

an image forming apparatus comprising image forming means for forming a toner image on a sheet in accordance with image data; and a sheet finisher configured to perform preselected processing with the sheet introduced thereinto from said image forming apparatus;

said sheet finisher comprising:

cutting means for cutting the sheet in a direction perpendicular to a direction of sheet conveyance in which said sheet is conveyed;

guide means positioned upstream of said cutting means in the direction of sheet conveyance for guiding the sheet being conveyed; and moving means for moving said guide means in a direction parallel to the direction of sheet conveyance, wherein said moving means includes means for causing, during sheet conveyance, said guide means to advance to a position downstream of said cutting means or means for causing, during cutting, said guide means to retract to a position upstream of said cutting means.

CLAIM11. A sheet finisher for performing preselected processing with a sheet conveyed thereto, said sheet finisher comprising:

a cutting mechanism configured to cut the sheet in a direction perpendicular to a direction of sheet conveyance in which said sheet is conveyed;

a guide positioned upstream of said cutting mechanism in the direction of sheet conveyance for guiding the sheet being conveyed; and a moving mechanism configured to move said guide in a direction parallel to the direction of sheet conveyance, wherein said moving mechanism is configured to cause, during sheet conveyance, said guide to advance to a position downstream of said cutting mechanism or to cause, during cutting, said guide to retract to a position upstream of said cutting mechanism; and a stationary guide plate, wherein said guide comprises a movable retraction guide plate positioned downstream of said stationary guide plate in the direction of sheet conveyance, and said movable retraction guide plate slides out from the stationary guide plate during said cutting to a position upstream from said stationary guide plate.

CLAIM12. The sheet finisher as claimed in claim 11, wherein said cutting mechanism comprises a straight stationary edge extending in the direction perpendicular to the direction of sheet conveyance, and a rotary edge rotatable in contact with said stationary edge for cutting the sheet while moving in a horizontal direction, said rotary edge is affixed to a stationary member extending across the direction of sheet conveyance in the direction perpendicular to said direction of sheet conveyance, and said moving mechanism causes, during sheet conveyance, said movable retraction guide plate to advance to a position downstream of a position where said rotary edge contacts said stationary edge or causes, during cutting, said movable retraction guide plate to retract to a position upstream of said stationary member.

CLAIM13. The sheet finisher as claimed in claim 12, wherein said moving mechanism causes said movable retraction guide plate to start retracting after a leading edge of the sheet or a leading edge of a sheet stack has arrived at said stationary edge, but before said sheet or said sheet stack is stopped at a preselected cutting position.

CLAIM14. The sheet finisher as claimed in claim 12, further comprising:

a controller configured to cause said rotary edge to move for cutting the sheet or a sheet stack, wherein said controller causes said rotary edge to start moving from a preselected home position toward a position adjacent a side edge of said sheet or said sheet stack before said movable retraction guide plate fully retracts.

CLAIM15. The sheet finisher as claimed in claim 12, further comprising:

a controller configured to cause said rotary edge to move for cutting the sheet or a sheet stack, wherein said controller causes said rotary edge to complete a movement from a preselected home position to a position adjacent a side edge of said sheet or said sheet stack before said movable retraction guide plate fully retracts.

CLAIM16. The sheet finisher as claimed in claim 12, wherein in a range over which said rotary edge is movable, said movable retraction guide plate is dimensioned smaller than a minimum sheet size to be dealt with in the direction perpendicular to the direction of sheet conveyance.

CLAIM17. The sheet finisher as claimed in claim 16, further comprising:

a sensor configured to sense said movable retraction guide plate fully retracted.

CLAIM18. An image forming system, comprising:

an image forming apparatus comprising an image forming mechanism configured to form a toner image on a sheet in accordance with image data; and a sheet finisher configured to perform preselected processing with the sheet introduced thereinto from said image forming apparatus;

said sheet finisher comprising:

a cutting mechanism configured to cut the sheet in a direction perpendicular to a direction of sheet conveyance in which said sheet is conveyed;

a guide positioned upstream of said cutting mechanism in the direction of sheet conveyance for guiding the sheet being conveyed; and a moving mechanism configured to move said guide in a direction parallel to the direction of sheet conveyance, wherein said moving mechanism is configured to cause, during sheet conveyance, said guide to advance to a position downstream of said cutting mechanism or to cause, during cuffing, said guide to retract to a position upstream of said cutting mechanism; and a stationary guide plate, wherein said guide comprises a movable retraction guide plate positioned downstream of said stationary guide plate in the direction of sheet conveyance, and said movable retraction guide plate slides out from the stationary guide plate during said cutting to a position upstream from said stationary guide plate.

* * * * *